US011613929B2

(12) United States Patent
Miess et al.

(10) Patent No.: US 11,613,929 B2
(45) Date of Patent: Mar. 28, 2023

(54) DYNAMIC DRILLING SYSTEMS AND METHODS

(71) Applicant: XR Dynamics, LLC, Housto, TX (US)

(72) Inventors: David P. Miess, Spring, TX (US); Michael V. Williams, Conroe, TX (US); James Dudley, Magnolia, TX (US)

(73) Assignee: XR Dynamics LLC, Houston, TX (US)

( * ) Notice: Subject to any disclaimer, the term of this patent is extended or adjusted under 35 U.S.C. 154(b) by 0 days.

(21) Appl. No.: 17/092,759

(22) Filed: Nov. 9, 2020

(65) Prior Publication Data

US 2021/0140239 A1 May 13, 2021

Related U.S. Application Data

(60) Provisional application No. 62/932,990, filed on Nov. 8, 2019.

(51) Int. Cl.

| | |
|---|---|
| ***E21B 4/00*** | (2006.01) |
| ***E21B 7/06*** | (2006.01) |
| ***E21B 4/16*** | (2006.01) |
| ***E21B 4/02*** | (2006.01) |

(52) U.S. Cl.

CPC ..... *E21B 4/003* (2013.01); *E21B 4/02* (2013.01); *E21B 4/16* (2013.01); *E21B 7/06* (2013.01); *E21B 7/068* (2013.01)

(58) Field of Classification Search

CPC ..... E21B 7/06; E21B 4/003

See application file for complete search history.

(56) References Cited

U.S. PATENT DOCUMENTS

| | | | |
|---|---|---|---|
| 1,853,933 | A | 4/1932 | Schmidt |
| 1,892,217 | A | 12/1932 | Moineau |
| 2,028,407 | A | 1/1936 | Moineau |
| 2,084,638 | A | 6/1937 | Goodwin |
| 2,997,325 | A | 8/1961 | Peterson |
| 3,260,318 | A | 7/1966 | Neilson et al. |
| 3,712,151 | A | 1/1973 | Diehl |
| 3,918,301 | A | 11/1975 | Baer |
| 4,144,001 | A | 3/1979 | Streicher |
| 4,266,619 | A | 5/1981 | Bodine |

(Continued)

FOREIGN PATENT DOCUMENTS

DE 2611672 A1 9/1977

OTHER PUBLICATIONS

International Search Report and Written Opinion dated Mar. 25, 2021 (issued in PCT Application No. PCT/US2020/059646) [20 pages].

(Continued)

*Primary Examiner* — Giovanna Wright
(74) *Attorney, Agent, or Firm* — Michael S. McCoy; Amatong McCoy LLC

(57) ABSTRACT

Methods, systems, and apparatus for imparting and limiting hypocycloidal, lateral, and torsional forces onto drill bits are provided, including hypocycloidal bearings for limiting hypocycloidal motion, lateral impulse mechanisms for imparting lateral movement to a drill bit, and torsional impulse mechanisms for imparting torsional movement to a drill bit. The methods systems, and apparatus may decrease friction, increase drilling efficiency, and provide additional benefits to drilling systems.

37 Claims, 32 Drawing Sheets

(56) References Cited

U.S. PATENT DOCUMENTS

| | | | | |
|---|---|---|---|---|
| 4,271,915 | A | 6/1981 | Bodine | |
| 4,394,881 | A | 7/1983 | Shirley | |
| 4,428,302 | A | 1/1984 | Herring, Jr. | |
| 4,491,428 | A | 1/1985 | Burr et al. | |
| 4,527,637 | A | 7/1985 | Bodine | |
| 4,651,981 | A | 3/1987 | Passiniemi | |
| 4,962,822 | A | 10/1990 | Pascale | |
| 5,165,473 | A | 11/1992 | Bode | |
| 5,265,684 | A | 11/1993 | Rosenhauch | |
| 5,549,464 | A | 8/1996 | Varadan | |
| 5,875,859 | A | 3/1999 | Ikeda et al. | |
| 6,102,378 | A | 8/2000 | Gieseler et al. | |
| 6,394,431 | B1 | 5/2002 | Smith | |
| 6,637,348 | B1 | 10/2003 | Teichmann et al. | |
| 6,742,609 | B2 | 6/2004 | Gillis et al. | |
| 6,769,499 | B2 | 8/2004 | Cargill et al. | |
| 6,945,338 | B1 | 9/2005 | Defourny et al. | |
| 7,373,995 | B2 | 5/2008 | Hughes et al. | |
| 7,661,485 | B2 | 2/2010 | Vögele et al. | |
| 7,926,883 | B2 | 4/2011 | Hall et al. | |
| 8,851,204 | B2 | 10/2014 | Knull et al. | |
| 9,016,405 | B2 | 4/2015 | Cooley et al. | |
| 9,193,239 | B2 | 11/2015 | Willems | |
| 9,242,047 | B2 | 1/2016 | Brereton et al. | |
| 9,334,691 | B2 | 5/2016 | Jarvis et al. | |
| 9,605,484 | B2 | 3/2017 | Gillis et al. | |
| 9,687,607 | B2 | 6/2017 | Brereton et al. | |
| 9,695,638 | B2 | 7/2017 | Murray et al. | |
| 10,465,775 | B1 | 11/2019 | Miess et al. | |
| 10,626,674 | B2 | 4/2020 | Spatz et al. | |
| 10,662,711 | B2 | 5/2020 | Reese et al. | |
| 10,738,821 | B2 | 8/2020 | Miess et al. | |
| 10,760,615 | B2 | 9/2020 | Miess et al. | |
| 2004/0028536 | A1 * | 2/2004 | Bakke | E21B 4/02 417/273 |
| 2008/0085203 | A1 | 4/2008 | Amburgey et al. | |
| 2009/0044980 | A1 | 2/2009 | Sheppard et al. | |
| 2011/0198126 | A1 | 8/2011 | Swietlik et al. | |
| 2013/0048384 | A1 | 2/2013 | Jarvis et al. | |
| 2013/0264119 | A1 | 10/2013 | Gynz-Rekowski et al. | |
| 2014/0170011 | A1 | 6/2014 | Clouzeau et al. | |
| 2014/0224546 | A1 | 8/2014 | Boulet | |
| 2014/0246234 | A1 | 9/2014 | Gillis et al. | |
| 2014/0369875 | A1 | 12/2014 | Samad et al. | |
| 2016/0108674 | A1 | 4/2016 | Gynz-Rekowski et al. | |
| 2016/0108677 | A1 | 4/2016 | Gynz-Rekowski et al. | |
| 2017/0051560 | A1 | 2/2017 | Slaughter, Jr. | |
| 2017/0145748 | A1 | 5/2017 | Murray et al. | |
| 2018/0128052 | A1 | 5/2018 | Herbig et al. | |
| 2018/0179823 | A1 | 6/2018 | Spatz et al. | |
| 2018/0179831 | A1 | 6/2018 | Spatz et al. | |
| 2019/0055785 | A1 | 2/2019 | Spatz et al. | |
| 2019/0169935 | A1 | 6/2019 | Spatz et al. | |
| 2019/0211896 | A1 | 7/2019 | Prevost et al. | |
| 2019/0309575 | A1 | 10/2019 | Spatz et al. | |
| 2020/0031586 | A1 | 1/2020 | Miess et al. | |
| 2020/0056659 | A1 | 2/2020 | Prevost et al. | |
| 2020/0063498 | A1 | 2/2020 | Prevost et al. | |
| 2020/0063503 | A1 | 2/2020 | Reese et al. | |
| 2020/0325933 | A1 | 10/2020 | Prevost et al. | |
| 2020/0355213 | A1 | 11/2020 | Prevost | |
| 2020/0362956 | A1 | 11/2020 | Prevost et al. | |
| 2020/0378440 | A1 | 12/2020 | Prevost et al. | |

OTHER PUBLICATIONS

Bourke, J. David, Compensating Eccentric Motion in Progressing Cavity Pumps, accessed on Jan. 7, 2019. Cover Page, pp. 1-5 (6 Pages total), Moyno.

Gravesen, Jens, The Geometry of the Moineau Pump, Mar. 26, 2008, pp. 1-14.

Sazonov, Yu. A.; Mokhov, M.A.; and Frankov, M.A., Development of Compact Hydraulic Positive Displacement Motor Featuring No Rotor Vibrations in Well Drilling, Indian Journal of Science and Technology, Nov. 2016, pp. 1-8, vol. 9(42), DOI: 10.17485/ijst/2016/v9i42/104220, ISSN (Print): 0974-6846, ISSN (Online): 0974-5645, www.indjst.org.

* cited by examiner

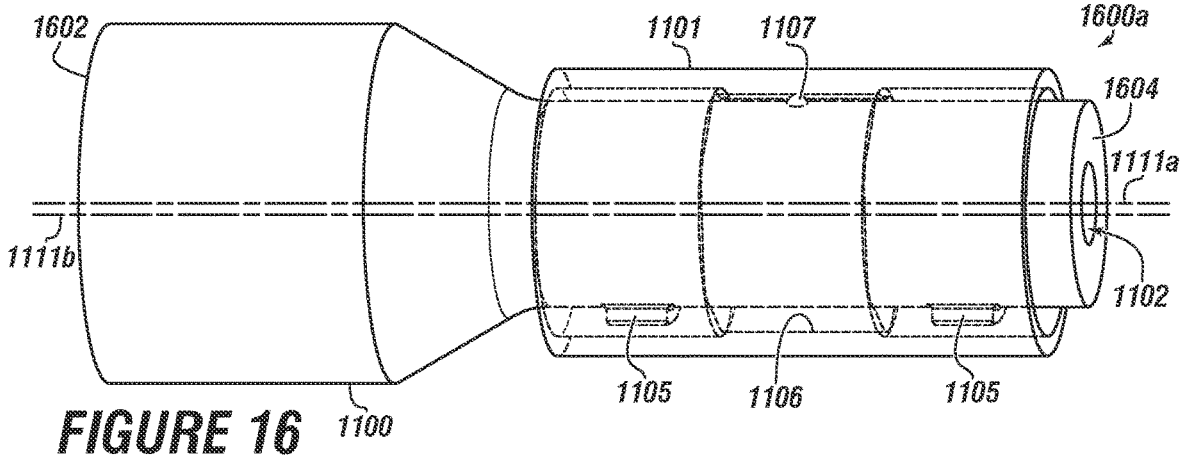
FIGURE 16
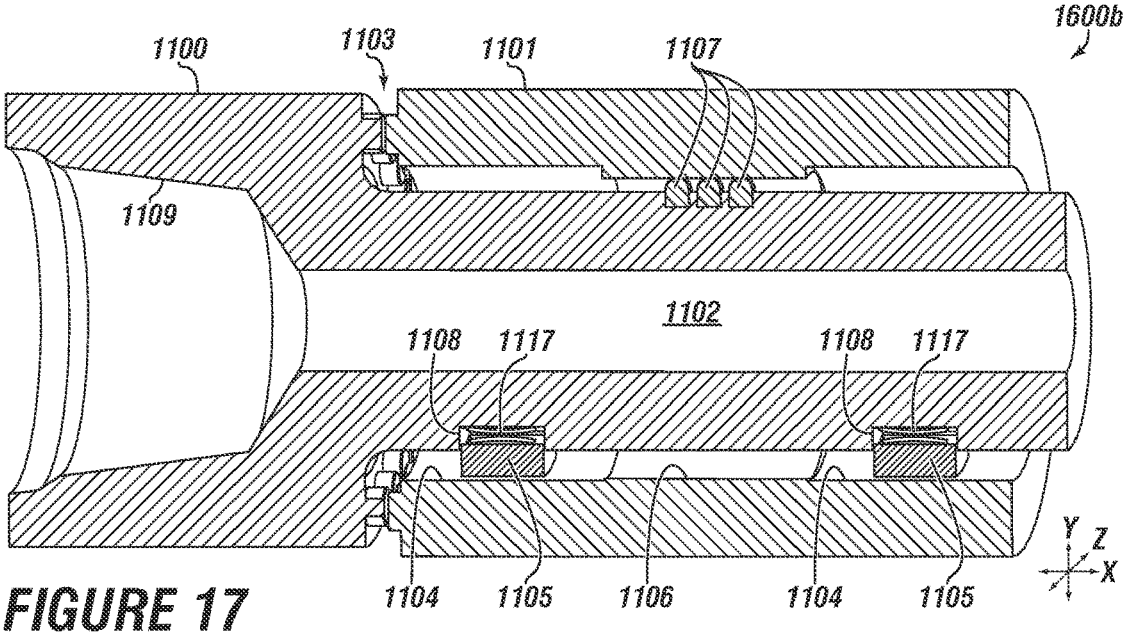
FIGURE 17
FIGURE 18
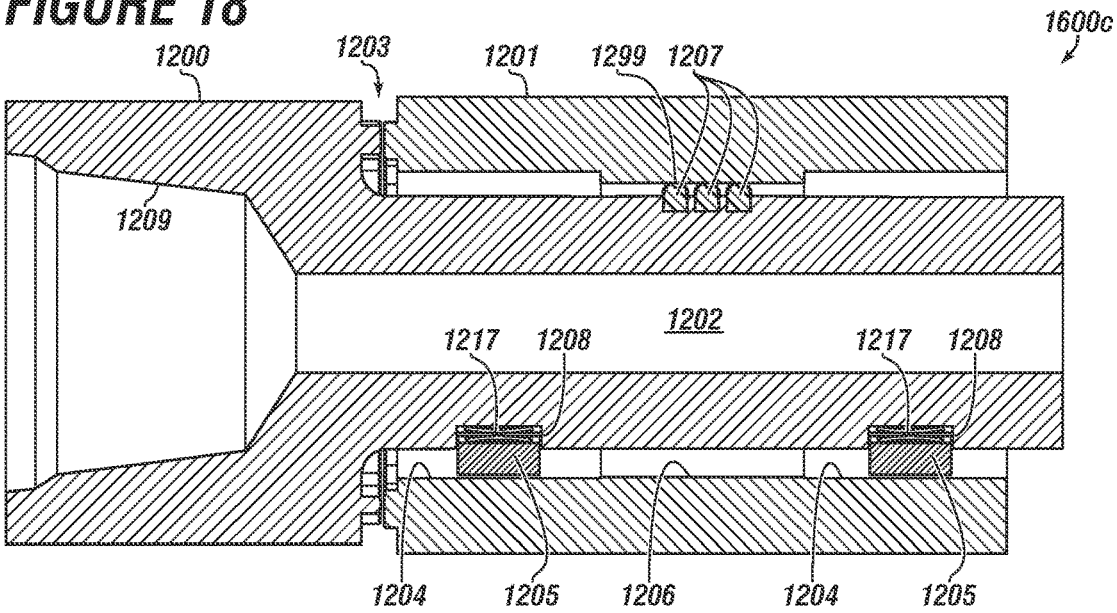

FIGURE 21
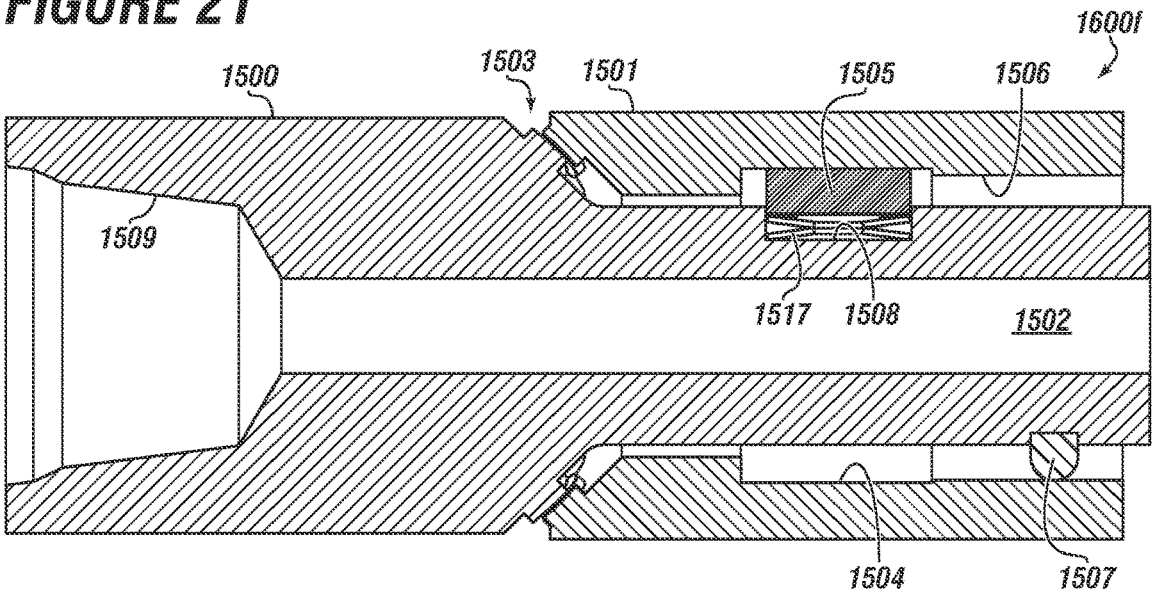
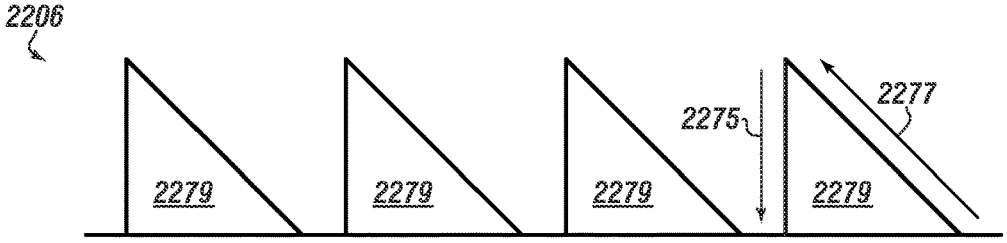
FIGURE 22
FIGURE 23
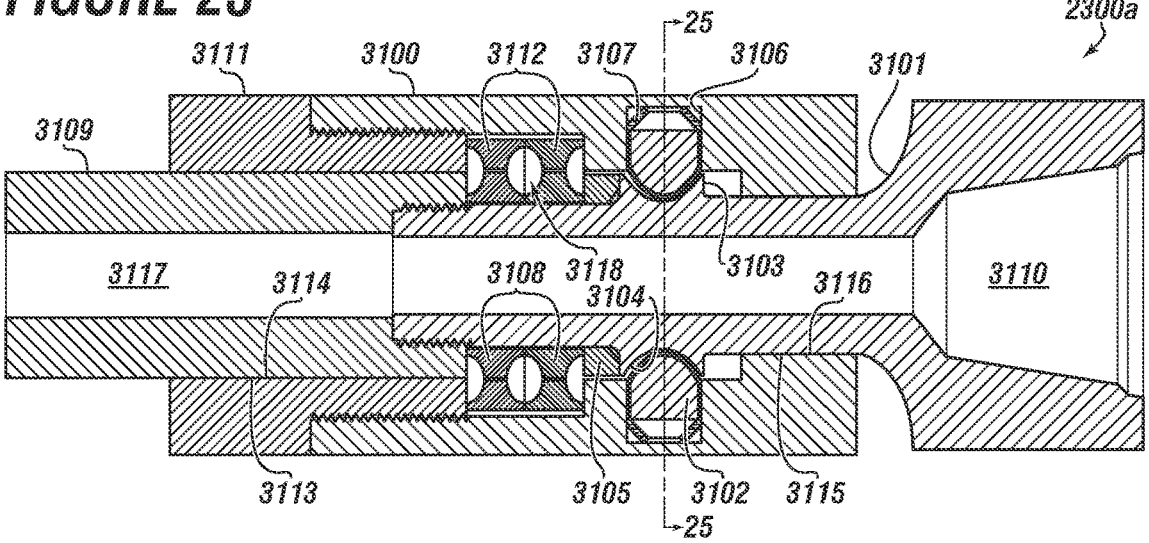

FIGURE 28
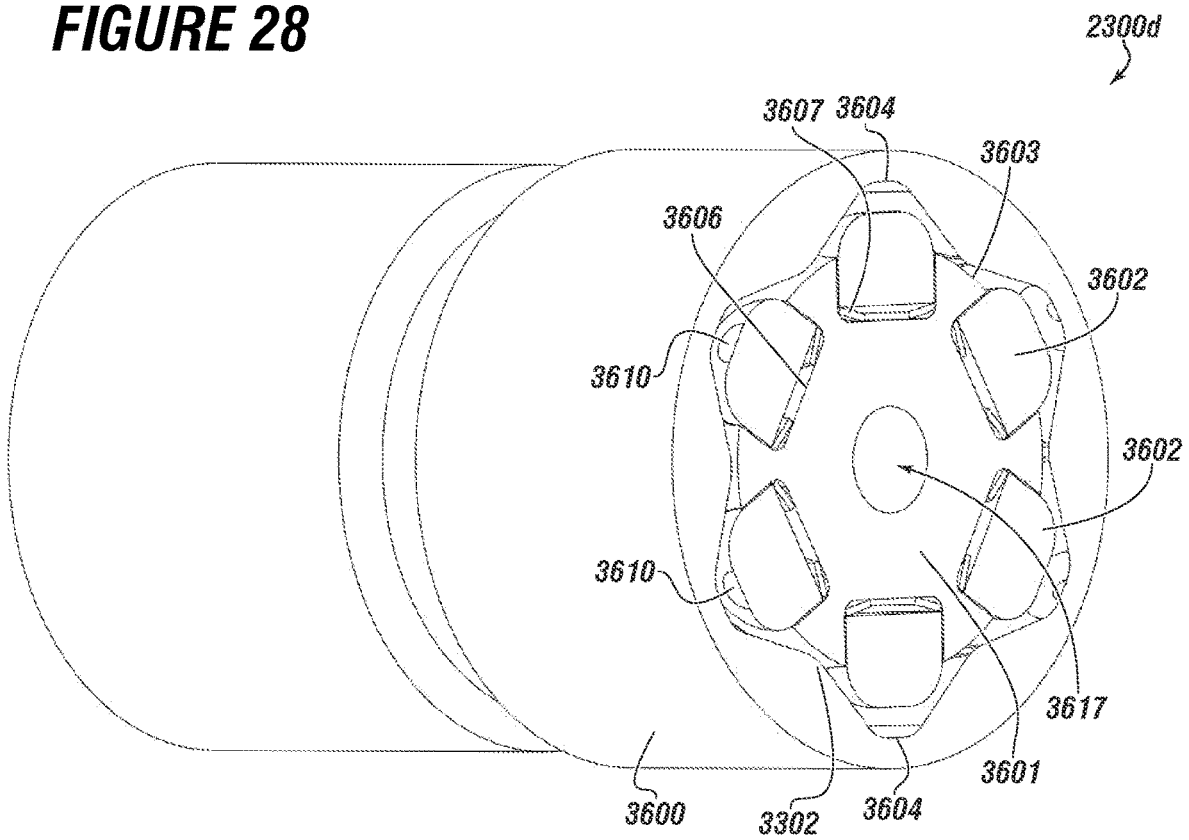
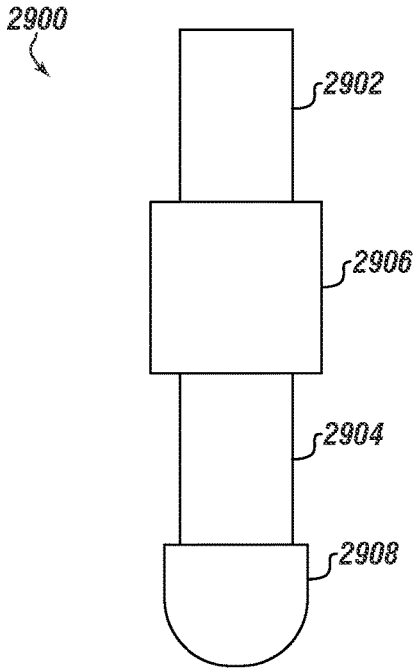
FIGURE 29

DYNAMIC DRILLING SYSTEMS AND METHODS

CROSS-REFERENCE TO RELATED APPLICATIONS

The present application claims the benefit of U.S. Provisional Patent Application No. 62/932,990, filed on Nov. 8, 2019, and entitled "Dynamic Drilling Systems and Methods," the entirety of which is incorporated herein by reference.

FIELD

The present disclosure relates to dynamic drilling systems and methods, including hypocycloidal bearings for use with progressive cavity positive displacement motors and pumps; dynamic lateral impulse drilling systems; and dynamic torsional detent drilling systems; as well as to methods of making and using the same.

BACKGROUND

Hydrocarbon retorts, for the most part, reside beneath layers of dirt and rock (and sometimes water as well). To access and retrieve the hydrocarbons, companies drill wells that extend from the surface to the hydrocarbon retorts. Wells may be vertical or non-vertical. Vertical wells provide a reasonably straight drill path that is generally intended to be perpendicular to the Earth's surface, with the drill bit operational along the axis of the drill string to which it is attached. Non-vertical wells, also known as directional wells, usually involve directional drilling. Directionally drilling a well requires movement of the drill bit off the axis of the drill string. Generally, a directionally drilled wellbore includes a vertical section up to a kickoff point where the wellbore deviates from vertical to or towards horizontal.

Drill strings used in directional drilling typically include a number of segments, including drill piping or tubulars extending from the surface, a mud motor (e.g., a positive displacement progressive cavity mud powered motor) and a drill bit. The mud motor may include a rotor catch assembly, a power section, a transmission, a bearing package, and a bit drive shaft with a bit box. The power section generally includes a stator housing connected to and part of the drill string, and a rotor. The mud motor is powered by energy harvested from drilling mud as the mud passes through the power section. The drilling mud is pumped at high pressures and volumes from the surface down the internal cavities of a drill string and through the power section. Mud passing through the power section rotates the rotor with respect to the stator housing. The rotor, in-turn, drives rotation, through a transmission driveline and bit drive shaft, to a drill bit.

Mud motors typically take advantage of a hypocycloid motion of the rotor within the stator. A "hypocycloid motion" of an object (e.g., a rotor), is a pattern of movement of the object for which a fixed point on the object (e.g., a blade of the rotor) traces a hypocycloid as the object rolls within another object (e.g., as the rotor rolls within a stator), where the hypocycloid is a plane curve. In a typical mud motor, the rotor is made out of metal. The stator is configured to receive the rotor and includes a rubber interior. As the rotor rotates, it rolls against the rubber interior of the stator. This rolling of the metal rotor on the rubber interior of the stator results in the degradation of the rubber interior, potentially exposing a metal interior surface of the stator.

For example, the rubber may "chunk," such that pieces of the rubber separate and fall off the stator, and/or the rubber may crack. Upon degradation of the rubber interior, the metal rotor rolls on the metal interior surface of the stator. This results in a change in the hypocycloidal motion path of the rotor within the stator, such that the output rotation axis of the rotor within the stator is no longer centered within the stator, but is off-center. Off-center hypocycloid motion of the rotor can result in stalling of the motor and a loss of angular momentum. Thus, the mud motor may exhibit a loss of efficiencies and an accompanying fluid leakage.

BRIEF SUMMARY

Some embodiments of the present disclosure include a downhole drilling assembly. The downhole drilling assembly includes a mud motor, including a motor housing having a stator disposed on an inner surface thereof. The motor housing and stator define a cavity, and a progressive cavity rotor is positioned within the cavity and engaged with the stator. Rotation of the rotor within the cavity follows a hypocycloidal motion. A drill bit or cutting assembly may be coupled to the rotor. At least one hypocycloid radial bearing is engaged with the rotor and configured to support the rotor as the rotor rotates within the stator.

Other embodiments of the present disclosure include a progressive cavity pump or motor. The pump or motor includes a progressive cavity rotor positioned within at least one progressive cavity stator. At least one hypocycloid radial bearing is coupled with the rotor and configured to support the rotor as the rotor rotates within the stator.

Other embodiments of the present disclosure include a method of limiting hypocycloidal motion of a progressive cavity rotor within a progressive cavity stator. The method includes coupling the rotor with at least one hypocycloidal radial bearing that is configured to support the rotor as the rotor rotates within the stator. In some aspects, the method includes limiting excessive hypocycloidal motion of the progressive cavity rotor within the progressive cavity stator. As used herein "excessive" hypocycloidal motion of a rotor refers to hypocycloidal motion of the rotor beyond a predetermined limit where orbit of the rotor imparts sufficient load on the stator to cause degradation of the stator or to cause an undesirable degree of degradation to the rubber interior of the stator.

Some embodiments of the present disclosure include a dynamic lateral impulse drilling assembly of a drill string. The assembly includes a mandrel shaft and a bearing housing. The bearing housing is coupled with the mandrel shaft via sliding engagement between at least one primary bearing pad and at least one primary bearing surface, and via sliding engagement between at least one wear element and at least one secondary bearing surface. The at least one secondary bearing surface is an undulating surface. In some such embodiments, the mandrel shaft includes the at least one primary bearing pad and the at least one wear-resistant element thereon, and the bearing housing includes the at least one primary bearing surface and the at least one secondary bearing surface thereon. In other such embodiments, the bearing housing includes the at least one primary bearing pad and the at least one wear-resistant element thereon, and the mandrel shaft includes the at least one primary bearing surface and the at least one secondary bearing surface thereon.

Other embodiments of the present disclosure include a method of drilling using a drill string that includes a mandrel shaft slidingly coupled with a bearing housing. The method includes rotating the mandrel shaft relative to the bearing housing. While rotating the mandrel shaft, the method includes laterally moving the mandrel shaft relative to a longitudinal axis of the bearing housing. In some embodiments, the lateral movement of the mandrel shaft is induced by sliding a wear-resistant element along an undulating bearing surface between the mandrel shaft and the bearing housing.

Other embodiments of the present disclosure include a dynamic torsional detent drilling assembly of a drill string. The assembly includes a mandrel shaft and a lower bearing housing. The lower bearing housing is rotatably coupled with the mandrel shaft via sliding contact between a contoured race and at least one wear-resistant element. The contoured race includes at least one concave pocket and at least one ridge. In some such embodiments, the mandrel shaft includes the contoured race on an outer surface thereof, and the lower bearing housing includes the at least one wear-resistant element on an inner surface thereof. In other such embodiments, the lower bearing housing includes the contoured race on an inner surface thereof, and the mandrel shaft includes the at least one wear-resistant element on an outer surface thereof.

Other embodiments of the present disclosure include a method of drilling using a drill string that includes a mandrel shaft slidingly coupled with a bearing housing. The method includes rotating the mandrel shaft relative to the bearing housing. While rotating the mandrel shaft, the method includes imparting a torsional impulse to the mandrel shaft. The torsional impulse is induced by sliding a wear-resistant element along a contoured race, capturing the wear-resistant element within a concave pocket on the contoured race, and applying torque to the wear-resistant element captured within the concave pocket until the applied torque is sufficient to release the wear-resistant element from the concave pocket.

Other embodiments of the present disclosure include a method of drilling. The method includes providing a helical positive displacement motor that includes a rotor and a stator. The rotor is an elongated body positioned to roll inside of an inner diameter of the stator. A mandrel shaft and drill bit are coupled with the rotor. The method includes rotating the rotor within the stator. While rotating the rotor within the stator, cusps of the rotor maintain contact with cusps of the stator. Rotation of the rotor within the stator follows a hypocycloidal motion. Rotation of the rotor within the stator imparts a hypocycloidal orbiting motion to the drill bit.

BRIEF DESCRIPTION OF THE DRAWINGS

So that the manner in which the features and advantages of the systems, products, and/or methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

FIG. 16 is an isometric view of a lateral impulse drilling mechanism including two primary bearing pads, and one wear resistant element in sliding engagement between the mandrel shaft and secondary bearing surface, in accordance with certain aspects of the present disclosure.

FIG. 17 is an isometric cross-sectional view of the lateral impulse drilling mechanism of FIG. 16.

FIG. 18 is a cross-sectional side view of the lateral impulse drilling mechanism of FIG. 16.

FIG. 21 is an isometric view of a lateral impulse drilling mechanism including one primary bearing pad and one wear resistant element cluster.

FIG. 22 is a simplified depiction of a sawtooth shaped undulating surface.

FIG. 23 is a cross-sectional view of a dynamic torsional detent mechanism.

FIG. 28 is another perspective view of a dynamic torsional detent mechanism.

FIG. 29 is a simplified schematic of a drill string.

Products, apparatus, systems, and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

Certain aspects of the present disclosure include a hypocycloid bearing assembly and a drill string incorporating the same. While depicted and described herein as incorporated into a drill string, one skilled in the art would understand that the hypocycloid bearing assemblies disclosed herein are not limited to use with drill strings, and may be incorporated into positive displacement progressive cavity pumps or motors used in a variety of other applications, such as sewer system pumps and mine dewatering pump systems. In some embodiments, the hypocycloid bearing assemblies disclosed herein may be incorporated into preexisting industrial hypocycloid progressive cavity pumps, such as those manufactured by MOYNO™. U.S. Pat. Nos. 1,892,217; 2,028,407; and 3,260,318 provide background helpful in the understanding of certain subject matter discussed herein, and are, therefore, hereby incorporated by reference for all purposes and made a part of the present disclosure.

Hypocycloid Bearing Assembly—Upper Mount

Figure 1:
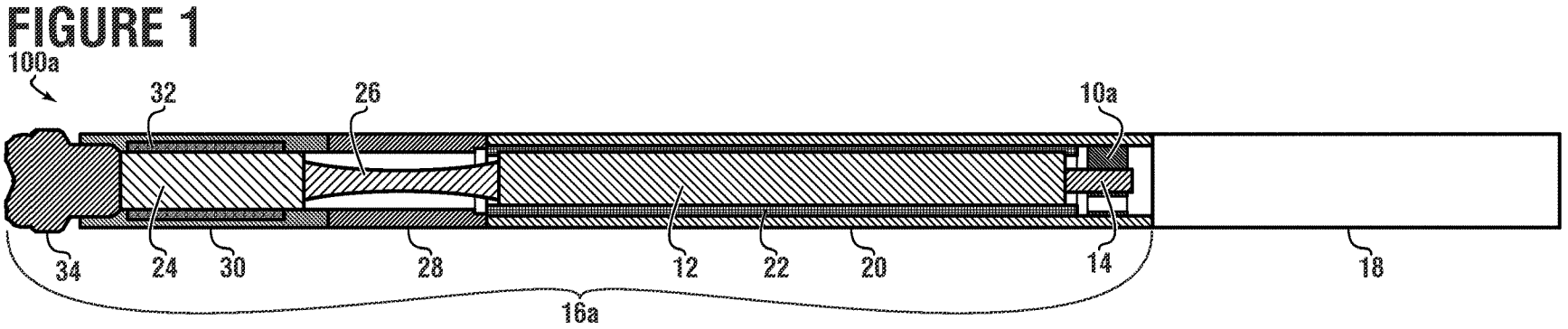
FIG. 1 is a side, cross-sectional view of a hypocycloid bearing assembly, including a hypocycloid bearing positioned above the rotor, and a classical, radial and thrust bearing set and transmission positioned below the rotor.

FIG. 1 is a side, cross-sectional view of drill string assembly 100*a* having hypocycloid bearing 10*a* assembled therewith. A portion of bottomhole assembly 16*a* is depicted, while other components of the bottomhole assembly and drill string are not shown. Above bottomhole assembly 16*a* (i.e., further away from drill bit 34, along drill string assembly 100*a*) drill string assembly 100*a* includes drill string 18 (e.g., piping and/or tubulars) extending to the surface. Bottom hole assembly 16*a* includes a power section including a mud motor (i.e., a positive displacement progressive cavity motor driven by drilling mud that is pumped downhole) that is composed, at least in part, of motor housing 20 (also referred to as the stator housing), stator 22, and rotor 12. In some embodiments, the mud motor is a steerable mud motor. In other embodiments, the mud motor is not steerable. Motor housing 20 may be made of steel, for example. Stator 22 is positioned within motor housing 20. In some embodiments, stator 22 is disposed on the inner wall of motor housing 20. In some embodiments, stator 22 is bonded to or otherwise attached to or coupled with the inner wall of motor housing 20. Stator 22 may be made of a polymeric material, such as an elastomer (e.g., rubber). Stator 22 and/or motor housing 20 are coupled with adjacent piping or tubulars 18.

Stator 22 defines an inner cavity within which rotor 12 is positioned. Rotor 12 may be made of steel, for example. As would be understood by one skilled in the art, with rotor 12 engaged within stator 22, the hydraulic horsepower of drilling mud flowing through the cavity of stator 22 causes rotor 12 to rotate within the cavity of stator 22. Rotor 12 is coupled with transmission (here shown as a flex joint 26), the transmission is coupled with bit shaft 24, and the bit shaft 24 is coupled with bit 34. The rotational force of rotor 12 is transmitted to bit shaft 24 through the transmission, which, in this embodiment, is includes flex joint 26 positioned within transmission housing 28. Transmission housing 28 may be a part of the drill string of drill string assembly 100*a*. Thus, the transmission couples rotor 12 with bit shaft 24 via a transmission driveline, which, here, includes the flex joint 26. However, one skilled in the art would understand that the transmission is not limited to the particular transmissions shown in the Figures provided herein.

Bit shaft 24 is positioned within a bearing package which, in this embodiment, includes bearing housing 30, which is a part of the drill string of drill string assembly 100*a*. Bearing housing 30 contains bearings 32. As shown, bearing housing 30 contains thrust and radial bearings 32. However, one skilled in the art would understand that other types of bearings and bearing arrangements may be used.

Bit shaft 24 transmits the rotational force to bit 34. Bit 34 may be any of a number of different styles or types of drill bits. Bit 34 may be a polycrystalline diamond cutter (PDC) design, a roller cone (RC) design, an impregnated diamond design, a natural diamond cutter (NDC) design, a thermally stable polycrystalline (TSP) design, a carbide blade/pick design, a hammer bit (a.k.a. percussion bits) design, or another bit design. Each different rock destruction mechanisms (i.e., drill bit) has qualities that make it a desirable choice depending on the formation to be drilled and the available energy in association with the drilling apparatus.

Rotor 12 is coupled with drill string 18 via rotor extension 14 (e.g., a rotor catch assembly of rotor 12). With mud flow, drilling mud (not shown) travels down internal cavities of drill string assembly 100*a*, including through the cavity of stator 22, causing rotor 12 to rotate with respect to stator 22 and motor housing 20 and therefore drill string 18. Rotor 12 drives rotation through the transmission flex joint 26 and bit shaft 24, to bit 34. Depending on the direction of rotation (clockwise or counter clockwise) of rotor 12 relative to drill string 18, the power section can increase, decrease or reverse the relative rotation rate of bit 34 with respect to the rotating drill string 18.

Movement of Rotor Within Stator

Figure 7:
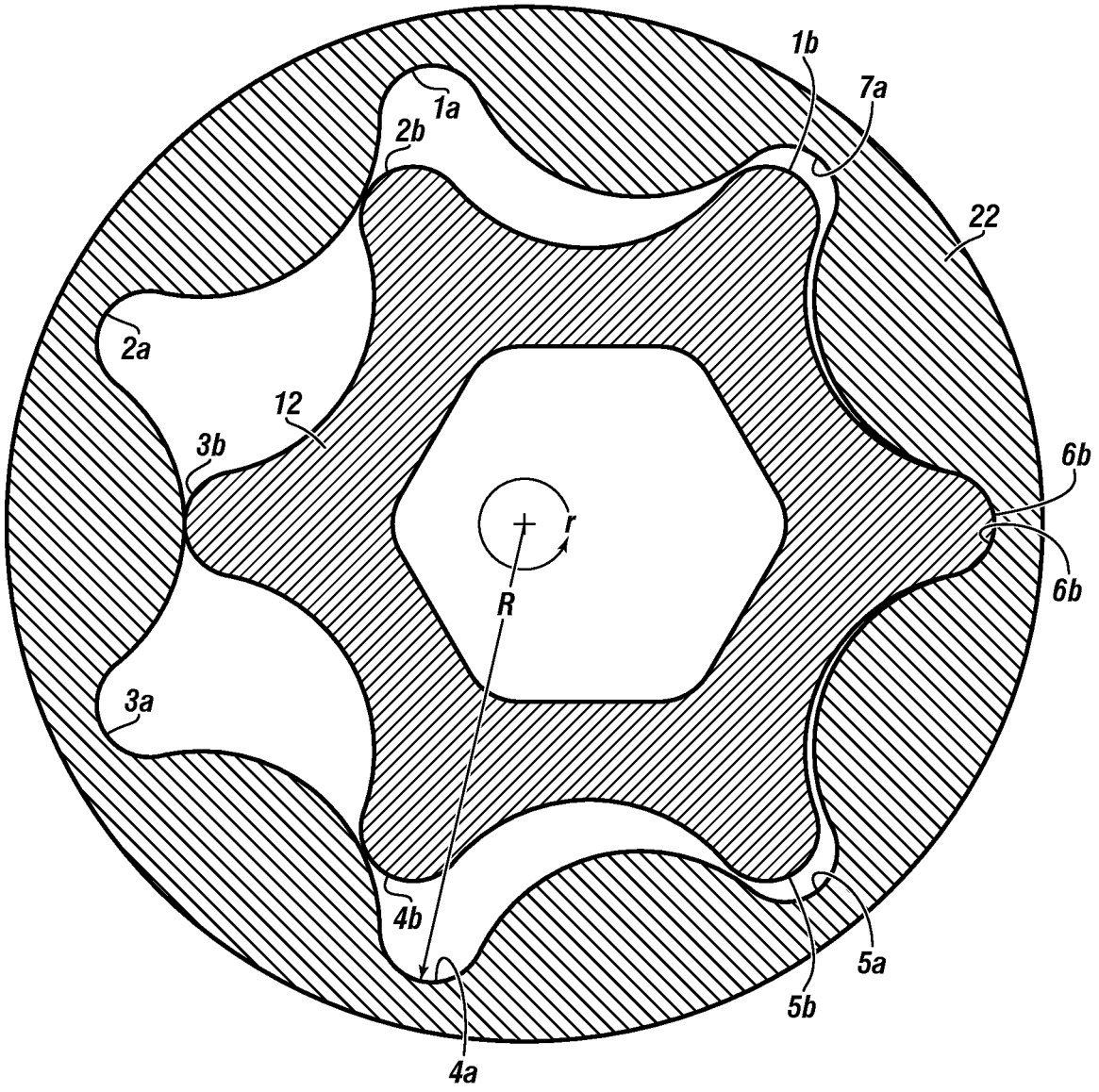
FIG. 7 is a simplified illustration of the movement of a rotor within a stator.

In the embodiment shown in FIG. 1, hypocycloid bearing 10*a* is positioned above rotor 12 (i.e., further away from bit 24 along drill string assembly 100*a* than rotor 12), and is coupled with rotor extension 14. Rotation of rotor 12 follows a hypocycloidal motion within the cavity of stator 22. For the purposes of illustration only, and without limitation, FIG. 7 depicts an exemplary, simplified illustration of the hypocycloidal motion of rotor 12 within stator 22. In FIG. 7, "R" is the radius of stator 22 (i.e., stator major diameter) and "r" is the orbit of rotor 12 in stator 22. The kusps of stator 22 are labeled 1*a*, 2*a*, 3*a*, 4*a*, 5*a*, 6*a*, and 7*a* in FIG. 7, and the rotor blades are labeled 1*b*, 2*b*, 3*b*, 4*b*, 5*b*, and 6*b*. The number of rotor blades is one less than the number of kusps in stator 22. The rotor radius is equal to: (k−1)/k*R. In the equation, k is the number of kusps in stator 22, where the number of rotor blades is equal to k−1. Without being bound by theory, for a mud motor it is believed that R=k*r. For example, if R is 2.5 and k is 7, then r is 0.357 (i.e., r=2.5/7). Also, in this example, the number of rotor blades is 6 (i.e., 7−1), and the stator radius is 2.143 (i.e., (7−1)/7*2.5)). Although FIG. 7 is shown with 6 rotor blades, one skilled in the art readily appreciates the number of rotor blades can be varied without departing from the ideas disclosed herein. In operation, the rotor spins and rotates about orbit r. Orbit r is a function of the radius of the stator and the number kusps in the stator.

The loads on the stator wall increase with the speed of the rotor and pressure across the motor. When the loads get high enough, the stator material begins to compress and deform. When this happens, the rotor orbit increases beyond the predicted orbit r. Still higher loads on the stator degrade and eventually destroy the stator.

In the configuration shown in FIG. 1, hypocycloid bearing 10*a* is coupled with rotor 12. Hypocycloid bearing 10*a* restrains the orbit of rotor 12. Restraining the orbit of rotor 12 reduces and, in some embodiments, eliminates increased loading on stator 22 as speed of the motor is increased to produce more power. Hypocycloid bearing 10*a*, thus, limits the impact force of rotor 12 onto stator 22. Limiting the hypocycloidal motion of rotor 12 within stator 22 reduces the degradation of stator 22 by rotor 12, by reducing the amount and/or degree of rolling of the metal rotor 12 on stator 22. As such, hypocycloid bearing 10*a* reduces or prevents changes in the hypocycloidal motion path of rotor 12 within stator 22 that would otherwise reduce the life and efficiency of the mud motor. Reducing or preventing off-center hypocycloid motion of rotor 12 correspondingly reduces or prevents stalling of rotor 12 and/or loss of angular momentum that can be transferred from rotor 12 to bit 34.

In some embodiments, the hypocycloid bearing diameters and hypocycloid bearing span (generally the bearing length) are equal, or the hypocycloid bearing span is greater than the hypocycloid bearing diameters, preventing cocking of the hypocycloid bearings. In some embodiments, the hypocycloid bearing may be made shorter by having the hypocycloid bearing contact area ground to a desired profile, such as a "watermelon" profile with the hypocycloid bearing having a larger diameter in a middle portion and a slight (e.g., 0.002-0.003") taper at the ends of the hypocycloidal bearing. For example, in some applications, the "watermelon" profile of a hypocycloid bearings accommodates for a bend or flex shaft.

Upper and Lower Mount

Figure 2:
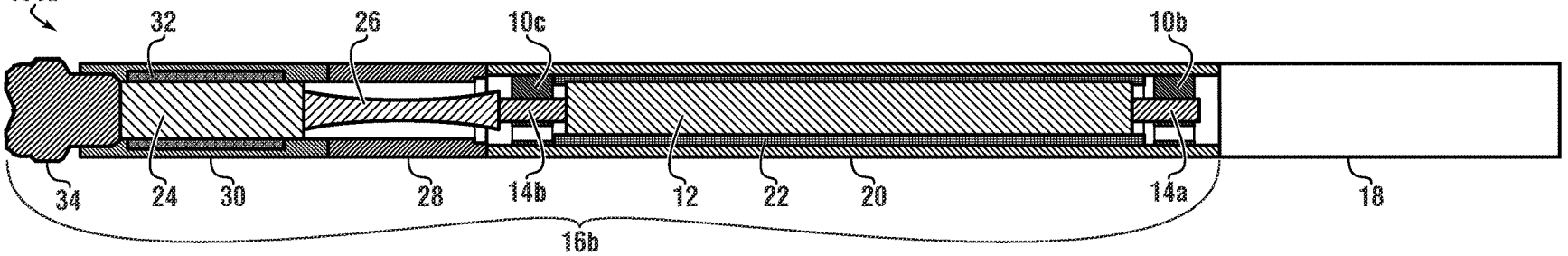
FIG. 2 is a side, cross-sectional view of a hypocycloid bearing assembly having an upper hypocycloid bearing positioned above the rotor, and a lower hypocycloid bearing positioned below the rotor.

FIG. 2 depicts drilling string assembly 100*b*. Drill string assembly 100*b* is similar to drill string assembly 100*a* of FIG. 1. However, instead of a single hypocycloid bearing positioned above rotor 12, bottomhole assembly 16*b* of drill string assembly 100*b* includes both upper hypocycloid bearing 10*b* positioned above rotor 12 and lower hypocycloid bearing 10*c* positioned below rotor 12, within motor housing 20, and coupled with rotor extensions 14*a* and 14*b*, respectively. Rotor extension 14*a* is received by the upper hypocycloid bearing 10*b*. Rotor extension 14*b* is received by the lower hypocycloid bearing 10*c* and is coupled with flex joint 26 for transference of rotational energy from rotor 12 to flex joint 26. As shown, lower hypocycloid bearing 10*c* is subjected to more radial load than upper hypocycloid bearing 10*b* due, at least in part, to the reaction of the transmission being bent back to center during operations. Lower hypocycloid bearing 10*c* and upper hypocycloid bearing 10*b* limit the hypocycloidal rotation of rotor 12 in the same manner as described above with respect to hypocycloid bearing 10*a*.

Stacked & Tilted Motor

Figure 3:
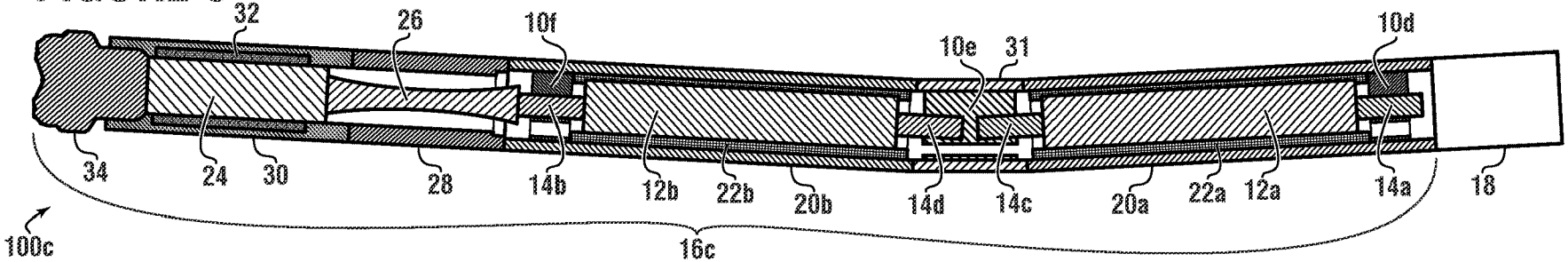
FIG. 3 is a side, cross-sectional view of a hypocycloid bearing assembly on a drill string with stacked and tilted motors, including an upper hypocycloid bearing positioned above a first rotor, a lower hypocycloid bearing positioned below a second rotor, and an intermediate hypocycloid bearing positioned between the first and second rotors. The hypocycloid bearing assembly shown in FIG. 3 is suitable for use with bend or tilted mud motors.

FIG. 3 depicts drill string assembly 100*c* with stacked and tilted motors, including an upper mud motor that includes upper motor housing 20*a*, upper stator 22*a*, and upper rotor 12*a*; and lower mud motor that includes lower motor housing 20*b*, lower stator 22*b*, and lower rotor 12*b*. Between the two mud motors, bottomhole assembly 16*c* of drill string assembly 100*c* includes double bend bearing housing 31, which provides for coupling of the upper mud motor with the lower mud motor. Specifically, upper rotor 12*a* includes rotor extension 14*c* coupled with double bend bearing housing 31, and lower rotor 12*b* includes rotor extension 14*d* coupled with double bend bearing housing 31. Rotor extensions 14*c* and 14*d* are coupled with hypocycloid bearing coupler 10*e*, which is positioned between the upper and lower mud motors. Thus, drill string assembly 100*c* is shown with three hypocycloid bearings, including upper hypocycloid bearing 10*d* coupled with rotor extension 14*a*, hypocycloid bearing coupler 10*e*, and lower hypocycloid bearing 10*f* coupled with rotor extension 14*b*. In some embodiments, double bend bearing housing 31 and/or hypocycloid bearing coupler 10*e* have a "watermelon" profile, as described herein.

While not shown, in some embodiments, an additional bend may be incorporated into drill string assembly 100*c*, such as by incorporating a bent connection between transmission housing 28 and bearing housing 30. The incorporation of such a bent connection may include timing of the threads such that the multiple bends are in the same plane.

In some embodiments, the timing of the two stators 22*a* and 22*b* may be optimized. The length of hypocycloid bearings coupler 10*e* and the mating rotor extensions 14*c* and 14*d* will allow for timing, including identifying and/or creating a thrust path for upper rotor 12*a*.

Compact, High Torque Transmission with Hypocycloidal Cutting Action

Figure 4:
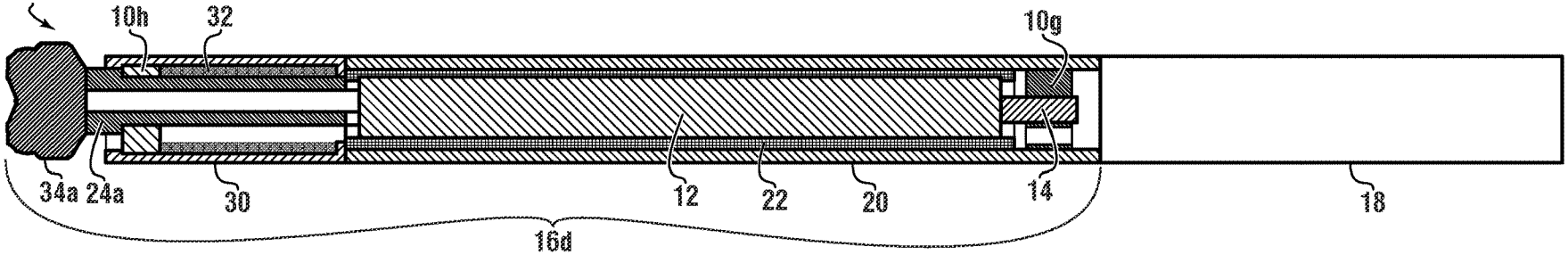
FIG. 4 is a side, cross-sectional view of a drill string having a hypocycloid bearing assembly configured for compact, high-torque transmission with hypocycloidal cutting action, including an upper hypocycloid bearing positioned above the rotor, and a lower hypocycloid bearing positioned below the rotor and below thrust and radial bearings, near the drill bit.

FIG. 4 depicts drill string assembly 100*d* having upper hypocycloid bearing 10*g* positioned above rotor 12 and lower hypocycloid bearing 10*h* positioned below rotor 12 and below thrust and radial bearings 32, near bit 34. In bottomhole assembly 16*d* of drill string assembly 100*d*, bit shaft 24*a* is connected to rotor 12 or is a unitary extension of rotor 12. Bit shaft 24*a* extends through bearing housing 30 and lower hypocycloid bearing 10*h*, and is coupled with bit 34*a*. In the embodiment of FIG. 4, bit 34*a* loads are carried through lower hypocycloid bearing 10*h*. Drill string assembly 100*d* is configured for compact, high-torque transmission with hypocycloidal cutting action of bit 34*a*. That is, rotation of bit 34*a* follows a hypocycloidal path, as bit shaft 24*a* transfers such motion to bit 34*a*. A drill bit having such hypocycloidal rotation may be referred to herein as a "hypocycloidal cutting bit."

Steerable Drilling Assembly with Hypocycloid Bearing and Cutting Bit

Figure 5:
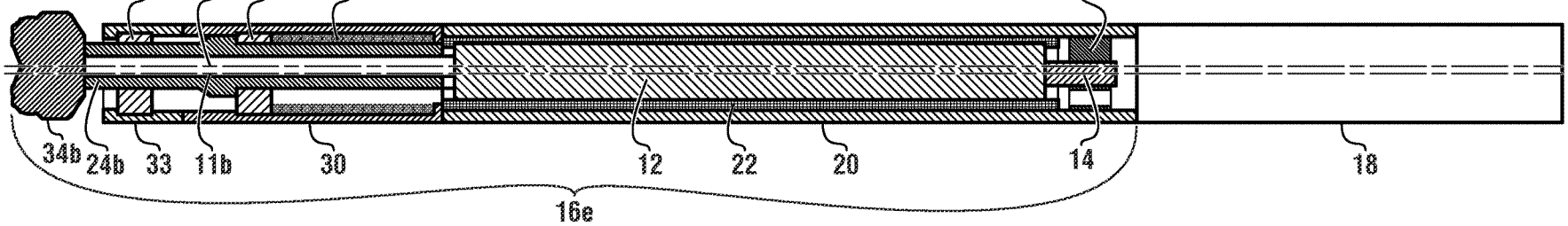
FIG. 5 is a side, cross-sectional view of a drill string having a steerable assembly with a hypocycloidal cutting bit and a hypocycloid bearing assembly, including an upper hypocycloid bearing positioned above the rotor, a lower hypocycloid bearing positioned below the thrust and radial bearings, and a tilted hypocycloid bearing positioned between the bit shaft and the tilted bit.

FIG. 5 depicts steerable drill string assembly 100*e* having a bottomhole assembly 163 that includes upper hypocycloid bearing 10*i* positioned above rotor 12, lower hypocycloid bearing 10*j* positioned below thrust and radial bearings 32, and tilted hypocycloid bearing 10*k* positioned between bit shaft 24*b* (an extension of rotor 12) and tilted, hypocycloidal cutting bit 34*b*. Tilted hypocycloid bearing 10*k* is supported within orienting housing 33, which orients bit shaft 24*b* and, thereby, bit 34*b* at a tilt relative to the remainder of drill string assembly 100*e*, as is illustrated by the angle of bit axis 11*a* relative to drill string axis 11*b*.

Compact, Concentric Cutting Bit with High Torque Transmission

Figure 6:
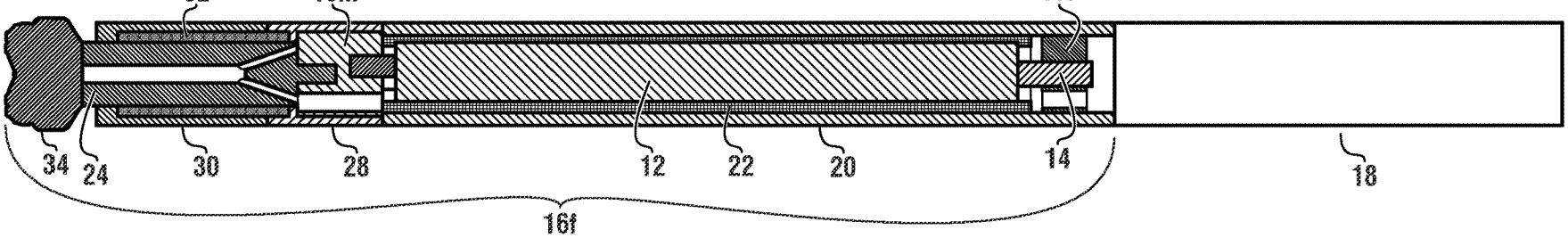
FIG. 6 is a side, cross-sectional view of a drill string including a compact, concentric cutting bit with a high-torque transmission and a hypocycloid bearing assembly, including an upper hypocycloid bearing positioned above the rotor and a lower hypocycloid bearing positioned below the rotor.

FIG. 6 depicts drill string assembly 100*f*, including upper hypocycloid bearing 10*l* positioned above rotor 12 and lower hypocycloid bearing coupler 10*m* positioned below rotor 12 and within transmission housing 28. Bottomhole assembly 16*f* of drill string assembly 100*f* includes a compact, concentric cutting bit 34 with a high-torque transmission.

Flow Through Drive Shaft

Figure 8A:
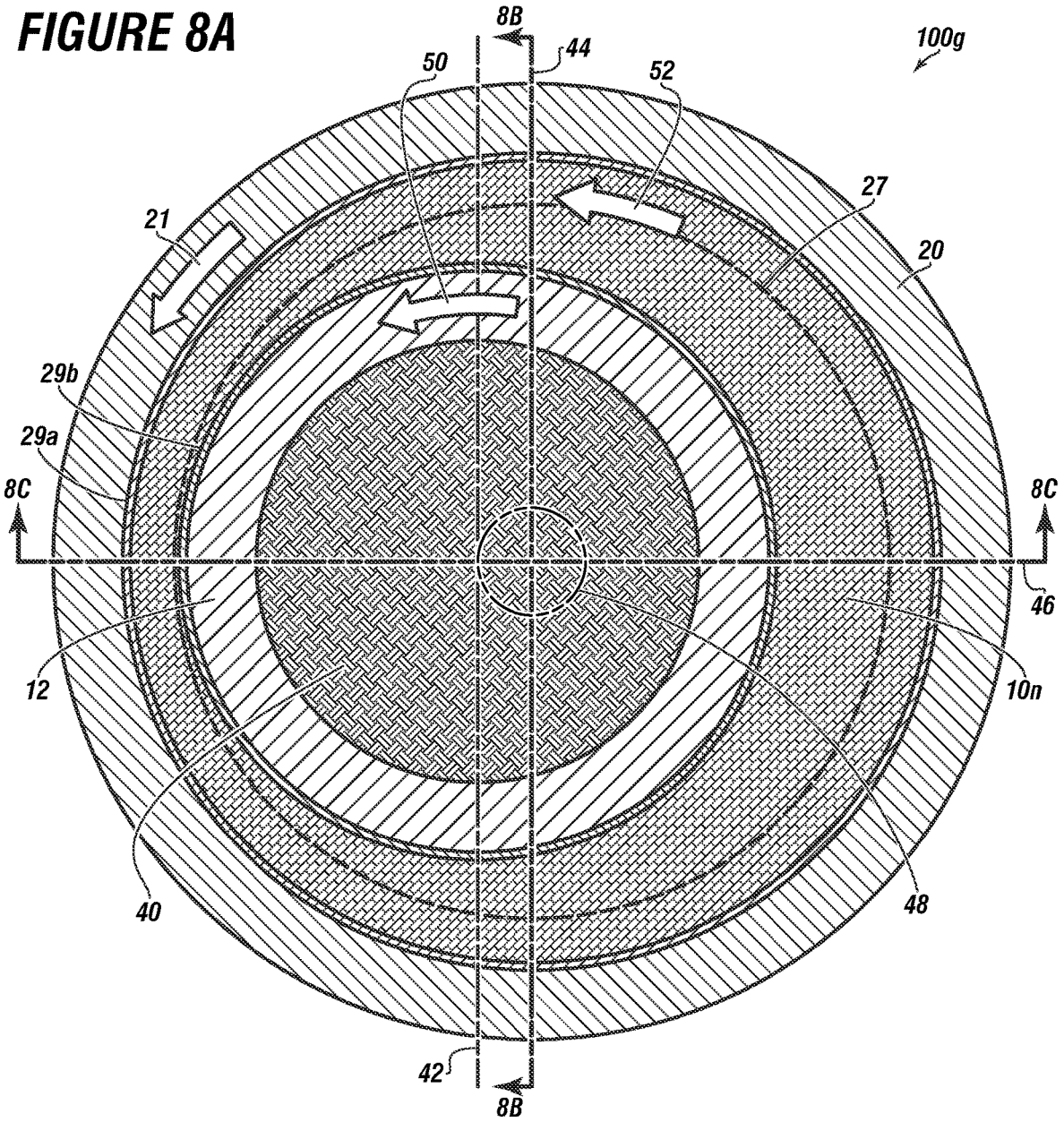
FIG. 8A is a cross-sectional view of a hypocycloid bearing with a flow through drive shaft.
Figure 8B:
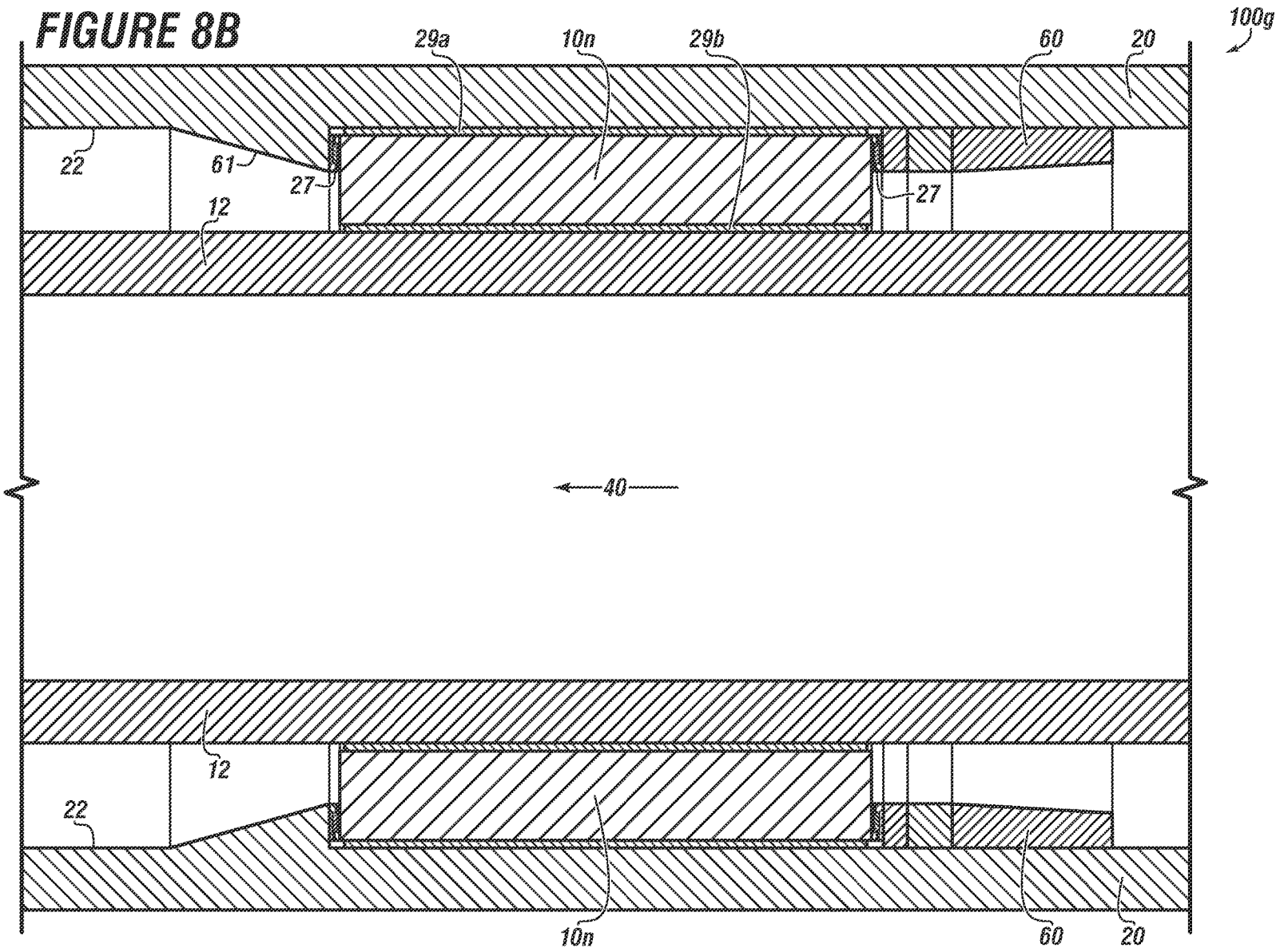
FIG. 8B is a side view along section 8B-8B of FIG. 8A.
Figure 8C:
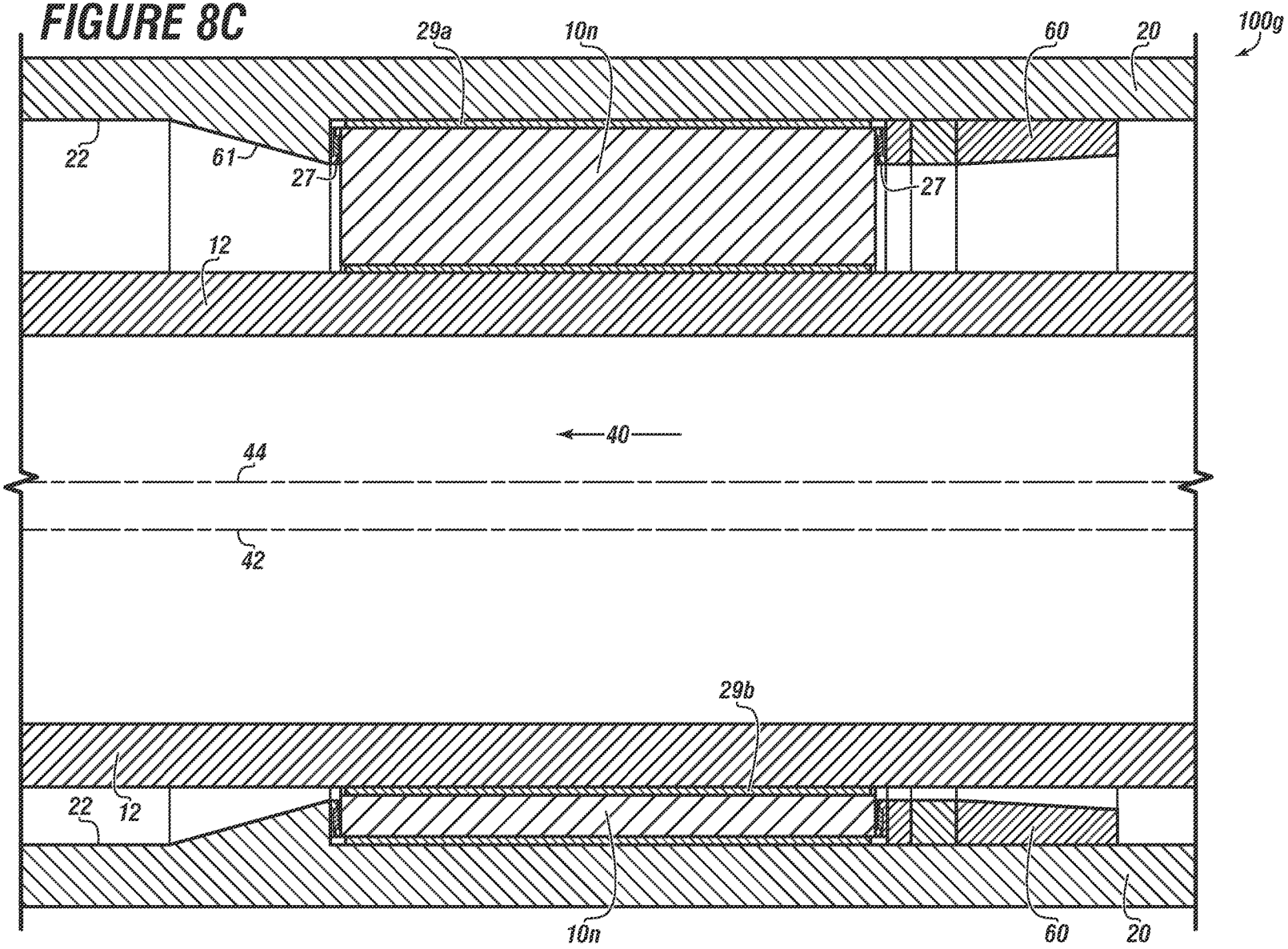
FIG. 8C is a side view along section 8C-8C of FIG. 8A.

FIGS. 8A-8C depict drill string assembly 100*g* with an exemplary embodiment of a hypocycloid bearing. Drill string assembly 100*g* includes motor housing 20, which is a portion of the drill string. In alternative embodiments, the motor housing is separate and distinct from the housing enclosing the stator. In such embodiments, the motor housing may have a different outside diameter that the housing enclosing the stator.

Between rotor 12 and motor housing 20, drill string assembly 100*g* includes hypocycloid bearing 10*n*, outer radial bearing pad 29*a*, and inner radial bearing pad 29*b*. In the embodiment shown in FIGS. 8A-8C, the hypocycloidal bearing 10*n* is positioned adjacent thrust bearing pads 27. Thrust bearing pads 27 engage the hypocycloid bearing 10*n*. Thus, hypocycloid bearing 10*n* receives and transmits loads to and from thrust bearing pads 27. Hypocycloid bearing 10*n* is secured longitudinally by lower retainer 61 and upper retainer 60. In the embodiment shown, lower retainer 61 is formed from and integral with motor housing 20 and the upper retainer 60 is a separate piece that is removably attached to motor housing 20. However, the assembly is not limited to this arrangement. Both of the retainers disclosed herein may be removable, or the lower retainer may be removable and the upper retainer formed out of the motor housing, or other configurations for securing the bearing known in the art may be employed.

Depicted in FIG. 8A is rotor center line 42 (at the current position of rotor 12) along a first direction; motor housing center line 44 along the first direction; rotor and motor housing center line 46 along a second direction, perpendicular to the first direction; and rotor orbit 48 within stator 22. Because rotor 12 is a hollow drive shaft in the embodiment of FIGS. 8A-8C, primary mud flow path 40 is within the cavity of rotor 12. In some embodiments, mud will also flow, in smaller volumes, between hypocycloid bearing 10*n* and either or both radial bearing pads 29*a* and 29*b*. The mud flow causes rotor 12 to rotate. The motor housing 20 is directly connected to and/or is a part of the drill string and, thus, rotates with the drill string. Rotation 50, of rotor 12, is indicated in FIG. 8A. Also, rotation of drill string, string rotation 21 (i.e., the direction of rotation of the drill string, if rotated), is indicated in FIG. 8A.

The radial bearing pads 29*a* and 29*b* define a radial bearing surface on the inner diameter (ID) of motor housing 20, which is larger than the stator major diameter. This radial bearing surface may include one or multiple materials including, but not limited to, polycrystalline diamond composite (PDC), tungsten carbide (WC), flame sprayed hard facing, and hardened steel. In some embodiments, the drive shaft (i.e., a bit shaft) is an extension of, or directly connected to the rotor 12, and also has a radial bearing surface thereon. In such embodiments, the radial bearing surface of the drive shaft may be formed of one or multiple materials including, but not limited to, PDC, WC, flame sprayed hard facing, and hardened steel.

Having described the components of the assembly 100*g*, the hypocycloid bearing 10*n* structure and function will now be described. In the embodiment shown, hypocycloid bearing 10*n* is a hollow cylinder body having a relatively large, off-center through-hole or cavity within the body. The rotor 12 is engaged within and through the cavity of the hypocycloid bearing 10*n*. As used herein, "off-center," refers to the state of not being in coaxial alignment. For example, the central axis of the "off-center through-hole or cavity" of hypocycloid bearing 10*n* body is not coaxially aligned with the cavity formed by stator 22 and/or the cavity formed in the motor housing 20. On the outer diameter (OD) and the offset inner diameter (ID) of hypocycloid bearing 10*n* are radial bearing pads 29*a* and 29*b*. The radial bearing pads 29*a* and 29*b* may be formed of one or multiple materials including, but not limited to, PDC, WC, flame sprayed hardfacing, and hardened steel. In some embodiments, with no compliance in the mounting of hypocycloid bearing 10*n*, there is a few thousands of an inch difference in the mating bearing (e.g., radial bearing pads 29*a* and 29*b*).

As indicated in FIG. 8A, the rotation of hypocycloid bearing, rotation 52, includes hypocycloid bearing 10*n* rotating inside of the motor housing 20 as a result of the hypocycloid motion/rotation generated by the mud motor. Further, rotor 12 also rotates with respect to hypocycloid bearing 10*n* body, as shown by rotation 50.

The off-center through-hole in the hypocycloid bearing 10*n* body is off-set by the radius of the rotor orbit 48 in the stator 22 (i.e., "r" as shown in FIG. 7). In this configuration, the hypocycloid bearing 10*n* of FIGS. 8A-8C is unloaded when the mud motor is off or running at low speeds. In some embodiments, the position of hypocycloid bearing 10*n* and the off-center hole thereof may be modified to change the rotor 12 loading onto the stator 22. For example, and without limitation, decreasing the positional offset of hypocycloid bearing 10*n* and the off-center hole thereof will compensate the centripetal force of the spinning rotor 12 and counterbalance the pressure loading on the stator 22. In such embodiments, the offset is configured for the hypocycloid bearing 10*n* to be pre-loaded. This pre-loading allows for optimal loads between the rotor 12 and stator 22 at optimal power outputs.

In some embodiments, the inner radial bearing pad 29*b* is tipped to compensate for the centripetal force of the spinning rotor 12, counterbalance pressure loading, and at least partially compensate for bending from the transmission. In some embodiments, the inner and/or outer radial bearing pads 29*a* and 29*b* clearance is increased to provide a measure of compliance between the rotor 12 and stator 22, potentially resulting in increased lateral shock in the respective radial bearing pads 29*a* and 29*b*.

Without being bound by theory, it is believed that a hypocycloid bearing that is positioned above the rotor, such as hypocycloid bearings 10*a*, 10*b*, 10*d*, 10*g*, 10*i*, and 101 as shown in FIGS. 1-6, bears at least some of or a majority of the lateral mud motor load that would, in the absence of such a hypocycloid bearing, be carried by and/or through the stator (e.g., a rubber stator) and transferred directly to the motor housing. Thus, hypocycloid bearings positioned above the rotor reduce the load (e.g., lateral mud motor load) on the stator; thereby, decreasing the wear rate of the stator, decreasing stress (e.g., rubber stress) on the material of the stator, reducing the potential for failures of the mud motor, and improving the thermal range of the stator and the mud motor.

Without being bound by theory, it is believed that a hypocycloid bearing that is positioned below the rotor, such as hypocycloid bearings 10*c*, 10*f*, 10*h*, 10*j*, and 10*m* as shown in FIGS. 1-6, bears at least some of or a majority of the lateral mud motor load that would, in the absence of such a hypocycloid bearing, be carried by and/or through the stator (e.g., a rubber stator) and transferred directly to the motor housing. Additionally, a hypocycloid bearing positioned below the rotor and coupled with the transmission reduces or prevents at least some or a majority of bending from the transmission from being carried by and/or through the stator; thereby, further reducing load on the stator. The hypocycloid bearings disclosed herein, thus, act as lateral support bearings to the rotor.

In some embodiments, thrust bearing pads 27 are used when the hypocycloid bearing carries axial load. Thrust bearing pads 27 may maintain and control the axial position of the hypocycloid bearing and prevent axial loads from affecting rotor 12 and the interaction between rotor 12 and stator 22.

In embodiments with a hollow rotor drive shaft, as shown in FIGS. 8A-8C, the primary mud flow path 40, the strength of rotor 12, and thrust bearing pad 27 surface area may be optimized. For example, and without limitation, a rotor having a larger internal diameter will provide for increased mud flow capacity compared with a smaller internal diameter, a rotor having a smaller shaft inner diameter and larger shaft outer diameter will provide for a higher-strength rotor, and a thrust bearing pad having a smaller inner diameter will provide for increase thrust bearing pad surface area.

In some embodiments, the body of hypocycloid bearing 10*n* is a solid body with an off-set cavity formed therethrough. The weight of the hypocycloid bearing 10*n* body may be reduced by machining the hypocycloid bearing 10*n* body to eliminate unneeded surface area for placement of radial bearing pads 29*a* and 29*b*, as well as to eliminate unneeded mass. In some aspects, bore holes, channels, or flow paths may be formed through hypocycloid bearing 10*n* body, such as by machining; thereby, reducing surface area and mass of hypocycloid bearing 10*n*, as well as providing mud flow paths through hypocycloid bearing 10*n*.

Solid Drive Shaft

Figure 9A:
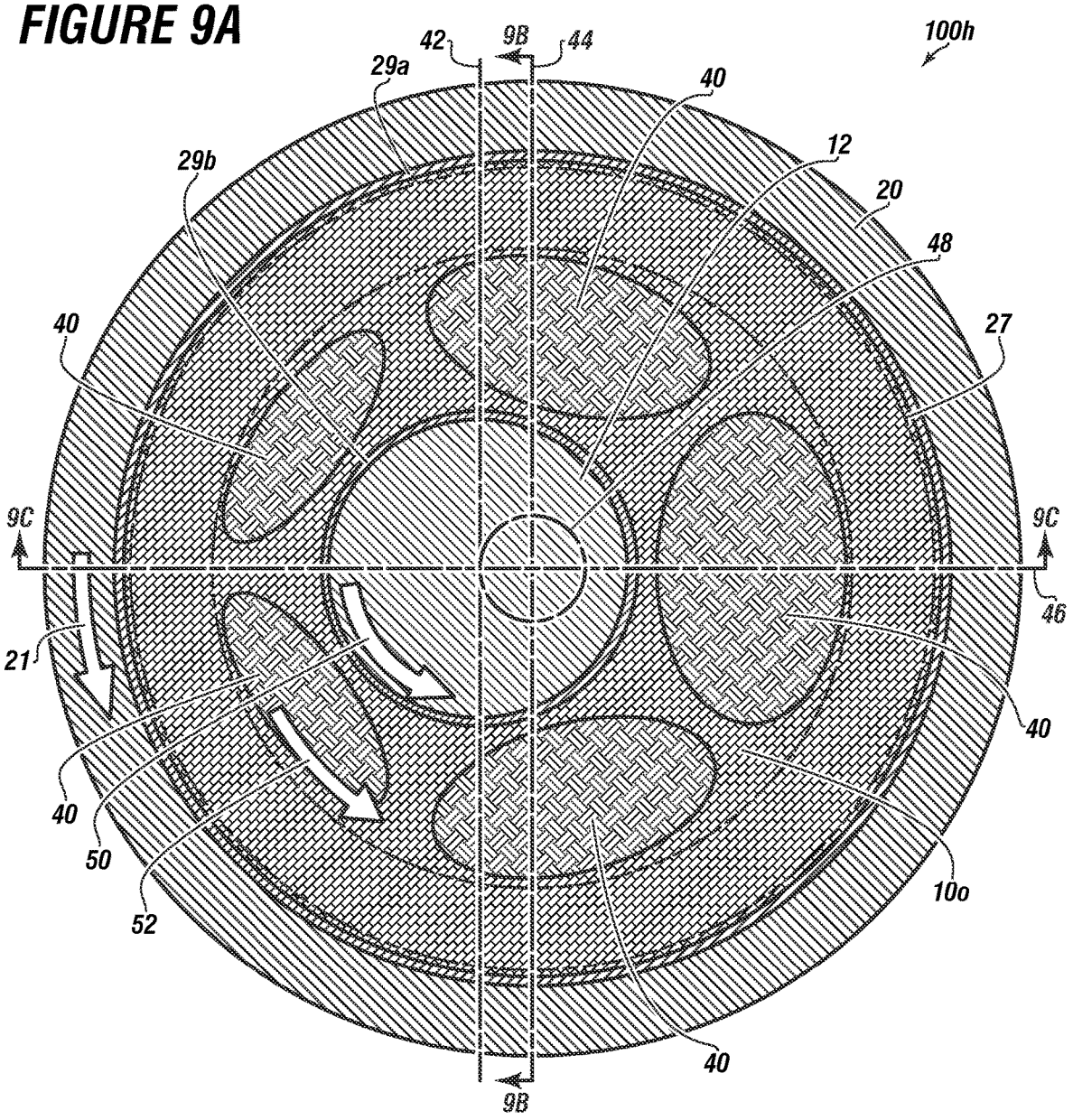
FIG. 9A is a cross-sectional view of a hypocycloid bearing with a solid drive shaft.
Figure 9B:
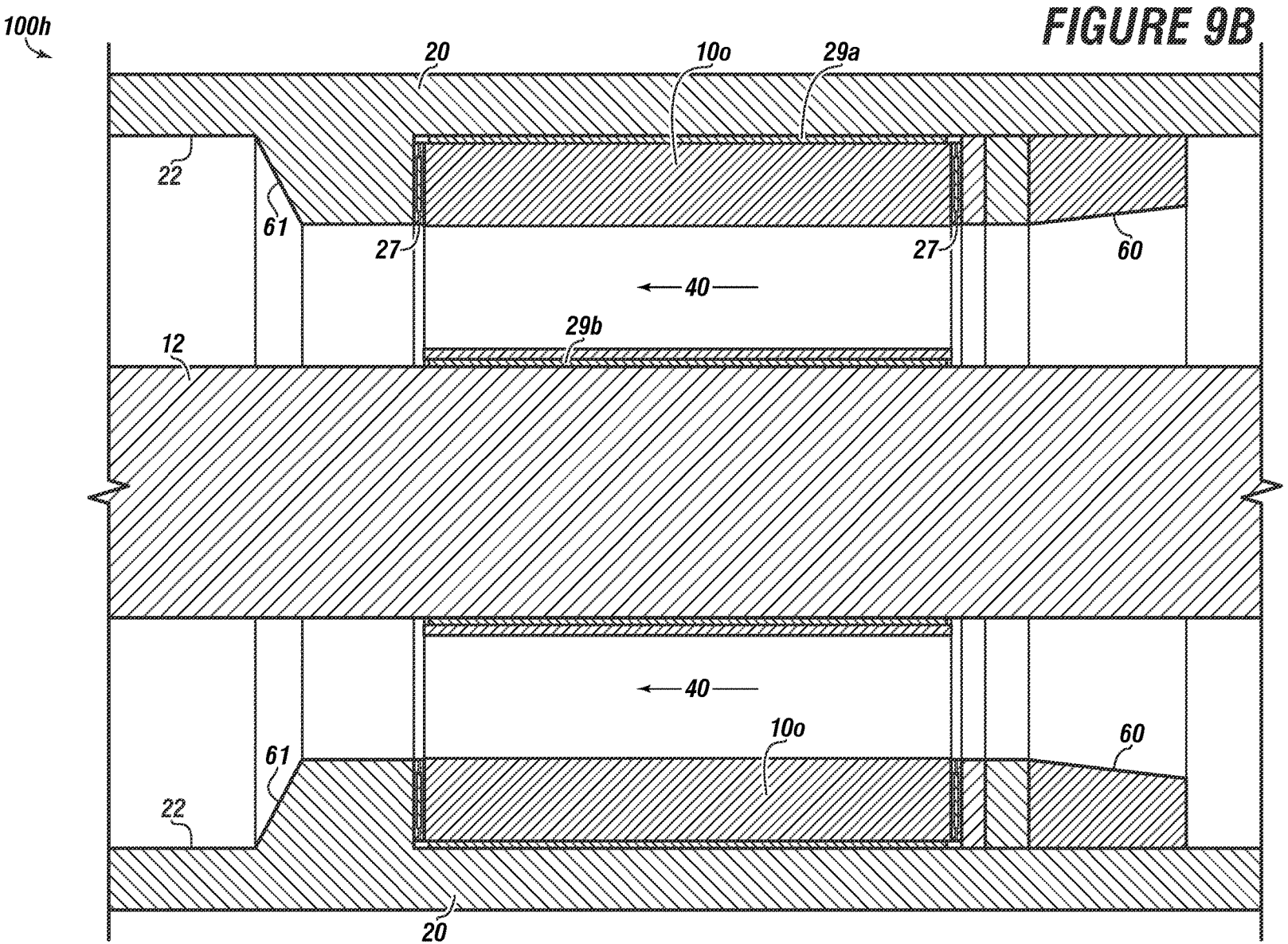
FIG. 9B is a side view along section 9B-9B of FIG. 9A.
Figure 9C:
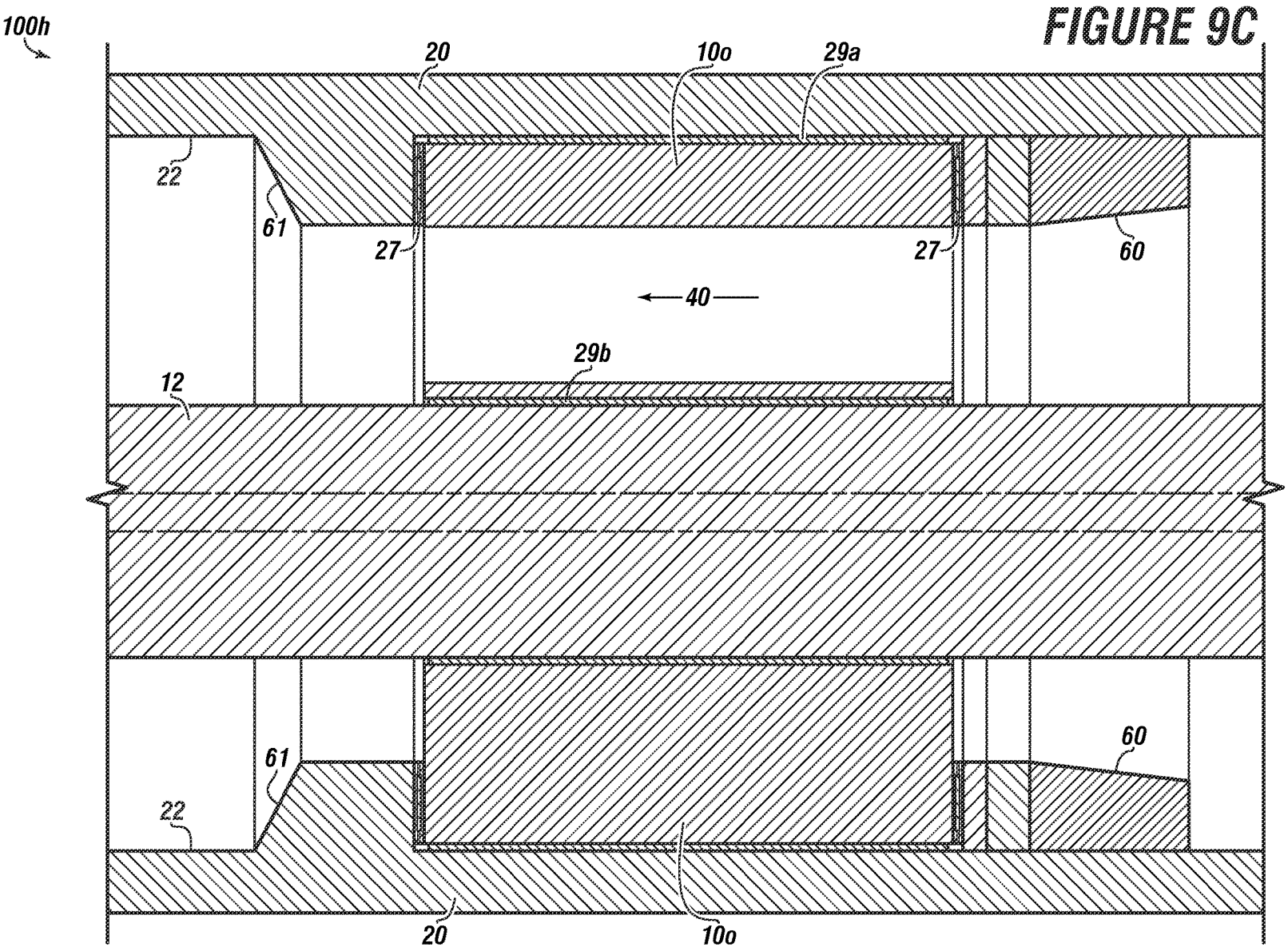
FIG. 9C is a side view along section 9C-9C of FIG. 9A.

FIGS. 9A-9C depict drill string assembly 100*h* including a rotor with a solid drive shaft. In the embodiment of FIGS. 9A-9C, mud flow passages 40 are provided through hypocycloid bearing 10*o* body. Without the need for a borehole through rotor 12 for providing the primary mud flow page, as shown in FIGS. 8A-8C, the diameter of motor drive shaft (i.e., rotor 12) shown in FIGS. 9A-9C may be reduced relative to the rotor diameter of the embodiment of FIGS. 8A-8C.

At Bit Hypocycloidal Drive

Figure 10A:
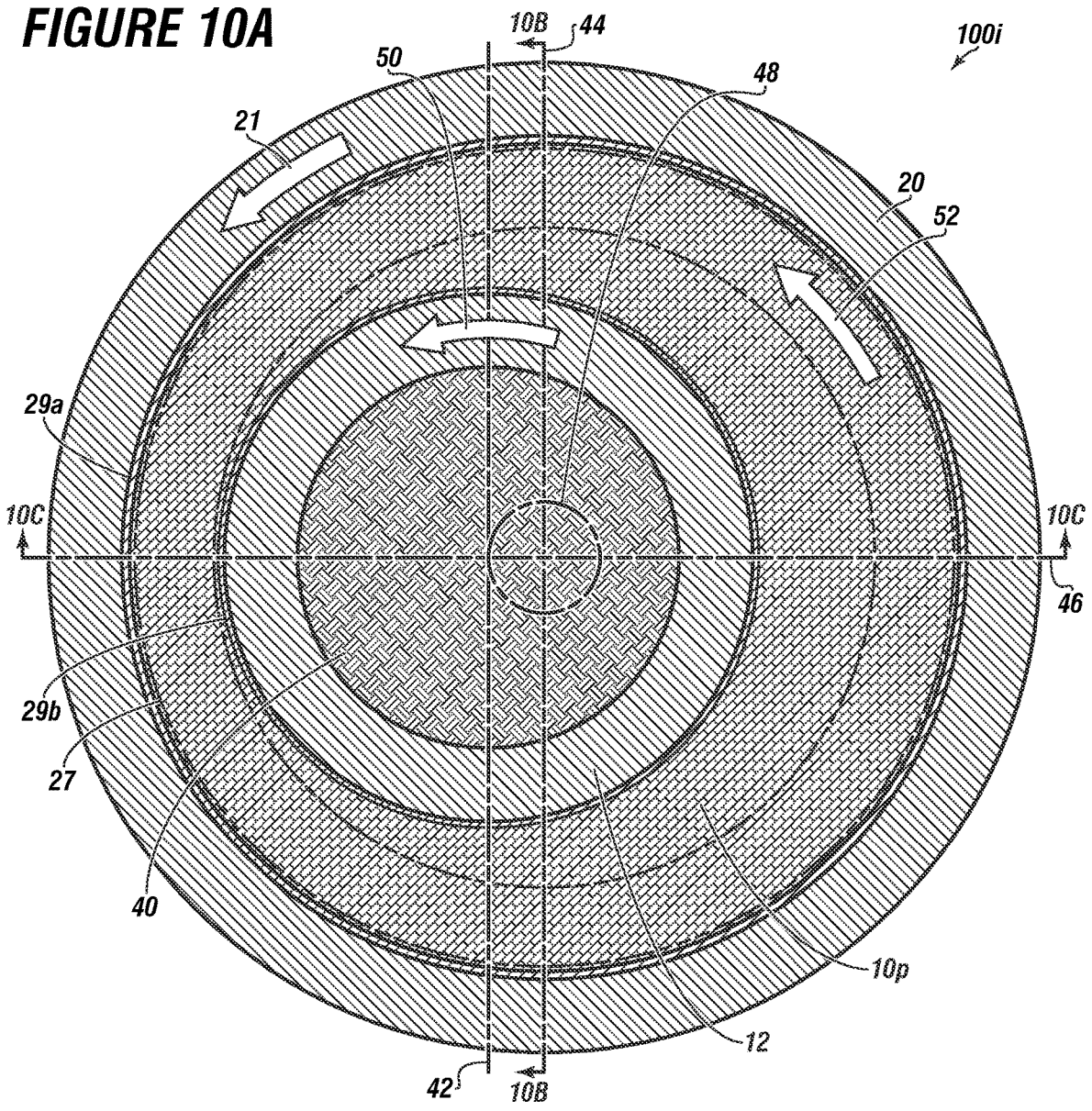
FIG. 10A is a cross-sectional view of a hypocycloidal bit drive with a hypocycloid bearing.
Figure 10B:
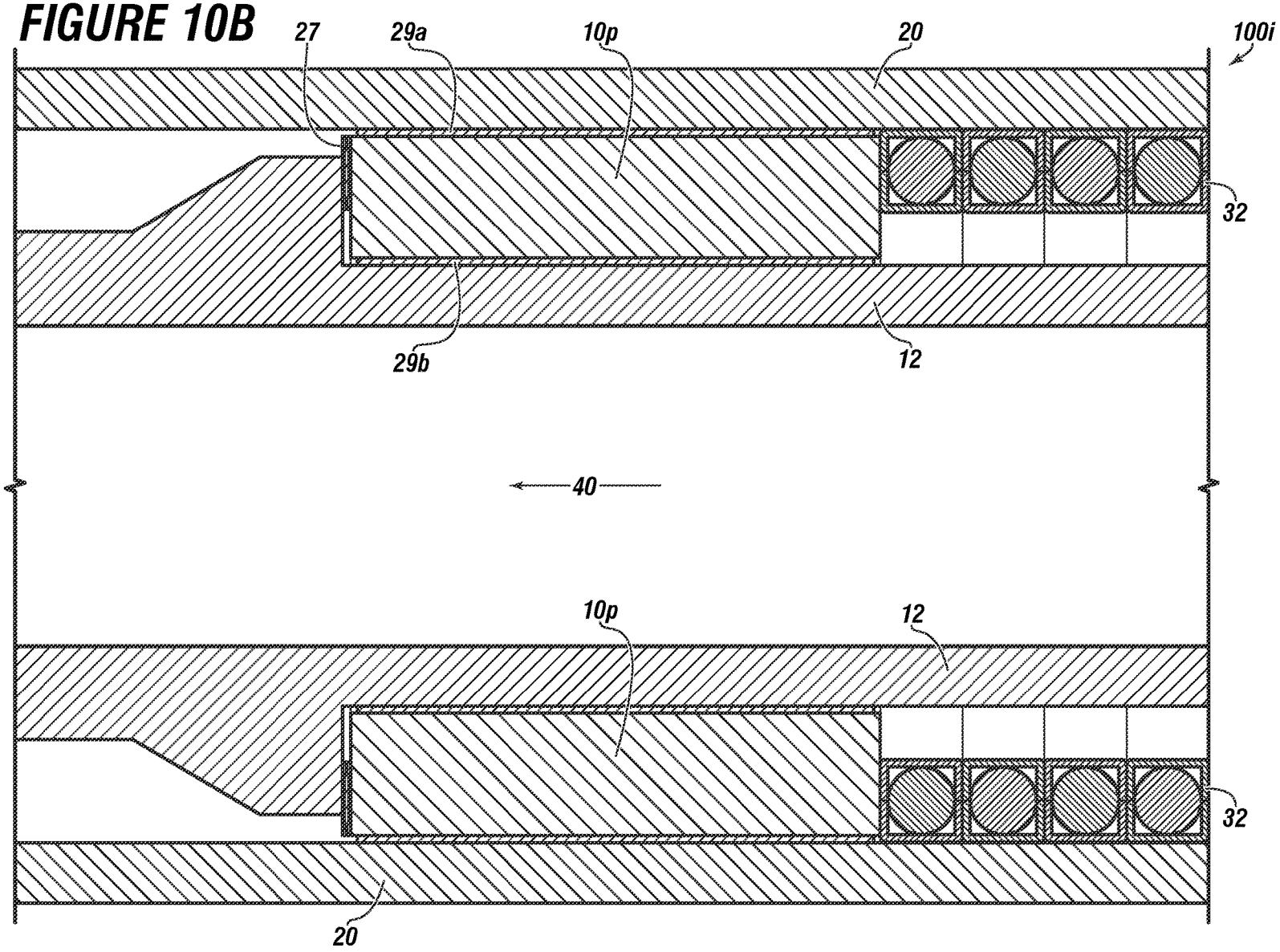
FIG. 10B is a side view along section 10B-10B of FIG. 10A.
Figure 10C:
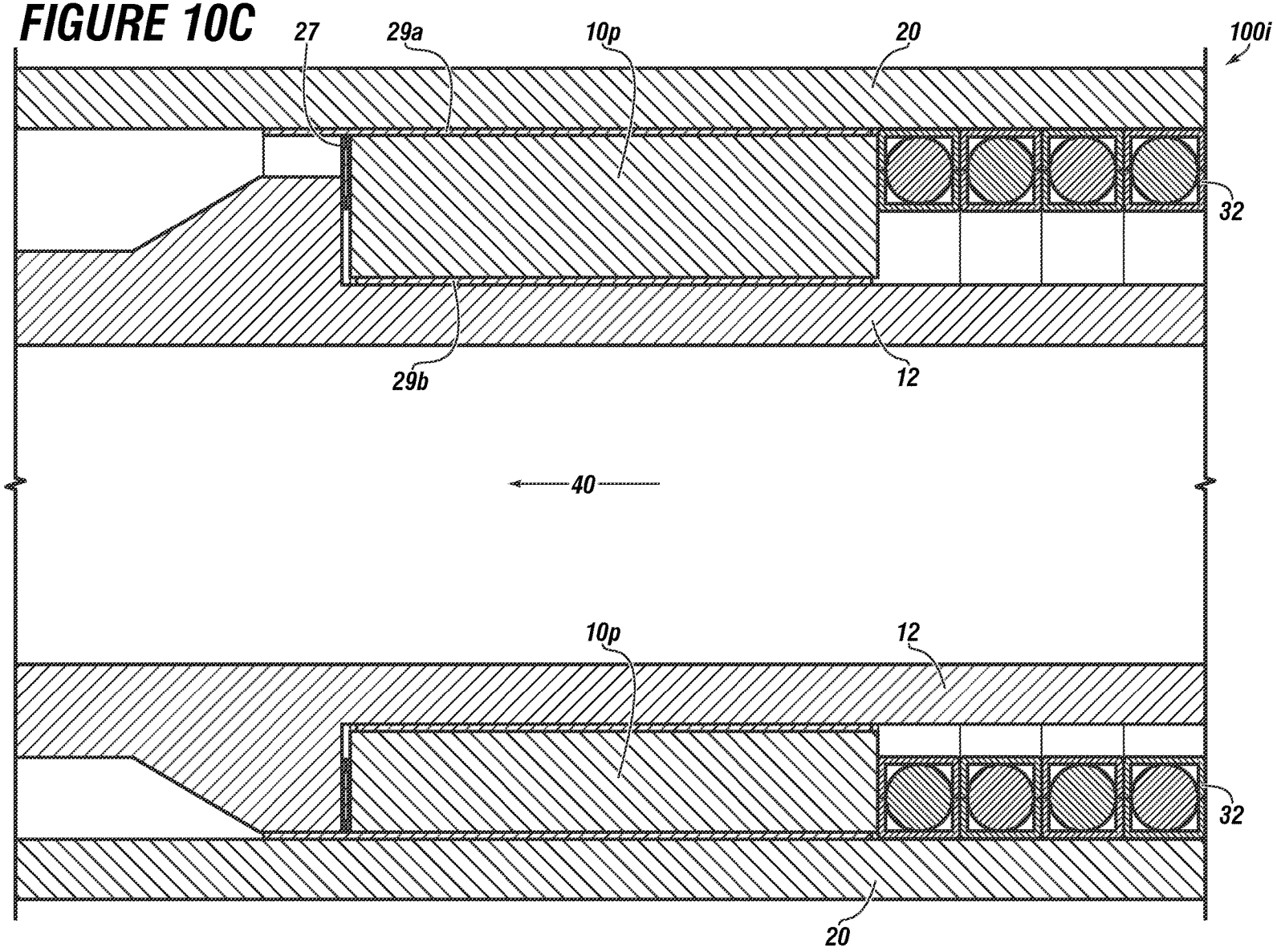
FIG. 10C is a side view along section 10C-10C of FIG. 10A.

FIGS. 10A-10C depict drill string assembly 100*i*. The hypocycloidal bearing 10*p* includes inner and outer radial bearing pads 29*a* and 29*b*, in conjunction with thrust bearing pads 27, carries at least some or all of the bit loads, including weight and torque. In the embodiment depicted in FIGS. 10A-10C, the hypocycloidal bearing 10*p* is positioned below thrust & radial bearings 32, such as is shown in lower hypocycloid bearing 10*j* in FIG. 5. In this configuration, motion created by the mud motor is transferred to the drill bit, such that the drill bit exhibits hypocycloidal motion.

Symmetric Direct Drive

Figure 11A:
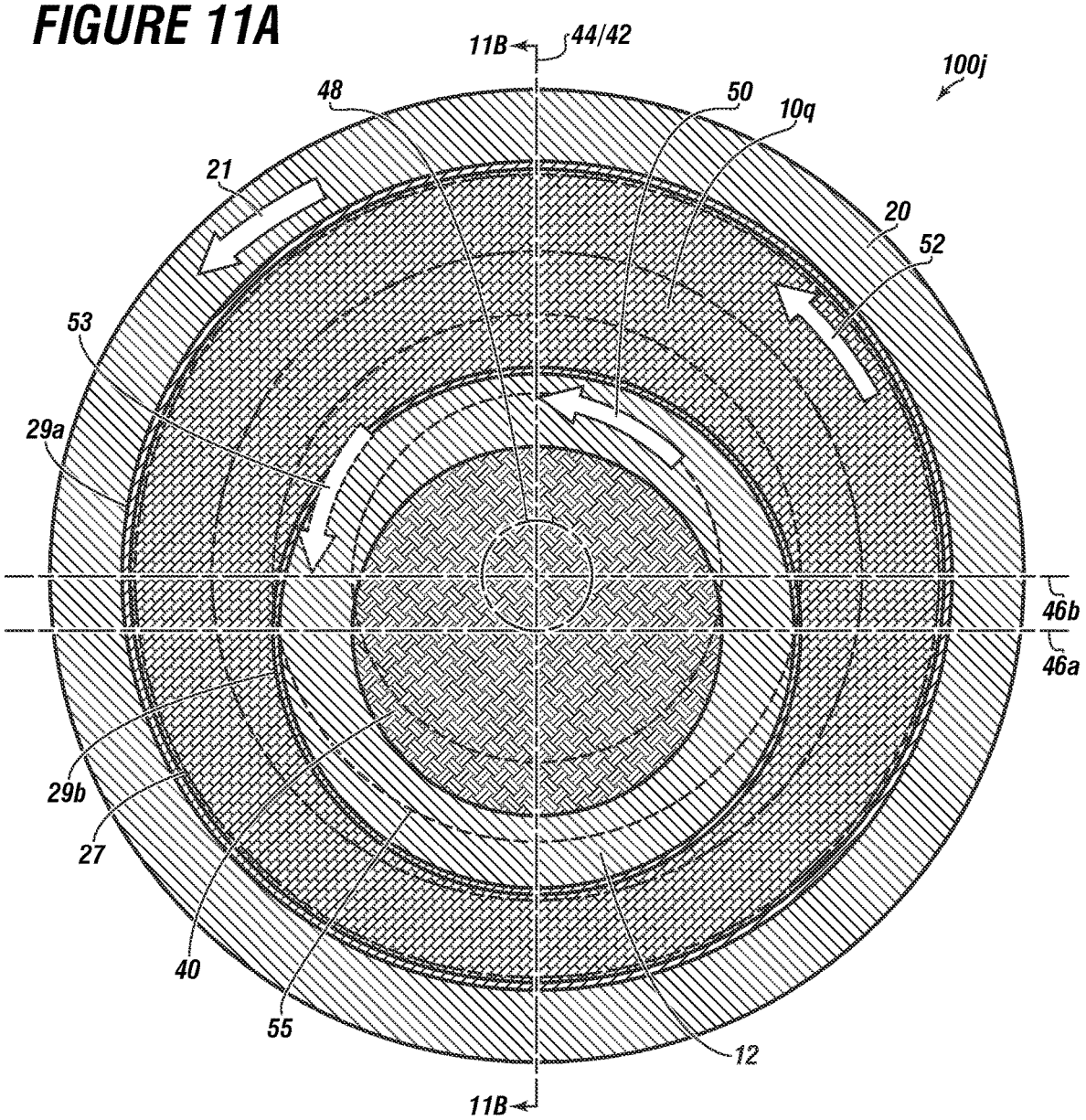
FIG. 11A is a cross-sectional view of a symmetric direct drive with a hypocycloid bearing.

FIGS. 11A-12C show two embodiments of a symmetric direct drive. FIGS. 11A and 11B depict drill string assembly 100*j*. First rotor center line 46*a* (at the current position of rotor 12) is offset from the first stator center line 46*b*, while second rotor center line 42 (at the current position of rotor 12) is aligned with second stator center line 44. Second stator center line 44 is also the bit center line in this embodiment. As shown in FIG. 11B, the second rotor center line 42 is off-set from second stator center line 44 by the radius of the rotor orbit (r). Thus, in operation, the second rotor center line 42 orbits about the second stator center line 44, as shown by 48. In FIGS. 11A and 11B, drive shaft 24 is off-set from rotor 12. That is, drive shaft 24 is concentrically aligned with second stator center line 44 and rotor 12 is concentrically aligned with second rotor center line 42. By off-setting bit drive shaft 24 from rotor 12, the hypocycloid motion is reduced, and in some instances removed, from the rotation of bit drive shaft 24. In alternative embodiments, the amount of off-set can be greater or less than r. Also shown in FIG. 11B is motor main bearing 127, spline drives 111, hypocycloidal bearing 10*q*, and bit rotation 53 with the path of bit rotation shown in dashed lines 55.

Figure 11B:
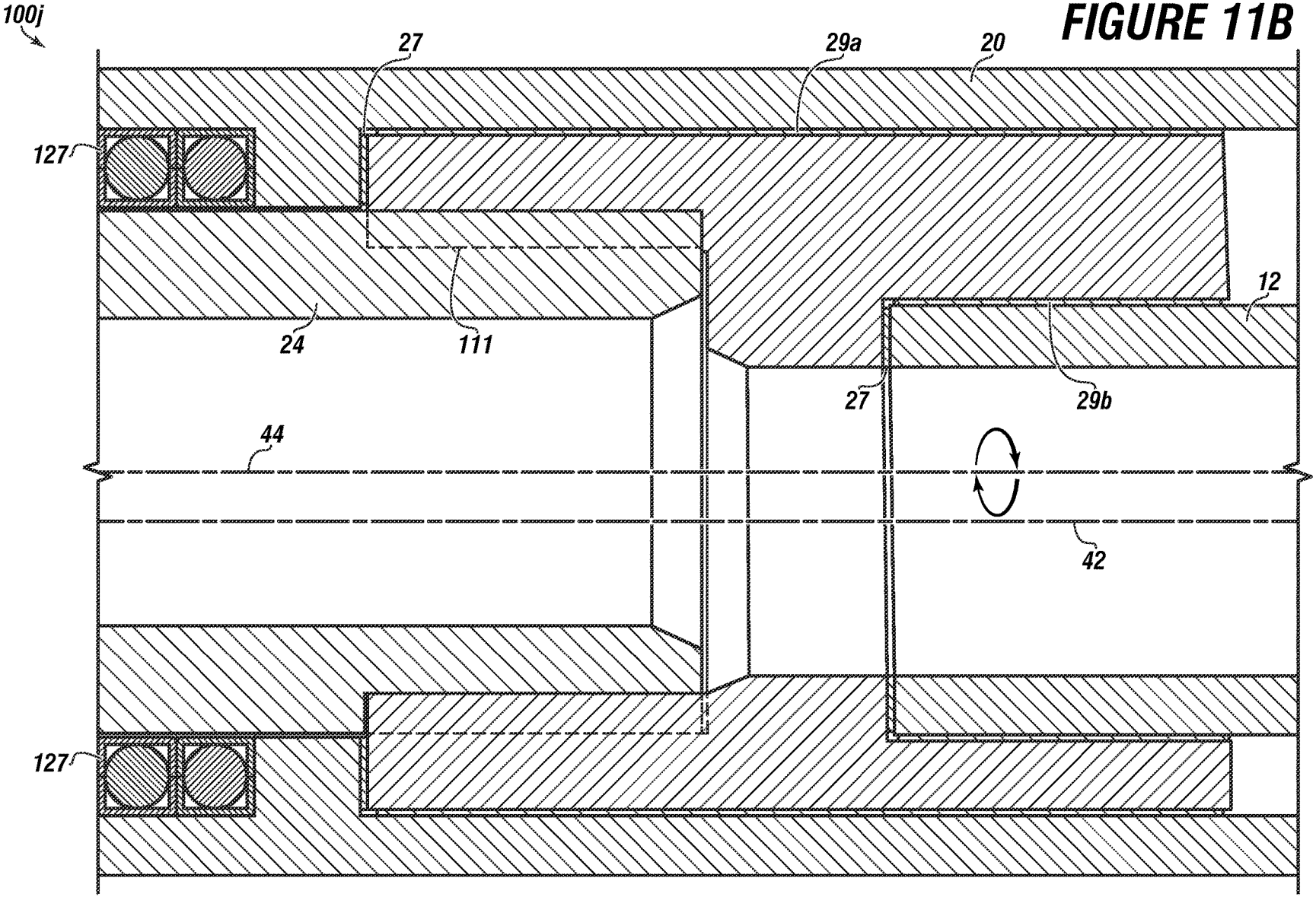
FIG. 11B is a side view along section 11B-11B of FIG. 11A.
Figure 12A:
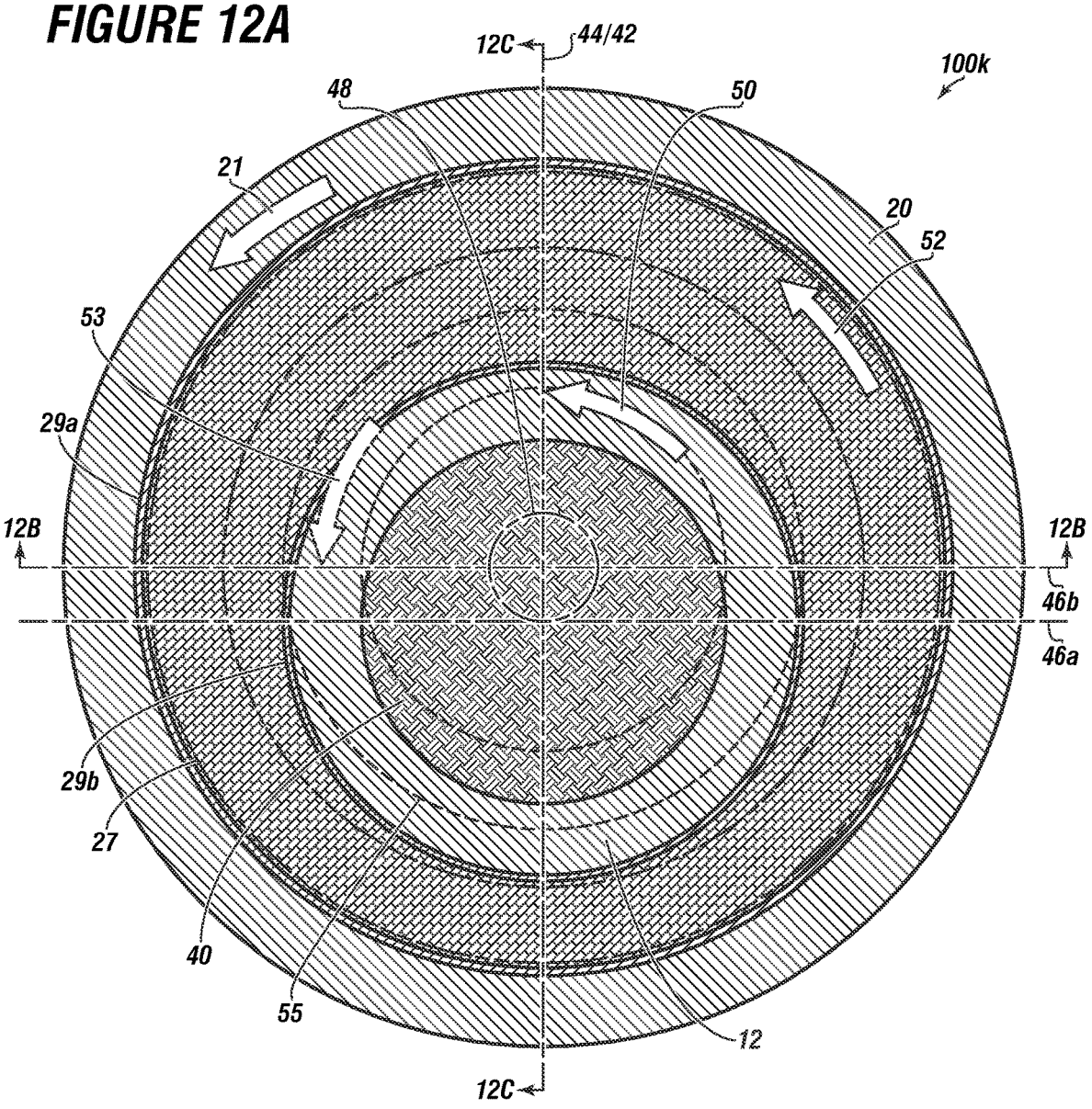
FIG. 12A is a cross-sectional view of a symmetric direct drive with a hypocycloid bearing.
Figure 12B:
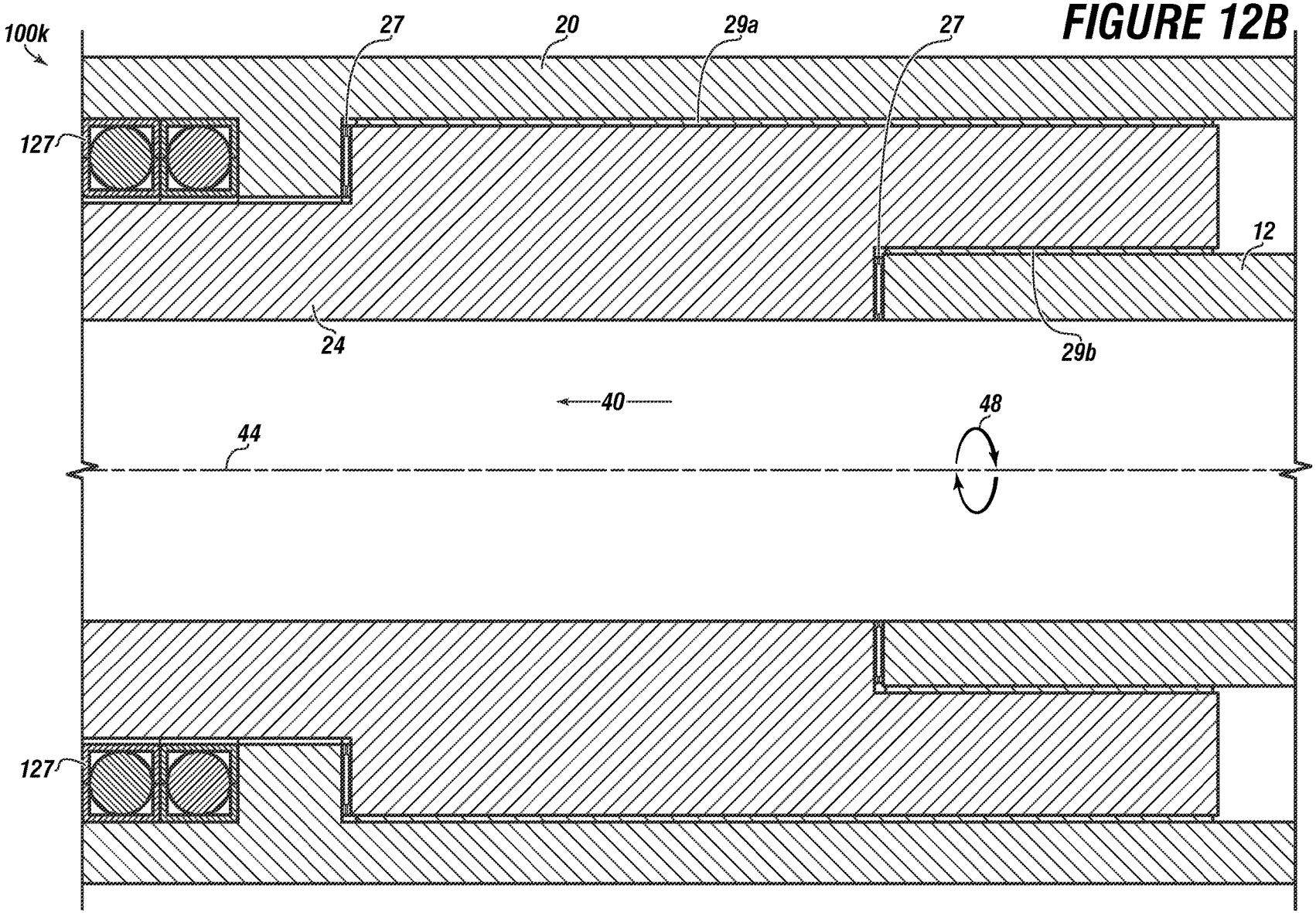
FIG. 12B is a side view along section 12B-12B of FIG. 12A.
Figure 12C:
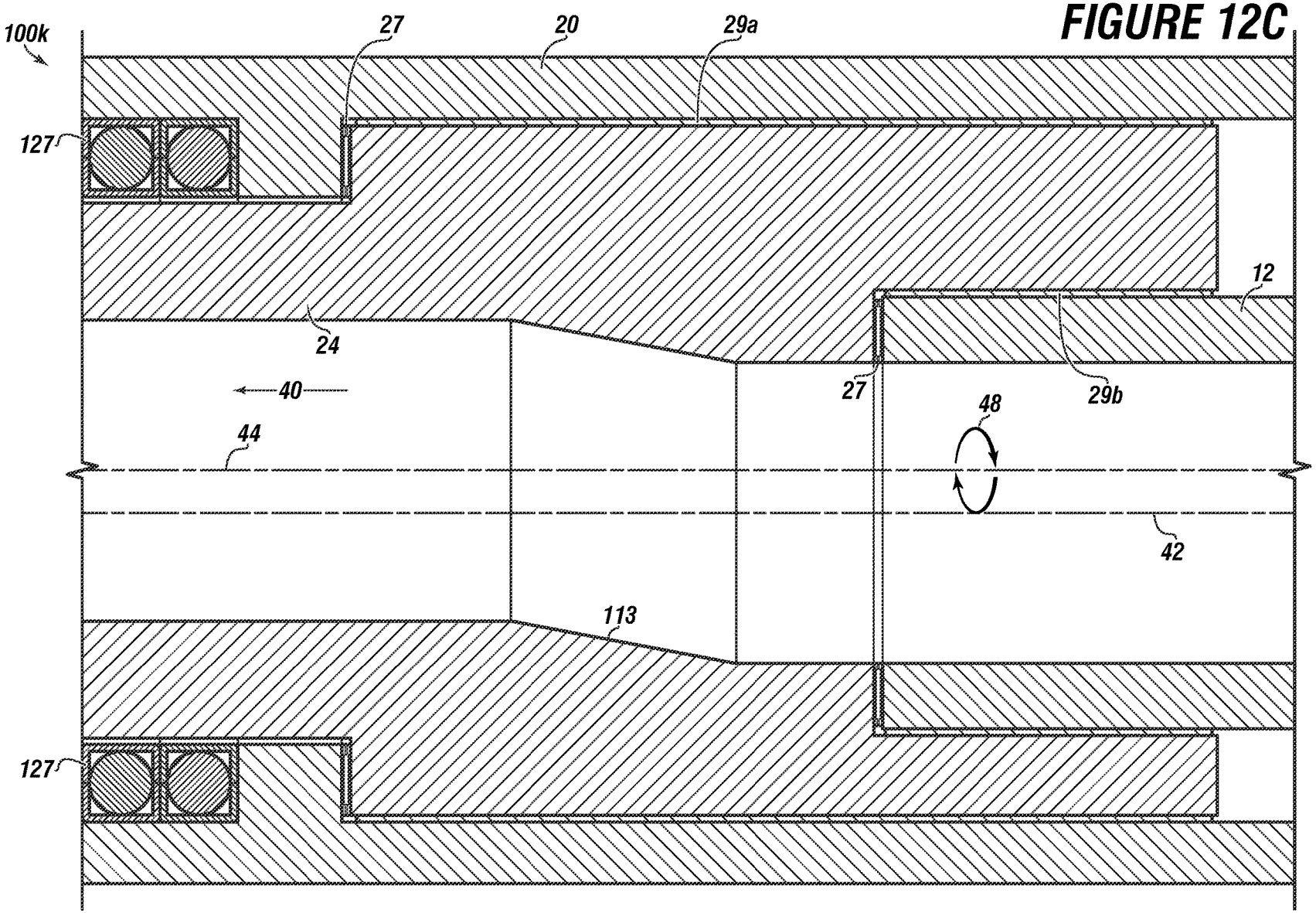
FIG. 12C is a side view along section 12C-12C of FIG. 12A.

FIGS. 12A-12C show a similar arrangement as is shown in FIGS. 11A and 11B. However, drill string assembly 100*k* includes curved channel 113 therethrough to achieve the same or a substantially similar result. With the curved channel 113, drive shaft 24 is concentrically aligned with second stator center line 44 and rotor 12 is concentrically aligned with second rotor center line 42. Thus, in operation, the second rotor center line 42 orbits about the second stator center line 44, as shown by 48.

Rotor as Drive Shaft

Figure 13A:
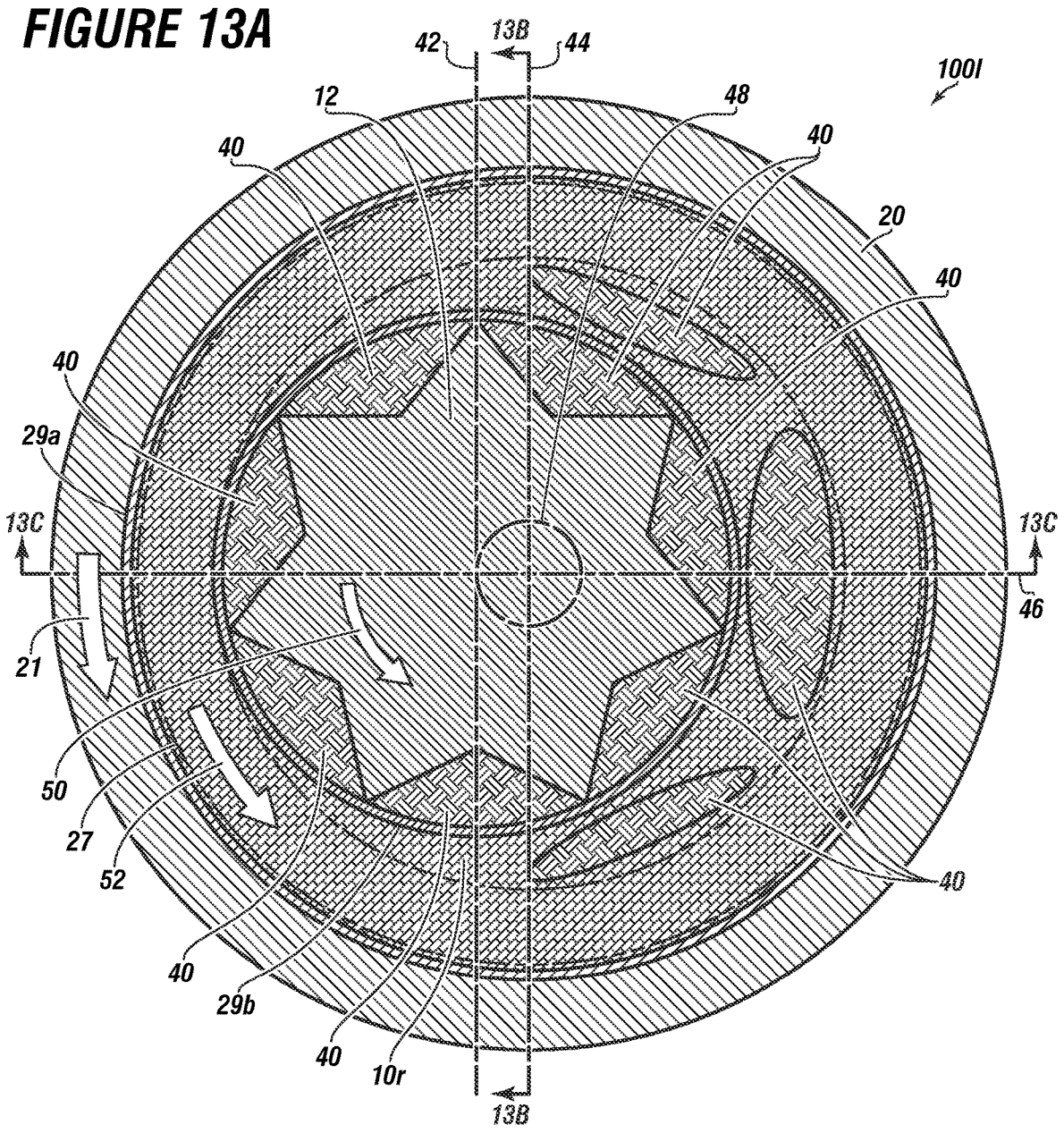
FIG. 13A is a cross-sectional view of an embodiment with the rotor as the drive shaft and including an intra-motor hypocycloid bearing.
Figure 13B:
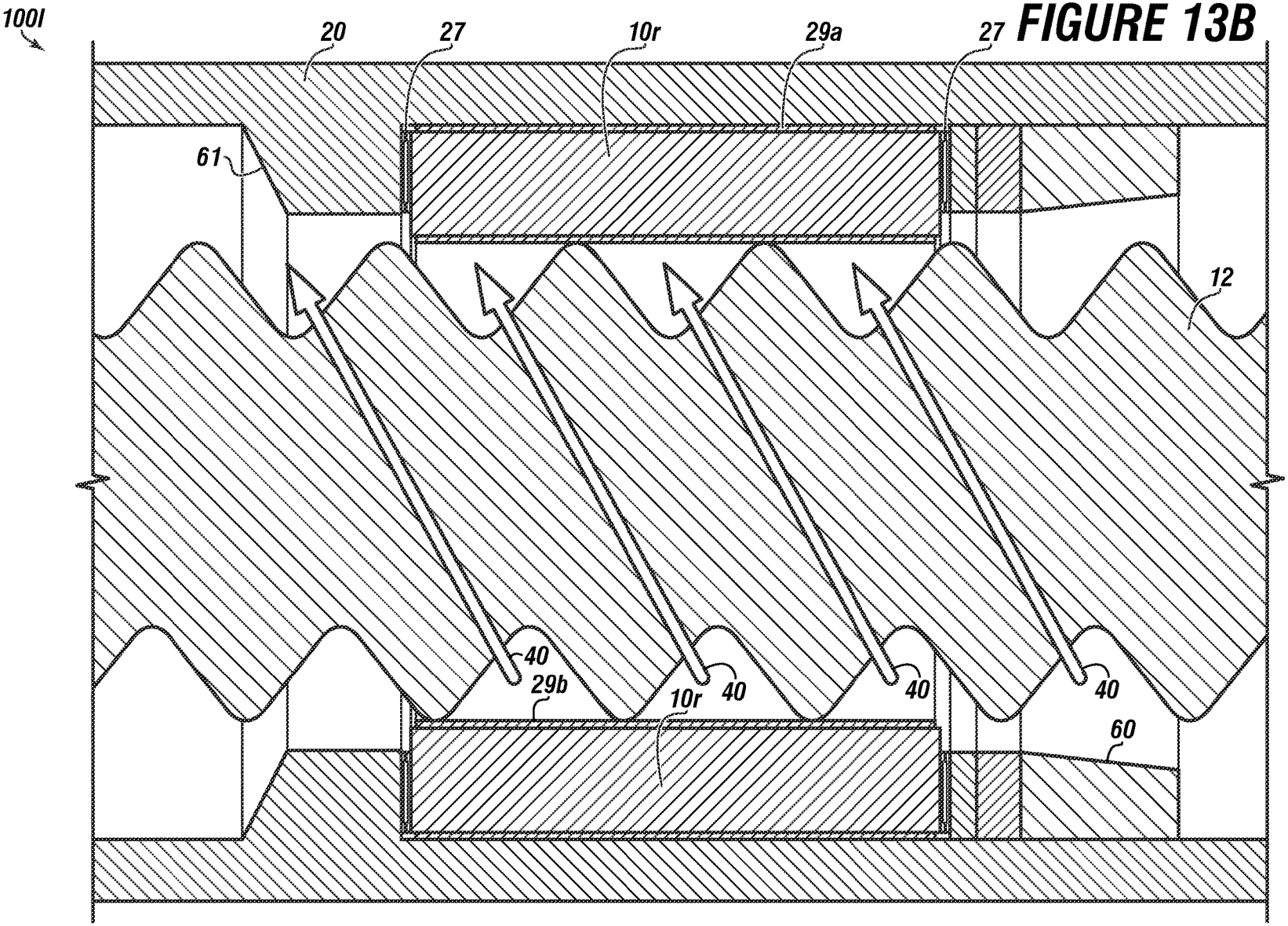
FIG. 13B is a side view along section 13B-13B of FIG. 13A.

FIGS. 13A and 13B depicts drill string assembly 100*l*, including hypocycloidal bearing 10*r*. In the embodiment of FIGS. 13A and 13B, rotor 12 operates as the drive shaft. A portion of rotor 12 extends beyond stator 22 and housing 20, and this extended portion of rotor 12 body is used to support the transfer of the radial loads to the drill bit. In the embodiment shown, rotor 12 is approximately shaped as a seven-pointed star. However, one skilled in the art would understand that rotor 12 is not limited to this particular shape. In operation, as rotor 12 rotates within stator 22 and motor housing 20, rotor 12 impacts (i.e., rolls and/or slides) on inner radial bearing pads 29*b*. Mud flow paths 40 include flow paths that spiral around rotor 12.

Rotor as Drive Shaft with Stator Bearing

Figure 13C:
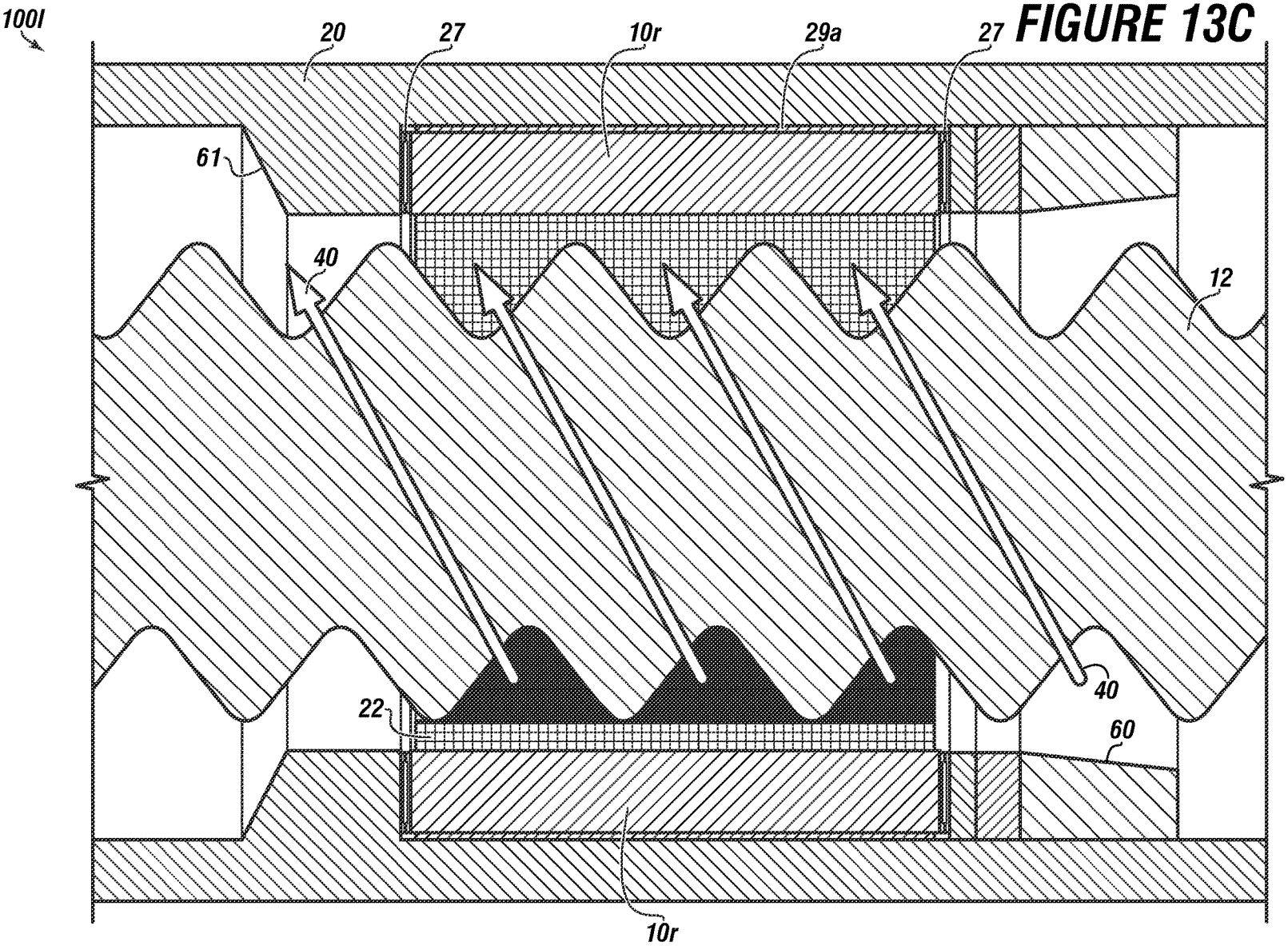
FIG. 13C is a side view along section 13C-13C of FIG. 13A.

FIG. 13C depicts a side view of an alternative embodiment of drill string assembly 100*l*. As shown in FIG. 13C, in this embodiment, at least for a short section of drill string assembly 100*l*, stator 22 profile is cut into a bearing-like metal and drill string assembly 100*l*, including stator bearing 10*r*. This arrangement eliminates the requirement for the bearing to rotate, although thrust bearings 27 and outer radial bearing pads 29*a* are shown, which allow for at least some compliance.

In some embodiments in which rotor 12 is used as the drill bit drive shaft, characteristics of the extended portion of rotor 12 that is used as the drill bit drive shaft are the same as those of the remainder of rotor 12. For example, this extended portion of rotor 12 has the same pitch and/or radii as the remainder of rotor 12. In other embodiments, the extended portion of rotor 12 has one or more different characteristics than the remainder of rotor 12, for example a different pitch and/or radii. In a preferred embodiment, for optimal performance, the rotor orbit 48 is maintained along the extended portion of rotor 12 (i.e., rotor 12 and the rotor extension 14 have the same, axially aligned, concentric orbits).

Rolling Barrel Bearing—Single Axis

Figure 14A:
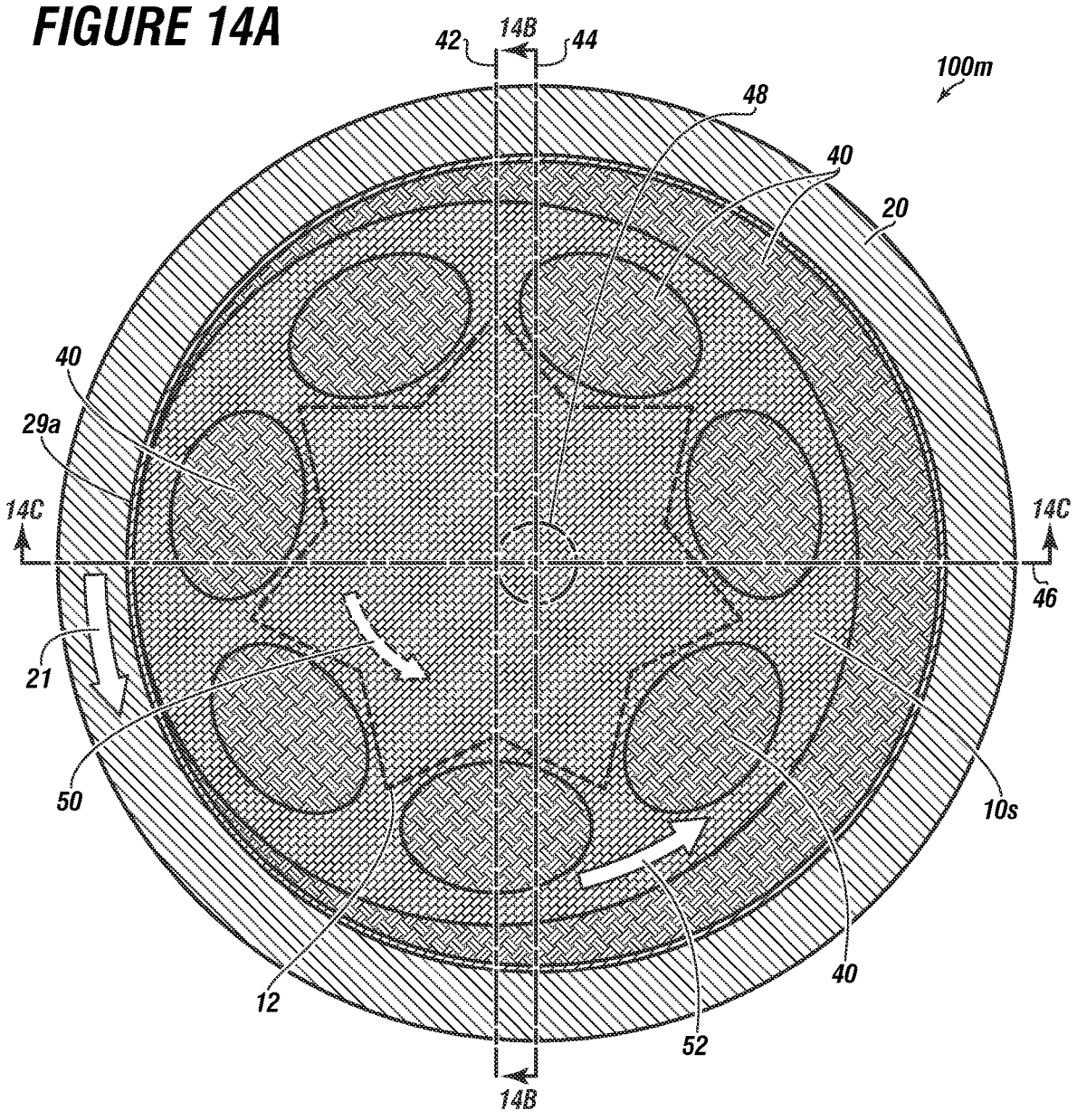
FIG. 14A is a cross-sectional view of an embodiment with a rolling barrel bearing and a solid drive shaft.
Figure 14B:
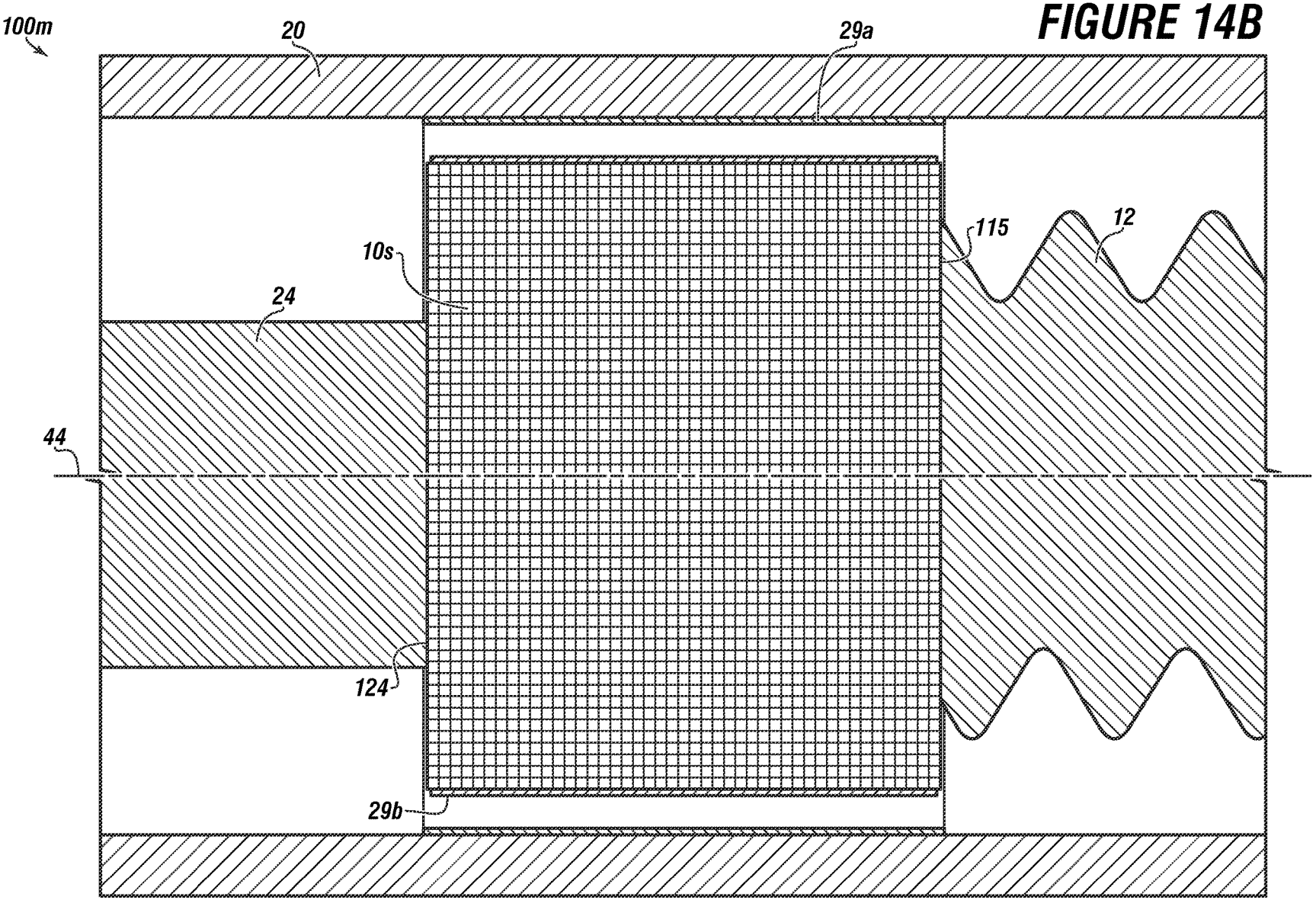
FIG. 14B is a side view along section 14B-14B of FIG. 14A.
Figure 14C:
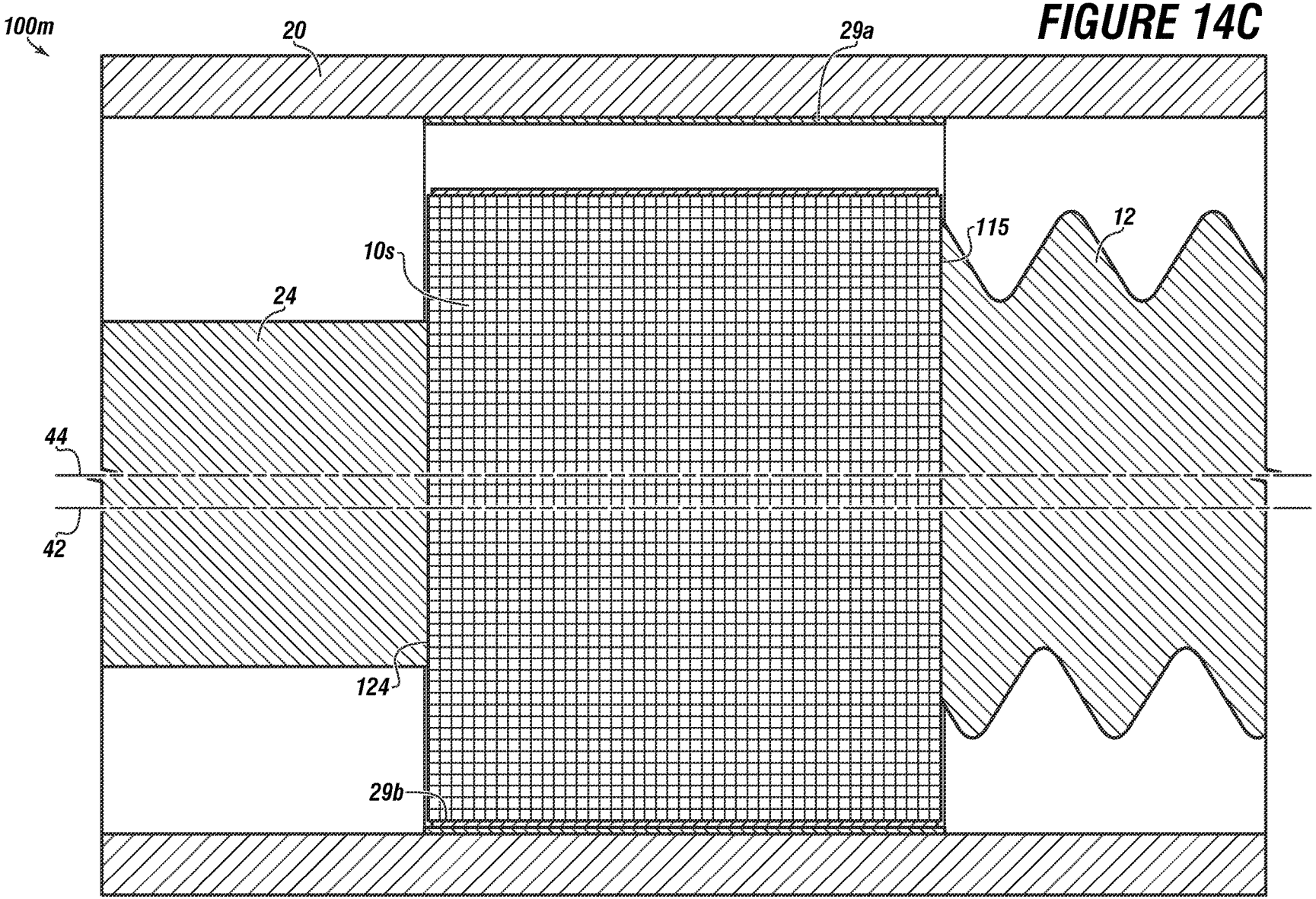
FIG. 14C is a side view along section 14C-14C of FIG. 14A.

FIGS. 14A-14C depicts drill string assembly 100*m*. In the embodiment depicted, the hypocycloidal bearing 10*s* is in the form of a rolling barrel bearing 10*s* rigidly attached to rotor 12 on one end 115 and rigidly attached to drill bit drive shaft 24 at the opposite end 124. As shown in this arrangement, drill string assembly 100*m*, including hypocycloidal bearing 10*s*, is not supporting bit loads. However, other embodiments are suitable for supporting bit loads.

Symmetric Gear Drive

Figure 15A:
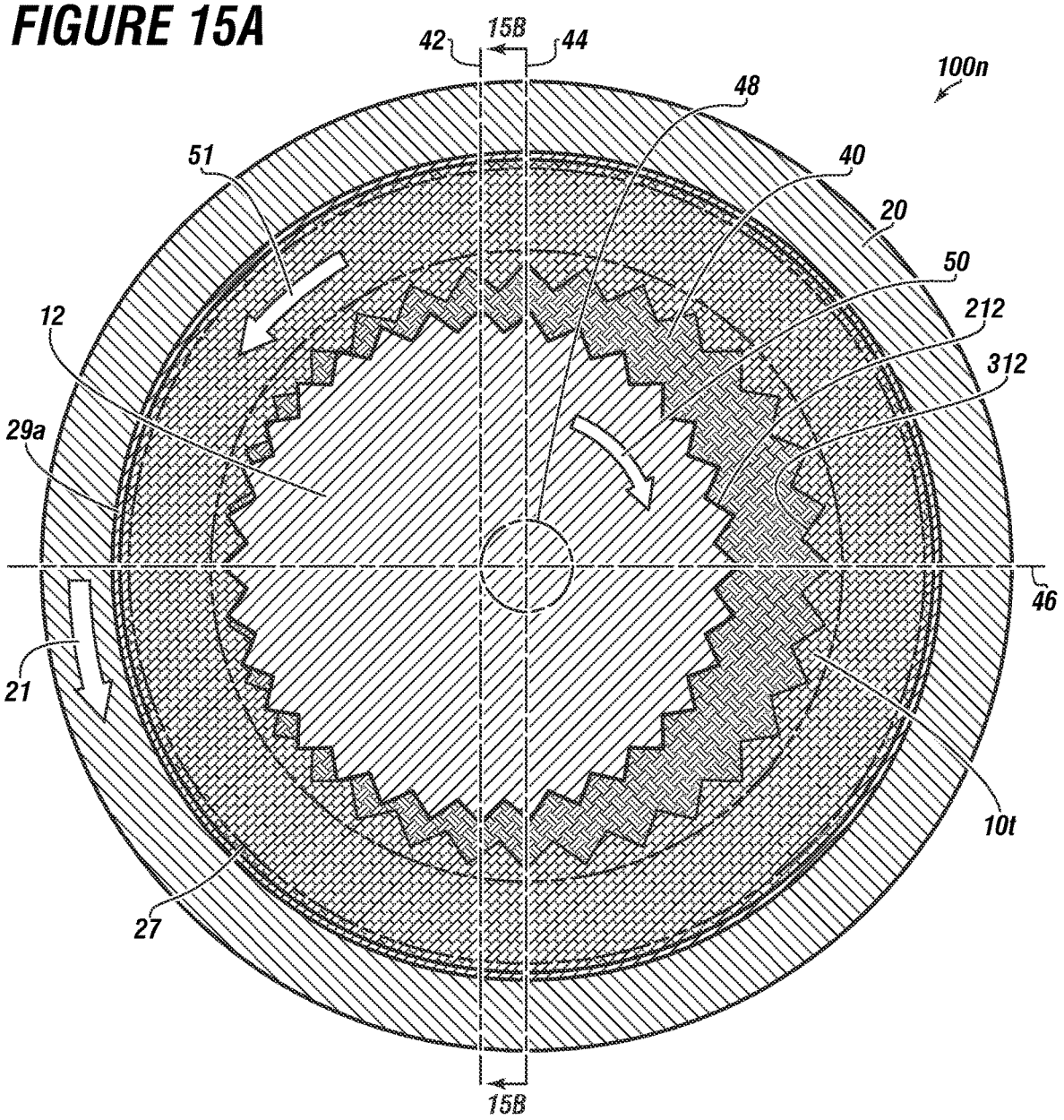
FIG. 15A is a cross-sectional view of an embodiment with a symmetric gear drive.
Figure 15B:
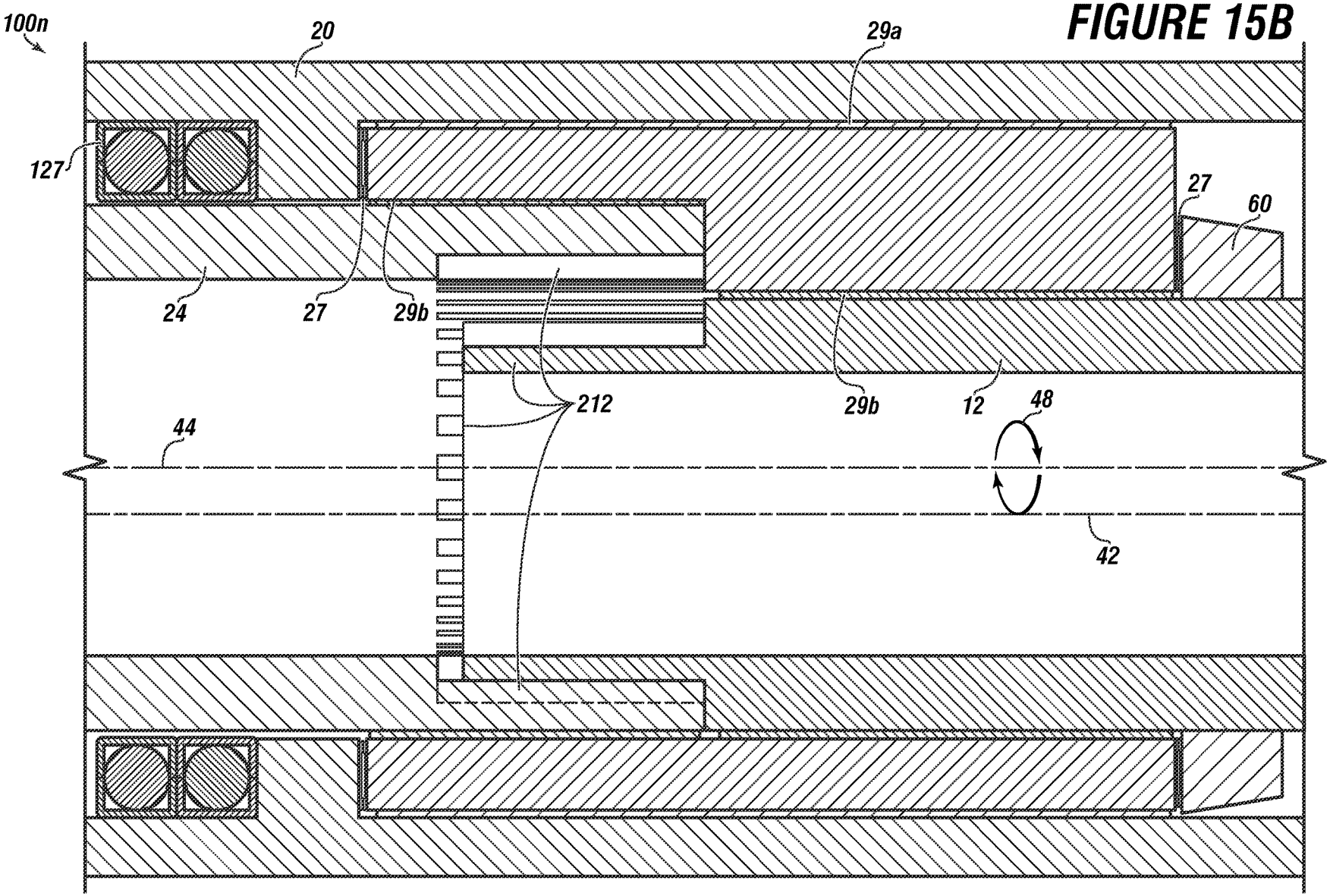
FIG. 15B is a side view along section 15B-15B of FIG. 15A.

FIGS. 15A and 15B depict drill string assembly 100*n*. In this embodiment, rotor 12 is extended beyond the stator and includes gear profile 212. Torque and rotation are transmitted through the gear profile 212 to hypocycloidal bearing 10*t*, which has a complimentary gear profile 312. With just one pair of gear profiles, rotor 12 counter rotates relative to the drill bit. In traditional drilling systems, the rotor would need to rotate counter clockwise relative to the standard clockwise rotation of the drill bit. In embodiments with an odd number of gears (not shown), the need to counter rotate the rotor would be obviated.

Downhole Drilling Assemblies & Progressive Cavity Machines

As described above in reference to FIGS. 1-15B, some embodiments include a downhole drilling assembly (drilling apparatus or drilling machine). The drilling assembly includes a drill bit or cutting structure assembly and a steerable mud motor assembly that includes at least one progressive cavity rotor and one or more hypocycloid radial bearings configured to support the rotor as it rotates within a motor housing or container. The hypocycloid bearings provide one or more axes of rotation and is positioned at one or both ends of the rotor(s), at one or more intermediate positions between the ends of the rotor, or combinations thereof.

While the hypocycloid bearings are described as being used in a drilling motor with reference to FIGS. 1-15B, the hypocycloid bearings can be used in other components that include a rotor and stator. For example, other embodiments include a progressive cavity pump or machine or motor. The pump or machine or motor includes at least one progressive cavity rotor positioned in one or more progressive cavity stators and one or more hypocycloid radial bearings that are configured to support the rotor(s) as it rotates within the progressive cavity stator(s). In such embodiments, the hypocycloid bearing(s) provides one or more axes of rotation and may be positioned at the end or ends of the rotor(s) and/or between the ends of the rotor.

Single Axis (Stator)

Certain embodiments include a hypocycloidal bearing that provides a single axis of rotation. In some such embodiments, the rotor outer diameter directly rides on hypocycloidal bearings that are in the form of circular ring bearings that are concentric with the stator housing (motor housing). In some such embodiments, such circular ring-type hypocycloidal bearings are integral to the stator housing, with the elastomer of the stator being formed (e.g., molded/injected molded) between and/or around the circular ring-type hypocycloidal bearings. Such circular ring-type hypocycloidal bearings may be in contact with the stator housing, and be molded into the elastomer that forms the stator.

In some such embodiments, rotor extensions extend at either or both ends of the rotor, and roll on the circular ring-type hypocycloidal bearings or roll directly on the stator housing. In certain embodiments, each rotor extension is in the form of an axle with an axle diameter that is less than the minimum rotor diameter, and includes an integral or attached spoked wheel that rolls on the circular ring-type hypocycloidal bearings or rolls directly on the stator housing.

In some embodiments, the rotor has a hypocycloid outer profile that rides on hypocycloidal bearing materials formed with a full, partial, or approximated hypocycloid stator profile that is complementary with the hypocycloid profile of the rotor and is concentric with the stator housing. In some such embodiments, the profiled hypocycloidal bearing(s) are integral to the stator housing and the elastomer that forms the stator is positioned between the profiled hypocycloidal bearing rings, with each of the profiled hypocycloidal bearings mutually timed to the rotor and to the stator elastomer. The profiled hypocycloidal bearing(s) may be in contact with the stator housing, with the stator elastomer positioned between the profiled hypocycloidal bearing rings that are mutually timed to the rotor and the stator elastomer.

Dual Axis (Stator and Rotor)

Certain embodiments include to hypocycloidal bearings that provide dual axes of rotation. In some such embodiments, the hypocycloidal bearings are formed as a circular plate or thin cylinder that is rotationally fitted to an inner diameter of the stator housing, with an off-center circular hole that is consistent with the rotor outer diameter or with a concentric extension from the rotor. In such embodiments, the distance off-center of the circular hole is defined by the hypocycloid orbit. The circular plate or thin cylinder hypocycloidal bearings include spokes, flow passages (e.g., mud flow passages), and/or chokes. In some such embodiments, the outer perimeters of the hypocycloidal bearings rotate true to the stator housing, and the off-center circular hole of the circular plate or thin cylinder hypocycloidal bearings rotates true to the rotor and/or the rotor extension.

Direct Hypocycloid Drive Between the Mud Motor and Bit

In some embodiments, a drill string assembly is provided that is configured for direct drive of the drill bit via the mud motor. In some such embodiments, the drill bit is gear driven or rotor driven.

Hypocycloidal Bit Rotation

In some embodiments, a drill string assembly is provided with a drill bit that is configured to rotate with a hypocycloidal motion. In some such embodiments, the hypocycloidal rotation of the drill bit is natural, reduced, or exaggerated.

Steerable Hypocycloid Motor

Some embodiments include a steerable drill string assembly having one or more hypocycloid bearings, as provided herein. Some embodiments include a steerable drill string assembly with a drill bit configured for hypocycloid bit motion. In some such embodiments, the steerable drill string assembly includes a single axis hypocycloid bearing fixedly coupled to the motor output shaft (e.g., bit shaft or rotor extension) and rotationally coupled to a bearing race located in a housing or sub positioned below the mud motor, and preferably near the drill bit. The bearing race may be round and located off-center relative to the housing or sub positioned below the mud motor. In such embodiments, the off-center bearing race acts upon the hypocycloid bearing drive shaft to create an eccentric orbit for the spinning drill bit; thereby, enhancing side-cutting action of the drill bit. Alternatively, a hypocycloid bearing that does not have a round profile (i.e., non-round profile) may be coupled with a cam follower, providing for more aggressive side-cutting with the drill bit (i.e., providing an increased rate of side extension of the drill bit). In some such embodiments, the drill string assembly including such a hypocycloid bearing includes a flex shaft or flex joint, providing for side-cutting movement of the drill bit.

In some such embodiments, the steerable drill string assembly includes dual axis hypocycloid bearing rotationally coupled to the mud motor output shaft (i.e., bit shaft or rotor extension) and rotationally coupled to a bearing race. The bearing race may be located in a housing or sub positioned below the motor, and preferably positioned near the drill bit. In some such embodiments, the bearing race is round, and is positioned off-center relative to the housing or sub below the motor. The off-center bearing race acts through the circular plate or thin cylinder hypocycloid bearing on the drive shaft of the hypocycloid bearing to create an eccentric orbit for the spinning drill bit; thereby, enhancing side-cutting action of the drill bit. In some embodiments of the steerable drill string assembly including the dual axis hypocycloid bearing, a non-round profiled hypocycloid bearing is coupled with a cam follower, providing for more aggressive side-cutting with the drill bit (i.e., providing an increased rate of side extension of the drill bit). In some such embodiments, the drill string assembly including such a hypocycloid bearing includes a flex shaft or flex joint, providing for side-cutting movement of the drill bit.

Mud Motor Fit Enhancements

In some embodiments, the coefficient of thermal expansion (CTE) of the material of the stator is modified by modifying the material composition of the stator. In general, the CTE for metals are typically lower (e.g., $\sim 15\times10^{-6}$ m/(m K)) as compared to the CTE of rubbers (e.g., $\sim 58\times10^{-6}$ m/(m K)). For a rubber stator, the CTE of the rubber stator may be modified by inclusion of a filler in the rubber; thereby, forming a rubber/filler composite. The filler may include, but is not limited to, glass, which typically has a CTE of about $0.56\times10^{-6}$; diamond, which typically has a CTE of about $1.2\times10^{-6}$; carbon black; silicone, which typically has a CTE of about $2.7\times10^{-6}$; boron nitride, which typically has a CTE of about $3.7\times10^{-6}$; or combinations thereof. For example, a mixture of about 75 weight percent of diamond dust and about 25 weight percent of a rubber may have a combined CTE of about 15.4. Modification of the CTE of the stator may reduce or eliminate any differential expansion between the stator metal parts coupled thereto (e.g., the motor housing and the rotor).

In some embodiments, the rubber/filler composite has a reduced wear rate relative to the rubber without the filler. As used herein, "wear rate" refers to the rate of degradation of the rubber as a result of frictional interaction with the rotor (e.g., thickness of stator degraded per amount of time). In some embodiments, the rubber/filler composite has an increased strength relative to the rubber without the filler.

Articulated Metal-to-Metal Mud Motor

Some embodiments include closely spaced profiled, small outer diameter stator tube sections, including a relatively thin layer of elastomer disposed between the motor housing and between the bearings that bond the stator tubes to the motor housing, hydraulically seals the mud motor, and provides for articulation (for a bending mud motor) and compliance (for minor dimensional variations) for the mud motor (e.g., as shown in FIG. 3).

In some such embodiments, such a mud motor may be formed by a method that includes injecting rubber to into the motor housing to form the relatively thin layer of elastomer as the stator. In such embodiments, the stator tubes carry a substantial portion of the hoop stress (circumferential stress). The use of a multiplicity of relatively small outer diameter stator tube sections provides articulation to the mud motor. In some such embodiments, the method of forming such a mud motor includes adding a filler, such as lead, to the injected rubber that forms the stator. The filler may be added in sufficient quantity to provide added articulation and compliance to the mud motor.

In some such embodiments, the method of forming such a mud motor includes injecting a homogeneously dispersed gas, preferably an inert gas such as nitrogen, into the elastomer that forms the stator. The injection of the inert gas into the elastomer reduces the effective CTE of the elastomer. For example, injection of about 70% by volume of nitrogen into the elastomer may reduce the effective CTE to about 5. In some such embodiments, a smaller volume of inert gas is injected into the elastomer that forms the stator, such as about 5-10% by volume. Injection of this smaller volume of inert gas into the elastomer forms multiple discrete pockets or voids within the elastomer. The pockets or voids within the elastomer provide space for the relatively incompressible elastomer rubber to expand and move, due, at least in part, to the compressibility of any of the gas within the pockets or voids. In some such embodiments, the pockets or voids provide for an expansion volume for the elastomer that forms the O-ring glands and/or adjacent strips of rubber used to attach the reduced O.D. stator tube sections to the stator tube. The O-rings, alone, provide the required axial seal, but additional provisions may be required to carry the axial load. The rubber strips may be in the form of a spiral, provided there are provisions to carry the axial load and, preferentially, provided there is also an axial seal (such as an O-ring). In some embodiments, the rubber strips are circumferential and bonded to the reduced O.D. stator tube sections and the stator tube, providing both a seal and carrying the axial load.

Some embodiments include relatively closely spaced profiled, reduced outer diameter stator tube sections with an elastomer in the form of an O-ring or similar seal and/or rubber rings positioned between each profiled bearing section and the stator housing to hydraulically seal the mud motor between each of the profiled bearing elements to allow transfer of torque to the stator housing, prevent axial movement, and provide articulation and compliance to the mud motor. Some such embodiments include torsional locks (such as splines), an axial lock (such as a shoulder), and an articulated joint (such as matching spherical contacts).

Dynamic Lateral Impulse Drilling—Components

Some embodiments of the present disclosure include methods, systems, and apparatus for dynamically imparting a lateral movement to a mandrel shaft and/or drill bit of a drill string. Some embodiments include dynamic lateral impulse drilling mechanisms, apparatus, systems, and methods. Imparting lateral movement to the mandrel shaft and drill bit of a drill string provides an additional force component to the cutting action during drilling operations. Such additional lateral force may increase cutting efficiency and speed, reduce frictional engagement between the drill string and wellbore, and provide other additional enhancements to the drilling operations.

Each of U.S. patent application Ser. Nos. 16/049,588; 16/049,608; 16/049,617; and Ser. No. 16/049,631; as well as U.S. Provisional Patent Application No. 62/713,681, describe the use of diamond-on-steel for bearing applications, and are incorporated herein by reference in their entireties as if set out in full herein. In some embodiments, the bearing surfaces disclosed herein are, or include, the same materials as disclosed in U.S. patent application Ser. Nos. 16/049,588; 16/049,608; 16/049,617; or 16/049,631; or in U.S. Provisional Patent Application No. 62/713,681, such as diamond-on-steel bearing surfaces.

FIG. 16 is an isometric view of a lateral impulse drilling mechanism. Lateral impulse drilling mechanism 1600*a* includes mandrel shaft 1100 at distal end 1602, and bearing housing 1101 at proximal end 1604. Two primary bearing pads 1105 of mandrel shaft 1100 are in sliding contact with bearing housing 1101. Lateral impulse drilling mechanism 1600*a* includes fluid port 1102 within the mandrel shaft 1100 for the passage of fluid there-through.

Wear resistant element 1107 is coupled with mandrel shaft 1100. Wear resistant element 1107 is in sliding contact with bearing race 1106 on an internal surface of bearing housing 1101.

In operation, drilling fluid, which may be used to lubricate and cool the lateral impulse drilling mechanism 1600*a*, flows through fluid port 1102 and subsequently passes through the inner diameter of a drill bit exiting out into an annulus of a borehole within which lateral impulse drilling mechanism 1600*a* is positioned. Without being bound by a specific ratio, in some embodiments approximately 90 percent of fluid volume flows though the center of mandrel shaft 1100 and approximately 10 percent of the fluid volume flows around the outside of mandrel shaft 1100 making contact with the various sliding bearing contact surfaces thereon.

In some embodiments, the bearing race 1106 has an undulating surface profile, such that, as the mandrel 1100 rotates within the bearing housing 1101, the wear resistant element 1107 slides along the undulating surface of the bearing race 1106. Thus, as the wear resistant element 1107 slides along the undulating surface of the bearing race 1106, the axial alignment of the mandrel 1100 relative to the bearing housing 1101 varies. Thus, movement of the wear resistant element 1107 along the undulating surface of the bearing race 1106 induces a lateral movement of the mandrel 1100 relative to the bearing housing 1101. For example, at some positions of the wear resistant element 1107 along the undulating surface of the bearing race 1106, the mandrel 1100 and the bearing housing 1101 are coaxially aligned along shared longitudinal axis 1111, as shown in FIG. 16. At other positions of the wear resistant element 1107 along the undulating surface of the bearing race 1106, the mandrel 1100 and the bearing housing 1101 are coaxially aligned but not concentric along, such that the longitudinal axis 1111*b* of the mandrel 1100 is laterally shifted relative to the longitudinal axis 1111*a* of the bearing housing 1101. This movement of the wear resistant element over the undulating surface of the bearing housing is more readily viewable with reference to FIGS. 19A and 19B, described in more detail below.

Turning now to FIG. 17, another embodiment of a lateral impulse drilling mechanism is depicted. For clarity, lateral impulse drilling mechanism 1600*b* is shown in isolation from the rest of the drill string. However, one skilled in the art would understand that lateral impulse drilling mechanism 1600*b* may be incorporated into a drill string, including numerous additional components not shown in FIG. 17. Mandrel shaft 1100 includes bit box 1109 rotatably held within bearing housing 1101. Fluid port 1102 is centrally located within mandrel shaft 1100, such that drilling fluid may pass therethrough to an attached drill bit (not shown) and exit into the annulus of a borehole.

Lateral impulse drilling mechanism 1600*b* includes two primary bearing pads 1105. Primary bearing pads 1105 are moveably captured within respective keyway style, recessed pockets 1108 within mandrel shaft 1100. Each primary bearing pad 1105 is positioned to be in sliding contact with two corresponding bearing race surfaces 1104 within bearing housing 1101. While lateral impulse drilling mechanism 1600*b* is shown as including two primary bearing races 1104 and two primary bearing pads 1105, the lateral impulse drilling mechanisms disclosed herein are not limited to having two primary bearing races and pads, and may include more or less than two primary bearing races and pads. The lateral impulse drilling mechanisms disclosed herein include at least one primary bearing race and at least one corresponding primary bearing pad.

Three wear resistant elements 1107 are coupled with mandrel shaft 1100. Wear resistant elements 1107 are in sliding contact with a corresponding bearing race 1106 within bearing housing 1101. While lateral impulse drilling mechanism 1600*b* is shown as including three wear resistant elements 1107 and one secondary bearing race 1106, the lateral impulse drilling mechanisms disclosed herein are not limited to having three wear resistant elements and one secondary bearing race, and may include more or less than three wear resistant elements and more than one secondary bearing race. The lateral impulse drilling mechanisms disclosed herein include at least one wear resistant element and at least one secondary bearing race. In some aspects, wear resistant elements 1107 have contoured, curved outer surfaces.

In operation, the drilling fluid used to lubricate and cool the lateral impulse drilling mechanism 1600*b*, primarily flows through the center of mandrel fluid port 1102 and subsequently passes through the inner diameter of a drill bit exiting out into an annulus of a borehole within which lateral impulse drilling mechanism 1600*b* is positioned. Without being bound by a specific ratio, in some embodiments approximately 90 percent of fluid volume flows though the center of mandrel shaft 1100 and approximately 10 percent of the fluid volume flows around the outside of mandrel shaft 1100 making contact with the various sliding bearing contact surfaces thereon.

Lateral impulse drilling mechanism 1600*b* includes at least one axial thrust bearing 1103. Axial thrust bearing 1103 is coupled between mandrel shaft 1100 and bearing housing 1101. Axial thrust bearing 1103 may be or include a sliding, dual carrier ring that holds a plurality of polycrystalline diamond elements or other bearing material elements. Such thrust bearing rings may be designed with extra width to accommodate prescribed lateral movement. Furthermore, such axial thrust bearings may be positioned at any location on mandrel shaft 1100, including at the distal end near mandrel bit box 1109, at the proximal end of mandrel shaft 1100, or any position there-between.

Primary bearing pads 1105 are coupled to springs 1117 within pockets 1108 of mandrel shaft 1100. Thus, primary bearing pads 1105 are compressible towards mandrel 1100 and expandable towards bearing housing 1101. In embodiments where the bearing surface 1106 is an undulating surface, as wear resistant elements 1107 moves along the undulating surface and forces mandrel 1100 out of coaxial alignment with bearing housing 1101, the springs 1117 are compressible to facilitate this movement of the mandrel 1100. Also, the springs are expandable to facilitate that movement of the mandrel 1100 back into alignment with the bearing housing 1101.

Turning now to FIG. 18, another view of a lateral impulse drilling mechanism is depicted. Lateral impulse drilling mechanism 1600*c* includes one axial thrust bearing 1203 rotatably coupled between mandrel shaft 1200 and bearing housing 1201. Axial thrust bearing 1203 may be the same or similar to axial thrust bearing 1103. Primary bearing pads 1205 are moveably captured within recessed pockets 1208 on mandrel shaft 1200. Lateral impulse drilling mechanism 1600*c* includes two stacked Belville springs 1217 positioned between primary bearing pads 1205 and recessed pockets 1208 to provide an elastic restoring force to the bearing pads 1205. While shown as including two stacked Belville springs 1217, any number of stacked Belville springs 1217 may be used, depending on the elastic restoring force required, the space constraints of bearing housing 1201 or the drilling application. Furthermore, the lateral impulse drilling mechanisms disclosed herein are not limited to including Belville springs, and may include other elastic restoring force apparatus capable of imparting an elastic restoring force onto primary bearing pads 1205. The lateral impulse drilling mechanisms disclosed herein include at least one elastic restoring force apparatus (e.g., a spring, such as a Belville spring) for each primary bearing pad 1205. In some embodiments, one or a plurality of Belville springs (or other elastic restoring force apparatus) are distributed across the surface between the bottom of mandrel recessed pockets 1208 and primary bearing pads 1205, depending on the application, space constraints and bearing contact force required. Other types of springs that may be utilized include, but are not limited to, coil, leaf, and elastomer pads. Belville springs 1217 function the same as springs 1117 described in reference to FIG. 17.

The primary bearing pads disclosed herein, including bearing pads 1205, may be or include a relatively high-strength steel. For example, the primary bearing pads may be or include a high-performance steel including, but not limited to, 4130, 4330, 8630, S7, and 17-4 PH 1150 stainless, or other grades of steel that are typically used in oil tool drilling applications. In some embodiments, the sliding contact surfaces of primary bearing pads (i.e., the surfaces of primary bearing pads that are in contact with the surfaces of primary bearing races) are metallurgically coated or treated to increase the hardness or wear resistance thereof. One non-limiting example of a coating is hard-facing with macro-crystalline tungsten carbide matrix containing cobalt, nickel or a copper-based binder. In some embodiments, the sliding contact surfaces of primary bearing pads may be treated by carburizing, boronizing, nitriding or similar treatments. In some embodiments, shaped wear resistant elements with contoured surfaces are fitted into primary bearing pads to optimally match the inner diameter of primary bearing races. Such elements may be made of cemented tungsten carbide, polycrystalline diamond, natural diamond, compacted diamond composite segments, or thermally stable diamond segments, for example.

Primary bearing races 1204 are in sliding contact with primary bearing pads 1205. Primary bearing races 1204 may be either integrated into bearing housing 1201 or made as a separate sleeve coupled therewith. The primary bearing races, such as races 1204, may be made or include a relatively high-performance steel including, but not limited to, 4130, 4330, 8630, S7, and 17-4 PH 1150 stainless, or other grades of steel typically used in oil tool drilling applications. Bearing housing races may also be coated or metallurgically treated to further increase the hardness or wear resistance of the sliding contact surface thereof. One non-limiting example of a coating that may be applied onto primary bearing races is hard-facing with macro-crystalline tungsten carbide-based matrix containing a cobalt, nickel or copper-based binder. In some embodiments, the sliding contact surfaces of primary bearing races are treated by carburizing, boronizing, nitriding or similar surface treatments. In some embodiments, primary bearing races are constructed and metallurgically treated for increased wear-resistance as a separate and individually manufactured sleeve that is then coupled within bearing housing, which could be replaced as a consumable component.

The secondary bearing races disclosed herein, such as race 1206, may be made of a relatively high-performance steel such as 4330, 8630, S7, or 17-4 PH 1150 stainless steel, or other steel grades typically used in oil tool drilling applications. Secondary bearing races may also be coated or metallurgically treated to further increase the hardness or wear resistance of the surface thereof. One non-limiting example of a coating on secondary bearing race is a hard face metal containing macro-crystalline tungsten carbide-based matrix with a cobalt, nickel or copper-based binder. In some embodiments, the contact surface of secondary bearing race may also be treated by carburizing, boronizing, nitriding or similar metallurgical treatments. In some embodiments of secondary bearing races, hard material elements or segments are integrated or mounted into the sliding contact surfaces thereof, improving wear-resistance of the surface forming undulating slopes or ridges on the surface thereof. Such mounted segments may be or include polycrystalline diamond, cemented tungsten carbide or other similar wear resistant materials.

The primary bearing pads disclosed herein (e.g., primary bearing pads 1205) may be of a shape having a rectangular aspect ratio, with the radial length longer than the axial width. However, other non-limiting geometries of primary bearing pads include square, ovoid and round. In some embodiments, the length of primary bearing pads is equivalent to, at minimum, a 45-degree arc section of the bearing housing race inner diameter surface and, at a maximum, a 355-degree arc section of the bearing housing race inner diameter surface. In some embodiments, the length of primary bearing pads is equivalent to from a 45-degree arc section of the bearing housing race inner diameter surface to a 355-degree arc section of the bearing housing race inner diameter surface, or from a 60-degree arc section of the bearing housing race inner diameter surface to a 340-degree arc section of the bearing housing race inner diameter surface, or from a 90-degree arc section of the bearing housing race inner diameter surface to a 325-degree arc section of the bearing housing race inner diameter surface, or from a 120-degree arc section of the bearing housing race inner diameter surface to a 300-degree arc section of the bearing housing race inner diameter surface, or from a 180-degree arc section of the bearing housing race inner diameter surface to a 280-degree arc section of the bearing housing race inner diameter surface, or from a 220-degree arc section of the bearing housing race inner diameter surface to a 250-degree arc section of the bearing housing race inner diameter surface. In some aspects, the radial positioning of the primary bearing pads is 180-degrees from the position of the wear resistant elements 1207 with a tolerance of plus or minus 45-degrees, as measured from the center point of the primary bearing pads to the center of the wear resistant elements.

In some embodiments, primary bearing pads 1205, recessed pockets 1208, and primary bearing races 1204 include sliding contact surfaces that are curved (e.g., concave or convex), as opposed to flat, to accommodate minor angular alignment variations encountered by mandrel shaft 1200.

The lateral impulse drilling mechanism may include more than one primary bearing pad, each positioned within a shared axial plane. That is, in one axial (from distal end to proximal end) location of the bearing housing, there may be a plurality of relatively small primary bearing pads (also referred to as sliding pads) to distribute and balance the elastic restoring force imposed on the wear resistant element.

The apex 1299 of each contoured wear resistant element 1207 shown in FIG. 18 is the portion of the wear resistant element 1207 that is in primary sliding contact with the surface of secondary bearing housing race 1206. Wear-resistant elements 1207 may be or include a high-pressure/high-temperature synthesized polycrystalline diamond fused onto a cemented tungsten carbide substrate. However, other wear resistant materials may also be used for the sliding contact surface materials including, but not limited to, polycrystalline cubic boron nitride, silicon carbide, cemented tungsten carbide, and steel that has been optionally carburized, boronized or nitrided. The shape of the contoured wear resistant elements 1207 may be that of a cylinder with a convex or spherical crown having a sliding contact surface radius that is equal to or less than the smallest radius of the bearing housing race 1206. However, wear resistant elements 1207 may have other shapes, depending on the method of attachment to mandrel shaft 1200, the drilling application and methods used to minimize sliding contact wear or stresses.

In some embodiments, each wear resistant element 1207 has a wear resistant, sliding contact surface that is highly polished or at least partially polished. As used herein, "polished" is defined as a surface finish of less than about 10 μin, or of from about 2 to about 10 μm. As used herein, "highly polished" is defined as a surface finish of less than about 2 μin, or from about 0.5 μin to less than about 2 μin. As would be understood by one skilled in the art, surface finish may be measured with a profilometer or with Atomic Force Microscopy.

While three contoured wear resistant elements 1207 are shown in FIG. 18, lateral impulse drilling mechanism may include only one or two contoured wear resistant element or may include more than three contoured wear resistant elements 1207. The use of additional wear resistant elements 1207 may increase the load capacity of lateral impulse drilling mechanism 1600*c* and provide redundancy. The contoured wear resistant elements 1207 may be positioned in any pattern, including clusters, that enables camming movement via the profile of secondary race 1206. In some embodiments, multiple sets of wear resistant elements 1207 and primary bearing pads 1205 are positioned or stacked in different axial planes within bearing housing 1201 and allowed to overlap radially for increased load capacity and redundancy. Also shown in FIG. 18 are bit box 1209 and fluid port 1202.

Figure 19A:
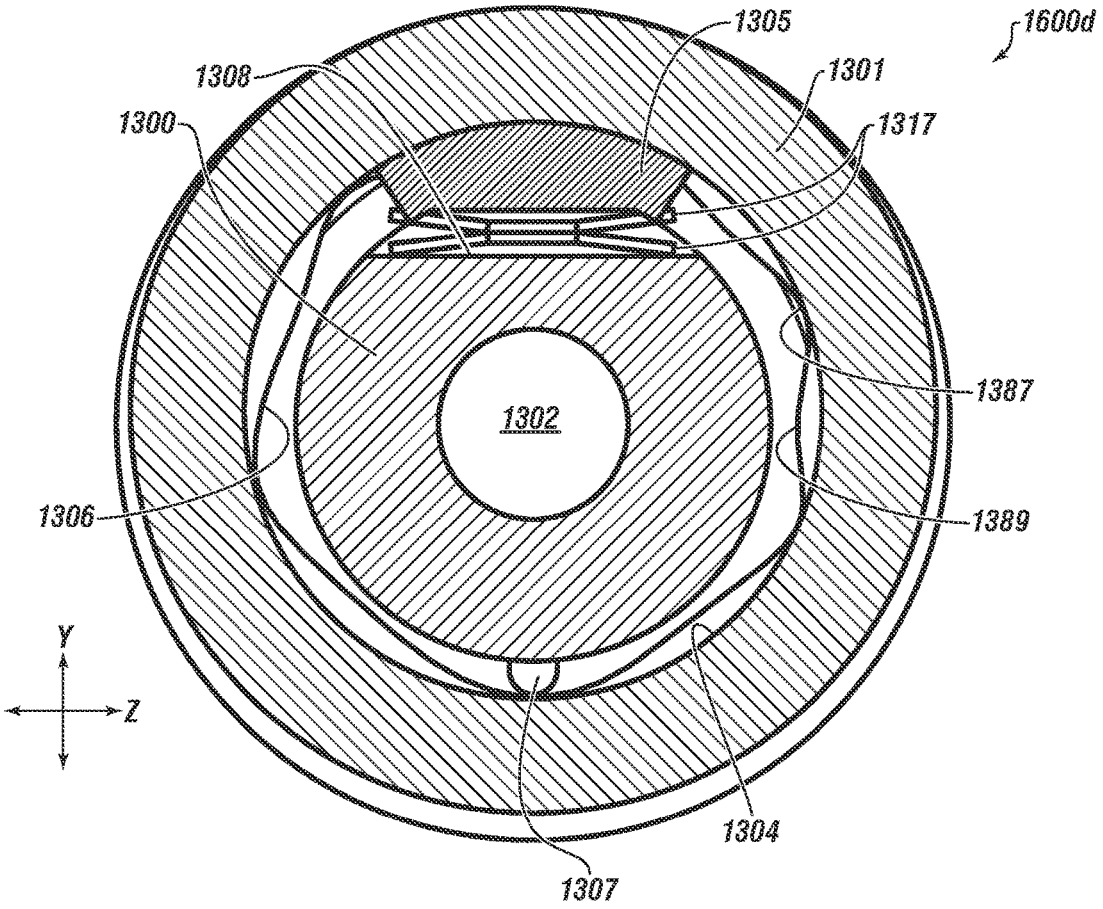
FIGS. 19A and 19B are cross-sectional end views of the lateral impulse drilling mechanism of FIG. 16, from the direction of the distal end of the lateral impulse drilling mechanism.
Figure 19B:
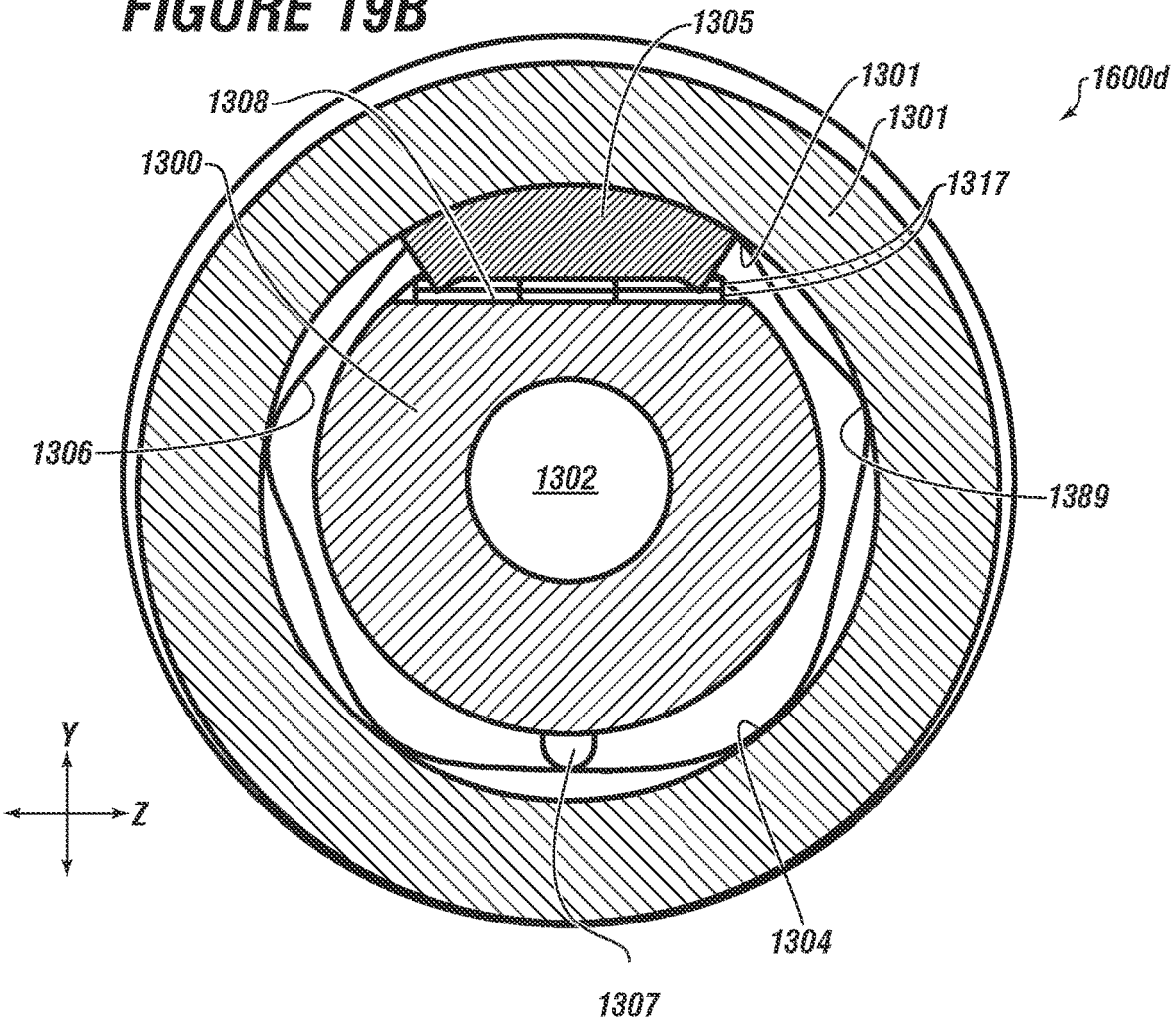

FIGS. 19A and 19B are cross-sectional views, looking axially into bearing housing 1301 of the bottom hole assembly of a lateral impulse drilling mechanism 1600*d* that same or substantially the same as that shown in FIG. 17. Primary bearing pad 1305 is in sliding contact with primary bearing race 1304, and wear element 1307 is in sliding contact with the undulating surface of secondary bearing race 1306. Two stacked Belville springs 1317 are positioned between primary bearing pad 1305 and the bottom of recessed pocket 1308 to provide an elastic restoring force thereto.

The undulations of secondary bearing race 1306 can be seen in FIGS. 19A and 19B, which are located within the inner diameter of the bearing housing 1301. The undulating pattern of secondary bearing race 1306 may be configured or profiled in any number of ways, allowing the wear resistant elements 1307 to act as cam followers to laterally manipulate or move mandrel shaft 1300 depending on the drilling application. The undulating pattern of secondary bearing race 1306 is not limited to the particular one shown in FIGS. 19A and 19B, and may be any of a variety of non-limiting patterns. The undulating pattern of secondary bearing race 1306 may be varied to define: (1) the frequency of lateral movements imparted to mandrel shaft 1300 as wear resistant elements 1307 move along secondary bearing race 1306; (2) the number of lateral impulses imparted to mandrel shaft 1300 in one 360-degree rotation of wear resistant elements 1307 along secondary bearing race 1306; (3) the amplitude or lateral displacement distance in one 360-degree rotation of wear resistant elements 1307 along secondary bearing race 1306; (4) the wave form type of the undulating pattern, including sinewave, half-wave, sawtooth or triangle, in one 360-degree rotation of wear resistant elements 1307 along secondary bearing race 1306; (5) the pattern symmetry or asymmetry of the undulating pattern in one 360-degree rotation of wear resistant elements 1307 along secondary bearing race 1306; or (6) combinations thereof. To impart lateral impulses to mandrel shaft 1300, at least one impulse or undulation is on secondary bearing race 1306 per every 360-degree rotation of wear resistant element 1307 thereabout. However, there is no maximum limit to the number of impulses or undulations that may be included on undulating surface of secondary bearing race 1306.

The undulation amplitude displacement distance may be, in one example, 0.025 inches or greater, such as from 0.025 to 0.1 inches, or from 0.03 to 0.09 inches or from 0.04 to 0.08 inches, or from 0.05 to 0.06 inches. As used herein, the "undulation amplitude displacement distance" refers to the distance that the mandrel shaft is laterally moved in the z- or y-direction as a result of movement of wear resistant element 1307 along the undulating surface of secondary bearing race 1306. That is, movement of wear resistant element 1307 along the undulating surface of secondary bearing race 1306 cyclically imparts lateral forces to mandrel shaft 1300, causing mandrel shaft 1300 to move laterally along the z- and/or y-directions. In some aspects, movement of wear resistant element 1307 along the undulating surface of secondary bearing race 1306 cyclically forces mandrel shaft 1300 into and out of coaxial alignment with bearing housing 1301. The impulse frequency of the lateral impulse drilling mechanisms disclosed herein may be 1 impulse per 360-degree rotation or greater. As used herein, the "impulse frequency" refers to the number of lateral impulses (lateral movements) imparted to the mandrel shaft per 360-degree rotation of the wear resistant element(s) along the secondary bearing race. For example, in the embodiment shown in FIGS. 19A and 19B, secondary bearing race 1306 includes an undulating surface defined by a series of peaks 1389 and valleys 1387. Each time that wear resistant element 1307 moves over one of peaks 1389, mandrel shaft 1300 is forced to move laterally relative to bearing housing 1301 such that a single "impulse" to mandrel shaft 1300 occurs. Lateral impulse drilling mechanism 1600*d* includes six peaks, such that six lateral impulses are imparted to mandrel shaft 1300 for each 360-degree rotation of wear resistant element 1307 along secondary bearing race 1306. However, the lateral impulse drilling mechanisms disclosed herein may have more or less than six peaks. FIG. 19A depicts wear resistant element 1307 engaged with a valley of the undulating surface of secondary bearing race 1306. FIG. 19B depicts wear resistant element 1307 engaged with a peak of the undulating surface of secondary bearing race 1306, such that the mandrel 1300 is laterally shifted relative to FIG. 19A and such that the spring 1317 is compressed relative to FIG. 19A. Also shown in FIGS. 19A and 19B is fluid port 1302.

Secondary bearing race 1306 can be contoured to have a prescribed pattern of undulation that is synchronized and/or timed to coincide with a bottom hole assembly scribe line associated with the direction of steer on a steerable motor. Such synchronization can be used to amplify, attenuate or otherwise influence various factors or tendencies related to the steering of a bottom hole assembly while slide drilling. As used herein, "slide drilling" is defined as the drill bit rotating while the drill string is not rotating, allowing the drill string to steer or build in a desired direction by means of a bent housing section contained in the bottom hole assembly.

Figure 20:
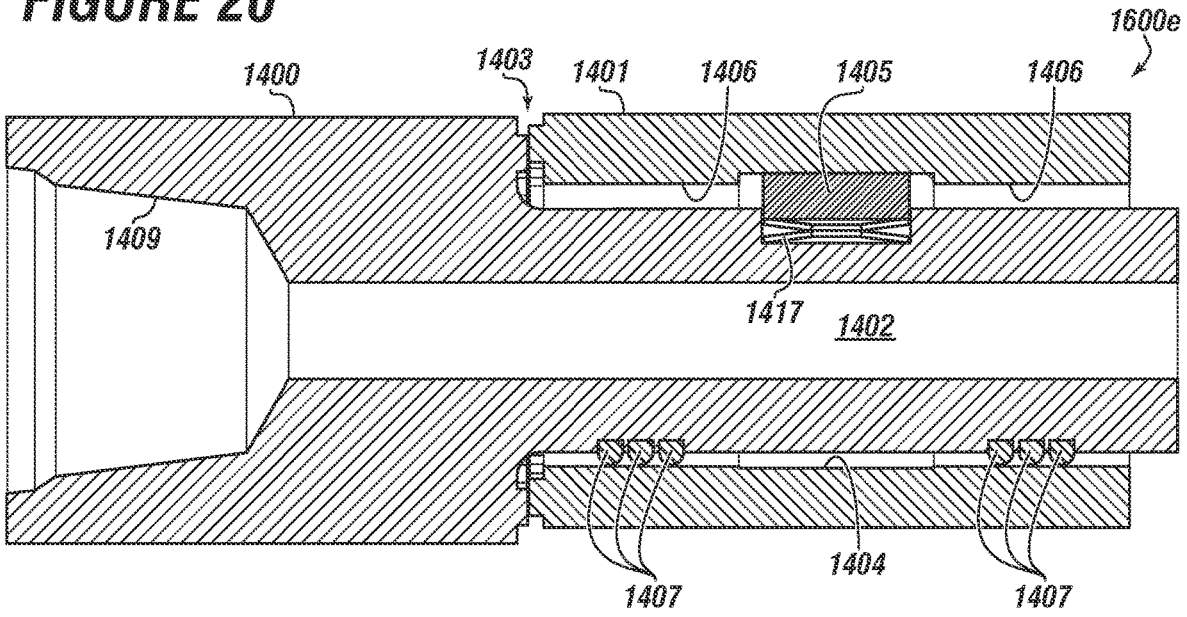
FIG. 20 is an isometric, cross-section view of a lateral impulse drilling mechanism including one primary bearing pad and a plurality of wear resistant elements.

FIG. 20 depicts an alternative design of a lateral impulse drilling mechanism. Lateral impulse drilling mechanism 1600*e* includes one centrally located primary bearing race 1404 and two secondary bearing races 1406 located axially above and below primary bearing race 1404. The secondary bearing races 1406 are synchronized with matching undulating patterns. This configuration allows mandrel shaft 1400 to rotate and also translate laterally as prescribed by the patterns on secondary bearing race 1406, while at the same time holding parallelism within bearing housing 1401. Thus, a lateral movement or shift of a component is a movement of that component in a direction that is perpendicular to the axis of rotation of that component. For example, looking at FIG. 19A, the axis of rotation of shaft 1300 is the x-axis coming out of and going into the page. Thus, a lateral movement or shift of the shaft 1300 is a movement of the shaft 1300 along the y-axis and/or z-axis (or within the plane defined by the y-axis and z-axis) while maintaining the axis of rotation of the shaft 1300 parallel with the x-axis.

Thrust bearing 1403 may be the same or substantially similar to those described with reference to FIGS. 16-19B. Thrust bearing 1403 may be designed with extra width to accommodate any lateral movement, which may be induced by the undulating patterns prescribed by the cam action of secondary bearing races 1406. While only one axial thrust bearing 1403 is depicted, any number of thrust bearings may be utilized at any number of locations along mandrel shaft 1400.

Lateral impulse drilling mechanism 1600*e* also includes primary bearing pad 1405 coupled with mandrel 1400 via spring 1417 and engaged with bearing race 1404. Lateral impulse drilling mechanism 1600*e* also includes wear resistant elements 1407 engaged with bearing race 1406. Also shown in FIG. 20 are bit box 1409 and fluid port 1402.

FIG. 21 depicts another embodiment of the lateral impulse drilling mechanism. Lateral impulse drilling mechanism 1600*f* includes bearing housing 1501 rotatably coupled with mandrel shaft 1500, and axially supported by a curved combination thrust and radial sliding bearing 1503. Thrust and radial sliding bearing 1503 is a combination thrust and radial type bearing designed to accommodate both rotational and angular movement of the inner race. That is, mandrel shaft 1500 and corresponding inner races of the combination thrust and radial slide bearing 1503 may be independently rotatable about three mutually orthogonal axes. A bearing of this type is described in U.S. Pat. No. 9,016,405.

In FIG. 21, primary bearing pad 1505 is moveably captured into recessed pocket 1508 of mandrel shaft 1500. Two stacked Belville springs 1517 are positioned between primary bearing pad 1505 and the bottom of recessed pocket 1508 to provide an elastic restoring force. As in previous embodiments, while two stacked Belville springs 1517 are depicted, any number of stacked springs could be used depending on the elastic restoring force required, the application, and the space constraints of bearing housing 1501.

Lateral impulse drilling mechanism 1600*f* includes at least one Belville spring for each primary bearing pad 1505. In some embodiments, a plurality of Belville springs are laterally distributed between the bottom of the recessed pocket and primary bearing pad, depending on the application, lateral area space constraints, and bearing contact force required. In addition, the geometric sides and corners of primary bearing pad 1505 and associated bottom corners, surfaces and sidewalls of recessed pocket 1508 may be radiused, as necessary, to accommodate any potential angular movement of mandrel 1500.

Primary bearing race 1504 is located within the inner diameter of bearing housing 1501. Primary bearing pad 1505 is positioned to make sliding contact with primary bearing race 1504, within the inner diameter of bearing housing 1501. Secondary bearing race 1506 is located near the proximal end of mandrel shaft 1500. Wear resistant element 1507 is mounted in mandrel shaft 1500 to make sliding contact with secondary bearing race 1506 within bearing housing 1501. Wear resistant element 1507 may include one single element or a plurality of elements. Wear resistant element 1507 may be shaped with a contoured surface to make optimal sliding contact while mandrel shaft 1500 rotates, and to function as a cam follower. Secondary bearing race 1506 is contoured with an undulating pattern to induce prescribed lateral movement of mandrel shaft 1500, while mandrel shaft 1500 is rotating. The combination radial and thrust bearing 1503 acts as a rotating pivot point to support both axial and radial forces between mandrel shaft 1500 and bearing housing 1501. This arrangement allows for mandrel shaft 1500 and a connected drill bit (not shown) to be angularly manipulated or pointed in various directions per 360-degree rotation, according to the drilling application. Also shown in FIG. 21 is bit box 1509 and fluid port 1502.

Dynamic Lateral Impulse Drilling—Operation

Having now described the components of some embodiments of the lateral impulse drilling mechanisms disclosed herein, the operation thereof will now be described in more detail. During standard drilling with a steerable motor, fluid is pumped from the drill rig floor through the drill string and bottom hole assembly to ultimately be expelled through the drill bit nozzles into the wellbore annulus. Upon first entering the bottom hole assembly, drilling fluid drives a positive displacement motor and associated transmission assembly, converting hypocycloid rotation to concentric rotation. A fixed blade bit attached to the mandrel shaft rotates to shear and remove rock in discrete radial paths. Similarly, three cone bits rotate concentrically, but instead crush rock as the primary cutting mechanism.

Referring to FIGS. 19A and 19B, the method of operation of the lateral impulse drilling mechanisms disclosed herein will now be described. As mandrel shaft 1300 rotates, the contoured wear resistant element or elements 1307 are in sliding contact with and act as a cam follower along the prescribed undulating pattern of secondary bearing race 1306. This induces lateral movement to mandrel shaft 1300, relative to bearing housing 1301 (i.e., the mandrel shaft 1300 is displaced from coaxial alignment with a longitudinal axis of the bearing housing 1301, along the y- and/or z-directions). Such induced lateral movement of mandrel shaft 1300 introduces new rock cutting mechanisms, as the drill bit and associated cutting elements are imparted with additional lateral movement components during rotation. Such lateral movement may be customized into a wide array of prescribed patterns to provide advantageous variations of rock cutting mechanics. Without being bound by theory or drilling methodology, various mechanism of movements will now be described.

With a continuous, sinewave undulating surface pattern of the secondary bearing race (as shown in FIG. 17), the cam following movement of the wear resistant element therealong may impart multiple, soft lateral undulations to the mandrel shaft per 360-degree rotation thereof. With such a pattern, the mandrel shaft 1100 of FIG. 17, connected to a drill bit (not shown), would be induced to move or undulate slightly from side-to-side while rotating and also still holding parallelism with bearing housing 1101. Without being bound by theory, the lateral movement of the mandrel shaft will impart lateral bit movement that cyclically occurs per 360-degree rotation, inducing increased fracturing of the rock formation. Additionally, cutting elements moving laterally, from side-to-side, while the bit is rotating will utilize a greater amount of cutting element edge, resulting in increased life and efficiency of the cutting elements. Furthermore, prescribed undulating lateral motion of a drill bit may improve cutting performance and extend the life of cutting elements more centrally located on the drill bit. Centrally located cutting elements on a fixed cutter drill bit are more susceptible to damage due to inherently lower radial cutting surface speeds. Undulating bit movement increases lateral cutting and fracturing tendencies of the rock located at the center of the bit face, thus making it easier to remove the formation and decrease propensity for cutting element damage.

A sawtooth undulating surface pattern of the secondary bearing race can create a gradual lateral shift followed by an abrupt retraction of the mandrel shaft back to its original position, thus creating a momentary, higher energy lateral movement event or impulse. Such a lateral, high energy impulse occurring multiple times, per one 360-degree bit rotation, will induce advantageous rock fracturing. A sawtooth undulating surface pattern 2206 is shown in FIG. 22, including teeth 2279. For simplicity, the sawtooth undulating surface pattern is shown in a flattened configuration. In operation, a wear resistant member (not shown) gradually moves upwards along the sloped surface of one of teeth 2279, as indicated via arrow 2277. This causes a gradual lateral movement of the mandrel shaft. The wear resistant member then reaches the end of the sloped surface and abruptly moves downward, as indicated via arrow 2275, resulting in a corresponding abrupt lateral movement of the mandrel shaft. The wear resistant member then moves on to the next of teeth 2279.

A lateral move or impulse can be imposed on a drill bit when the movement of the drill bit is aligned or synchronized with the direction of steer or scribe line of a bottom hole assembly. With the lateral impulse of the drill bit aligned or synchronized with the direction of steer of the bottom hole assembly, the steering tendency can be augmented or made more effective.

High frequency undulating patterns may be used to provide small amplitude, higher frequency lateral vibrations or oscillations in the mandrel shaft, and thus in the attached drill bit. Lateral vibrations or oscillations of the mandrel shaft and drill bit connected therewith may result in reduced drill string friction while sliding in an extended horizontal section of a wellbore. That is, by repeatedly, laterally moving out of contact with the wellbore, the drill string experiences reduced friction when sliding within the wellbore.

Referring again to FIG. 21, lateral impulse drilling mechanism 1600*f* includes one primary bearing pad 1505 and a corresponding primary bearing race 1504 in sliding contact therewith. One wear resistant element 1507 and one secondary bearing race 1506 are in sliding contact to provide cam following movement along the undulating surface of secondary bearing race 1506. The configuration of lateral impulse drilling mechanism 1600*f* allows mandrel 1500 to pivot angularly within bearing housing 1501. The steering tendency of a bottom hole assembly will be augmented or made more effective when the occurrence of the angular impulses is synchronized with the scribe line or direction of steer of the bottom hole assembly.

During both slide and rotate drilling, various types of resonance or resonant oscillations can occur along the drill string, which can be potentially harmful or even lead to eventual failure of the bottom hole assembly. These resonant oscillations can originate from an inherent natural frequency for a particular drill string design, can be induced by an excitation factor, such as drill string friction against a formation, or can be induced by the aggressiveness of a particular bit design. Dynamic lateral impulse mechanisms, such as those shown and described with reference to FIGS. 16-22, can be synchronized using a prescribed undulating pattern to cancel deleterious resonant oscillation tendencies or significantly reduce the magnitude of these oscillations and vibrations.

Dynamic Torsional Detent Mechanism—Components

Some embodiments of the present disclosure include methods, systems, mechanisms, and apparatus for dynamically imparting a torsional movement to a mandrel shaft and/or drill bit of a drill string. Some such embodiments include dynamic torsional detent drilling mechanisms, and methods of use thereof. Imparting torsional movement to the mandrel shaft and drill bit of a drill string provides an additional force component to the cutting action during drilling operations. Such additional torsional force may increase cutting efficiency and speed, reduce frictional engagement between the drill string and wellbore, and provide other additional enhancements to the drilling operations.

Some embodiments include a torsional detent mechanism configured to create discrete and prescribed torque impulse events at the drill bit. The detent mechanisms disclosed herein are configured to cause an amount of potential torsional energy to buildup and then to quickly release to provide for increased drilling energy, reduced friction due to vibration, and to breakup inherent drill string harmonics. In addition, the detent mechanisms disclosed herein may induce a lateral hammering or jarring effect to augment steering tendency of the drill string.

In some embodiments, a bottom hole assembly with a bearing housing is provided. The torsional detent mechanism disclosed herein may be generally located in the bottom hole assembly of the drill string. The bottom hole assembly may or may not have a bent housing.

The torsional detent mechanism shown in FIG. 23 is shown in isolation from the remainder of the drill string for clarity and simplicity. Dynamic torsional detent mechanism 2300*a* includes lower bearing housing 3100, which is rotatably connected to mandrel 3101. Mandrel shaft 3101 includes integrated box connection 3110 to accommodate a drill bit (not shown). Mandrel 3101 is integrated and/or formed with a secondary contoured mandrel race 3103 containing concave pockets 3104. Contoured mandrel race 3103 is in sliding contact with a plurality of wear resistant elements 3102 that are moveably captured in element retention pockets 3106 of lower bearing housing 3100. Secondary contoured mandrel race 3103 is or forms a portion of the mandrel that has an outer diameter that is larger than that of the shaft 3199 of mandrel 3101.

Wear resistant elements 3102 coupled with bearing housing 3100 via springs 3107 such that elements 3102 are extendable and retractable generally perpendicular as the contoured mandrel race 3103 rotates, thus creating a cam following action. The variable distance of the extending and retracting of wear resistant elements 3102 is determined by a prescribed geometry of concave pockets 3104 on contoured mandrel race 3103. Concave pockets 3104 may be equally spaced on the surface of the contoured mandrel race 3103. When the wear resistant elements 3102 slidingly engage the concave pockets 3104, the rotation of mandrel shaft 3101 is momentarily resisted allowing a torsional energy to build up in the drill string after which is then released once the detent resisting force is exceeded. As used herein, "detent" is defined as a mechanism or structure that temporarily maintains a component or part in a certain position relative to another component or part, which can be released from that certain position by applying force to one of the components or parts. Such detent action provides for the momentary buildup of torsional potential energy, and then quickly releases the built-up energy to create a dynamic torsional impulse to the rotating mandrel shaft 3101 and connected drill bit (not shown). Without being bound by theory, such torsional impulse action may augment rock destruction and increase drilling efficiency. The torsional impulse provides a temporary increase in the angular velocity of the rotating component (e.g., mandrel shaft). That is, the rotating component is rotating at a higher angular velocity immediately after the rotating component passes the detent than the angular velocity of the rotating component immediately before passing the detent.

Belville spring 3107 is positioned within the element retention pocket 3106 to provide an elastic restoring force between lower bearing housing 3100 and wear resistant element 3102. While FIG. 23 depicts only one Belville spring, multiple springs or alternative spring types (e.g., coil, leaf) may be included in each element retention pocket 3106 to adjust the mandrel rotation torque resistance.

Thrust ring 3105 is positioned to provide a flat, first axial load support surface against a plurality of inner bearing support races 3108. Thrust ring 3105 also has a radiused second axial load support surface to minimize corner stress against mandrel race 3103.

Bearing retainer shaft 3109 is threaded onto mandrel shaft 3101, providing a restoring clamping force to retain the inner bearing races 3108. A plurality of ball bearings (not shown) are distributed in bearing channel 3118 between the inner bearing support races 3108 and outer bearing support races 3112 to provide axial load rotational support for the bottom hole assembly. The proximal end of the bearing retainer shaft 3109 is connected to a transmission shaft assembly (not shown). This assembly can include a flex shaft, dog bone, knuckle or constant velocity type transmission to convert hypocycloid rotation from the rotor shaft of a positive displacement motor to concentric rotation utilized by the drill bit. Upper bearing housing 3111 is connected via threads to lower bearing housing 3100 to provide a compressive force on the outer bearing support races 3112 (also referred to as stack races).

Coating 3115 is disposed on the inner diameter of lower bearing housing 3100 and is in rotating sliding contact with second coating 3116, which is disposed on the outer diameter of mandrel shaft 3101, forming a lower (distal) radial bearing assembly. Coating 3113 is disposed on the inner diameter of the upper bearing housing 3111 and is in rotating, sliding contact with coating 3114, which is disposed on the outer diameter of bearing retainer shaft 3109, forming an upper (proximal) radial bearing assembly. Coatings 3115, 3116, 3113 and 3114 may each be a hard material coating. The hard material coatings of the upper radial bearing set and lower radial bearing set may be or include macro-crystalline tungsten carbide hard facing with a cobalt, nickel or brass binder, or contoured, cemented tungsten carbide tiles or polycrystalline diamond elements.

In some embodiments, the contoured mandrel race 3103 of mandrel shaft 3101, with prescribed, discrete detent concave pockets 3104, is or includes a high-performance steel, such as 4140, 4340, 8630, S7, or 17-4 PH 1150 stainless steel, or another steel grade that is typically used in oil tool drilling applications. Contoured mandrel race 3103 may additionally be treated to improve wear resistance, including carburizing, nitriding and boronizing. Other materials of which the convex pockets 3104 or portions thereof (e.g., the ridges thereof), contoured mandrel race 3103, or other adjacent surfaces may be at least partially composed of include polycrystalline diamond, cemented tungsten carbide or other wear resistant materials.

Mandrel shaft 3101 includes fluid passage 3117 through the center thereof. Drilling fluid flow is split or diverted at the proximal, entrance of the bearing retainer shaft 3109 with a volume flow of approximately 10% passing between the mandrel shaft 3101 and lower bearing housing 3100, and approximately 90% of the remaining fluid passing through the central fluid passage 3117 within mandrel shaft 3101. These volume percentages are not limiting, and are merely exemplary percentages.

Wear resistant elements 3102 may be generally cylindrical, having domed sliding contact surfaces. The domed surfaces may be coated with high pressure/high temperature sintered polycrystalline diamond containing a secondary phase of cobalt alloy, for example. The wear resistant element 3102 may also be made of or include cemented tungsten carbide or macro-crystalline tungsten infiltrated with nickel, cobalt or brass.

Figure 24:
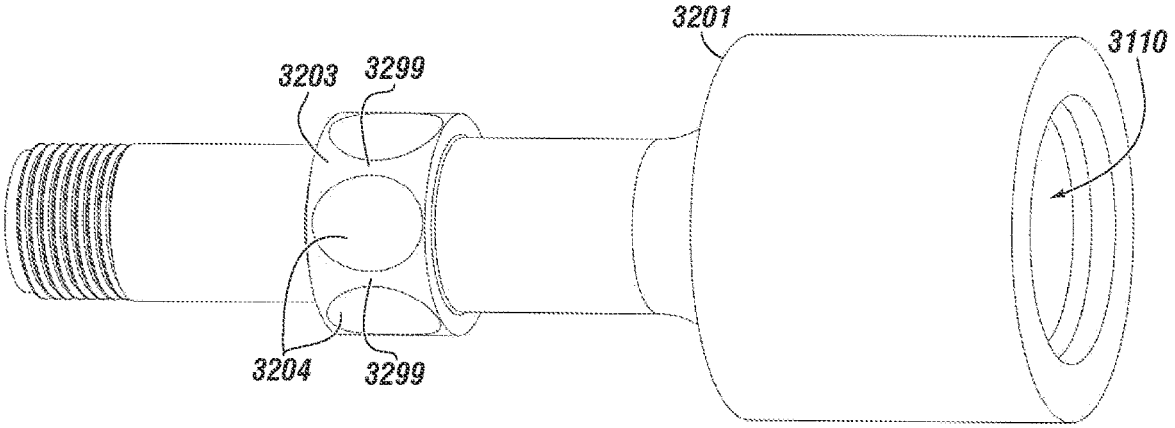
FIG. 24 depicts a mandrel shaft of a dynamic torsional detent mechanism.

FIG. 24 depicts only mandrel shaft 3201 in isolation, for clarity and convenience. Mandrel shaft 3201 may be the same or substantially the same as mandrel shaft 3101. Contoured mandrel race 3203 includes equally spaced, concave pockets 3204, with equally spaced ridges 3299 therebetween. The quantity, spacing, shape and size of the concave pockets may vary depending on the application or the designer's discretion.

While FIG. 24 depicts only one contoured mandrel race 3203 on mandrel shaft 3201, any number of contoured mandrel races and corresponding wear resistant elements may be utilized to add redundancy, augment the torque impulse resistance or to increase the detent frequency per one 360-degree rotation imposed on the rotating mandrel shaft. Furthermore, the contoured mandrel race 3203 can be an integral part of the mandrel shaft 3201 or be a separate and replaceable component part coupled therewith (e.g., a sleeve or ring).

Figure 25:
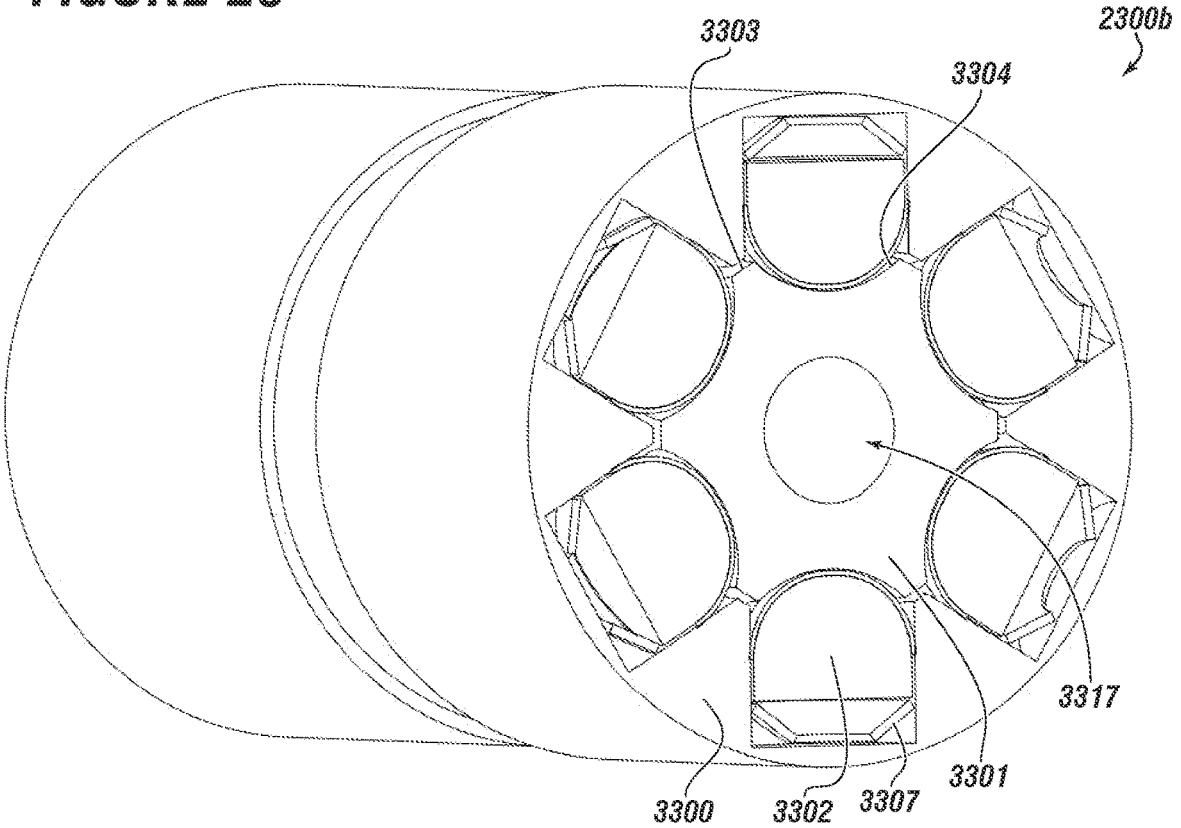
FIG. 25 is a perspective view of a dynamic torsional detent mechanism.

FIG. 25 is a view of the dynamic torsional detent mechanism including a bearing housing and mandrel shaft taken at 25-25 of FIG. 23. Dynamic torsional detent mechanism **2300*b* includes 3300, mandrel shaft 3301, a plurality of wear resistant elements 3302, a contoured mandrel race 3303, a plurality of concave pockets 3304, a plurality of Belville springs 3307, and a fluid port 3317**.

With reference to FIG. 25, a positive displacement motor and transmission assembly (not shown) connectively rotates the bearing retainer shaft (shown in FIG. 23) and mandrel shaft 3301. Each wear resistant element 3302 is in sliding contact with the contoured mandrel race 3303 and slidingly engages concave pockets 3304. Upon engagement, the plurality of wear resistant elements 3302 drop into corresponding concave pockets 3304 as a result of the imposed restoring force from the Belville springs 3307. This engagement creates a torsional resistance or detent condition. The mandrel shaft 3301 momentarily resists rotation, thus initiating a buildup of torsional potential energy from the elasticity of the drill string. After a certain torque threshold is reached, the rotational detent resistance is overcome, allowing the mandrel shaft 3301 to again resume rotation, augmented with a dynamic, short duration, amplified torque impulse.

One exemplary detent torque resistance force threshold range is between 1% and 80% of the maximum torque delivered by the positive displacement motor. The detent resistance can be adjusted in at least several ways. For example, the number of Belville springs 3307 can be varied within an element retention pocket 3306 to increase or decrease the imposed restoring force. The penetration depth of the wear resistant elements 3302 into the concave pockets 3304 can be increased or decreased. The radius of the wear resistant elements 3302 can be increased or decreased, as well as corresponding adjustments to the concave pockets 3304. The quantity of wear resistant elements 3302 and corresponding concave pockets 3304 can be increased or decreased. Dynamic torsional detent mechanism **2300*b* includes at least one wear resistant element 3302 and at least one corresponding concave pocket 3304. The number of additional sets of contoured mandrel races 3303 and corresponding wear resistant elements 3302 can be increased or decreased on the mandrel shaft 3301, allowing the option for an increased frequency of detent engagements or simultaneous, redundant detent engagements. Dynamic torsional detent mechanism 2300*b* includes at least one contoured mandrel race 3303 on the mandrel shaft 3301**.

The radial detent pattern on the contoured mandrel race 3303 is equally spaced and symmetric, as depicted in FIG. 25. However, alternative patterns of concave pocket layouts may be used. The radial detent pattern of the contoured mandrel race 3303 may also be radially asymmetric. The radial detent pattern may have as few as one concave pocket per one 360-degree rotation or as many concave pockets as can be fit per one 360-degree rotation on the contoured mandrel race 303 according to the application or designer's discretion. In some embodiments, dynamic torsional detent mechanism **2300*b* includes multiple contoured mandrel races 3303 with timed patterns, which are staggered or timed to increase the total number of aggregate detent events per one 360-degree rotation of the mandrel shaft 3301. While FIG. 25 depicts six wear resistant elements 3302 and corresponding concave pockets 3304, as few as only one wear resistant element 3302 may be used on a given contoured mandrel race 3303 or as many wear resistant elements 3302 as may be fit radially on the contoured mandrel race 3303** may be used.

Depicted between the sliding contact surfaces of wear resistant elements 3302 and concave pockets 3304 is a radius ratio of 1/1.5. However, the radius ratio between the wear resistant elements 3302 and convex surface of concave pockets 3304 can range between 1/1 to 1/4, or from 1/1.5 to 1/3.5, or from 1/2 to 1/3. In some embodiments, the sliding contact surface of wear resistant elements 3302 may be polished or highly polished. The polished contact surface of the wear resistant elements 3302 may have a hard material coating, which may be or include polycrystalline diamond; polycrystalline cubic boron nitride; macro-crystalline tungsten carbide matrix with a cobalt, nickel or brass infiltrate; cemented tungsten carbide; or infiltrated thermally stable diamond.

Figure 26:
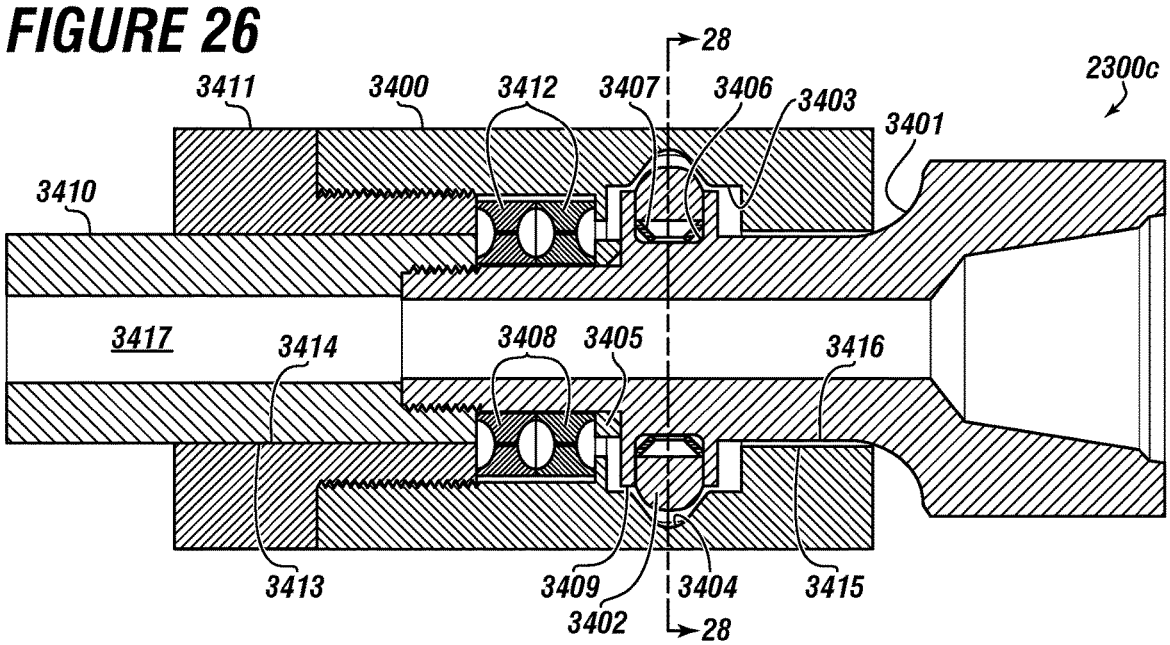
FIG. 26 is another cross-sectional view of a dynamic torsional detent mechanism.

FIG. 26 depicts dynamic torsional detent mechanism 2300*c*, which includes bearing housing 3400 rotatably connected to mandrel shaft 3401, and fluid port 3417 within the center of mandrel shaft 3401.

A plurality of convex wear resistant elements 3402 are moveably fitted on springs 3407 and captured into element retention pockets 3406 on the secondary mandrel surface 3409. Each wear resistant element 3402 is in sliding contact with the bearing housing race 3403. The convex contact surface of each sliding wear resistant element 3402 can be coated with a wear resistant hard material, such as polycrystalline diamond; cemented tungsten carbide; microcrystalline tungsten carbide infiltrated with cobalt; nickel or brass; and polycrystalline cubic boron nitride. The Belville spring 3407 is positioned between the bottom of the element retention pocket 3406 and the base of the wear resistant element 3402 provides an elastic restoring force between the two constrained surfaces.

Similar to dynamic torsional detent mechanism 2300*a* of FIG. 23, thrust ring 3405 is positioned to provide a flat, first axial load support surface against a plurality of inner bearing support races 3408. Thrust ring 3405 also has a radiused second axial load support surface to minimize corner stress against the proximal side of the secondary mandrel surface 3409.

Bearing retainer shaft 3410 is threaded onto mandrel shaft 3401, providing a restoring clamping force to retain the inner bearing races 3408. The upper bearing housing 3411 is connected via threads to the bearing housing 3400 to provide a restoring clamping force on the outer bearing support races 3412.

A plurality of ball bearings (not shown) are distributed between the inner bearing support race 3408 and outer bearing support race 3412 to provide axial load rotational support of mandrel shaft 3401. The proximal end of the bearing retainer shaft 3410 is connected to a motor drive assembly (not shown) which converts rotor shaft hypocycloid rotation of a positive displacement motor to concentric rotation to be utilized by the drill bit. Examples of typical motor drive transmission assemblies include flex shaft, knuckle, dog bone, or constant velocity type systems.

While FIG. 26 depicts a plurality of wear resistance elements on the secondary mandrel surface 3409, there can be as few as one wear resistant element per 360 degrees or as many as can be fit per 360 degrees on the secondary mandrel surface 3409 as per the application or designer's discretion. In a similar fashion, there can be as few as one concave pocket 3404 within 360 degrees of the inner diameter of the bearing housing race 3403, or as many as can be reasonably be fit within 360 degrees of the inner diameter of the bearing housing race 3403.

While FIG. 26 depicts wear resistant elements 3402 on only one secondary mandrel surface 3409, a plurality of wear resistant elements 3402 could be placed in different axial locations on either one or more secondary mandrel surfaces 3409. For example, redundant radial patterns of wear resistant elements 3402 could be utilized at various axial positions on mandrel shaft 3401. Conversely, unique timing patterns could be created using different radial patterns in multiple axial planes to create an aggregate of torsional impulse patterns.

While FIG. 26 depicts using one Belville spring 3407 for each wear resistant element 3402, multiple springs or alternative spring types (e.g., coil, leaf) could be utilized to increase or decrease the elastic restoring force depending on the application and space constraints.

While FIG. 26 depicts a radially symmetric placement of wear resistant elements 3402, the pattern placement may also be asymmetric. Also, the placement of concave pockets 3404 may be radially symmetric or asymmetric.

Mandrel shaft 3401 is rotated by a positive displacement motor (not shown), the wear resistant elements 3402 make sliding contact with the bearing housing race 3403. Upon engagement with concave pocket(s) 3404, the wear resistant elements 3402 dynamically extend as a result of the imposed elastic restoring force of the Belville springs 3407, thus causing the mandrel shaft 3401 to momentarily resist rotation. After a short interval of time, torque buildup from the positive displacement motor will soon overcome the torque threshold limit of the engaged wear resistant elements 3402 and concave pockets 3404. At that point, the wear resistant elements 3404 retract back into their respective element retention pockets 3406, allowing the mandrel shaft to once again turn freely. At the same time, the stored torsional potential energy from the elasticity of the drill string is quickly released providing a momentary, supplemental torque in the form of a discrete and sequenced impulse.

Bearing housing 3400 and bearing housing race 3403 can be made of any high strength steel, such as 4140, 4340, 8630, S7, and 17-4 PH 1150 stainless steel or other steel grades typically used in oil tool drilling applications. However, other materials may also be used to form all or a portion of the detent concave pocket ridges or other race contact surfaces subject to higher wear potential, such as polycrystalline diamond, cemented tungsten carbide or other wear resistant materials.

Bearing housing race 3403 may be an integral, unitary part of bearing housing 3400, or the bearing housing race 3403 may be a separate, replaceable sleeve or liner coupled to bearing housing 3400 to facilitate easy customization of detent patterns.

Dynamic torsional detent mechanism 2300*c* also includes coated surfaces 3413, 3414, 3415, and 3415, which are the same or substantially similar to coatings 3113, 3112, 3115, and 3116 of FIG. 23.

Figure 27:
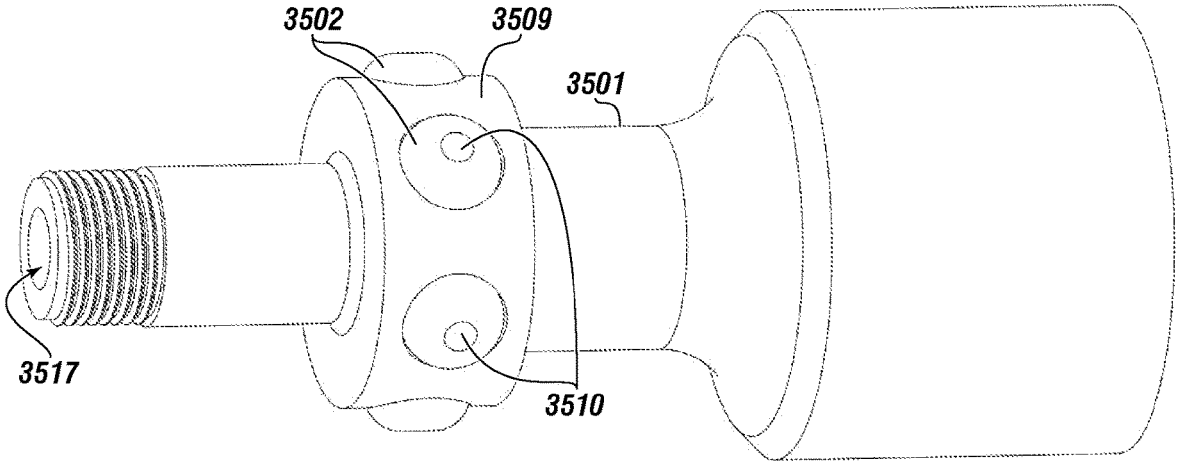
FIG. 27 is another view of a mandrel shaft of a dynamic torsional detent mechanism.

FIG. 27 depicts mandrel shaft 3501, which is the same or substantially the same as mandrel 3401. Mandrel shaft 3501 is shown in isolation from the remainder of the bottom hole assembly and bearing housing for clarity. Mandrel shaft 3501 is connected to the secondary mandrel surface 3509, which contains a plurality of wear resistant elements 3502. The mandrel shaft 3501 is also shown with fluid passage 3517. The wear resistant elements 3502 are moveably captured within the body of secondary mandrel surface 3509.

Wear resistant elements 3502 are spherical or generally spherical, but with flat contact areas 3510 in the region that makes sliding contact with the bearing housing race. Flat contact areas 3510 will facilitate increased elastic restoring forces imposed by the Belville springs, reduce the amount of load per unit area to further reduce sliding friction when not in a detent event, and reduce the amount of sliding wear imposed on the secondary mandrel surface, thus extending the service life of the detent mechanism.

FIG. 28 is a view of a dynamic torsional detent mechanism the same or similar to that of FIG. 26 (e.g., along line 28-28). Fluid port 3617 is centrally located within mandrel shaft 3601. The surface 3603 is a surface of bearing housing 3600. The secondary mandrel surface 3603 includes element retention pockets 3606, which moveably capture wear elements 3602. Flat contact areas 3610 are located at the apex of each wear resistant element 3602. Wear resistant elements 3602 make sliding contact with the bearing housing race and concave pockets 3604 thereof to provide detent engagement therewith. As the mandrel 3601 rotates the wear elements 3602 disengage from pockets 3604 and engage with surface 3603. That is, as mandrel 3601 rotates relative to bearing housing 3600, elements 3602 ride along surface 3603 and are intermittently captured within pockets 3604.

Dynamic Torsional Detent Mechanism—Design

Having now described the components of the dynamic torsional detent mechanism disclosed herein, certain considerations, parameters, and variables will now be described with reference to the designing of such dynamic torsional detent mechanisms. To design a dynamic torsional detent mechanism, one or more of the following determinations, and designations may be made: (1) determine the maximum torque output of the positive displacement motor (PDM) for application; (2) designate a detent torque limit threshold which falls between 1-80% or from 1-10% of the max torque output of the PDM; (3) determine the number of detent impulse events desired per one 360-degree rotation; (4) determine if the detent impulse events will be a symmetric or asymmetric pattern spacing; (5) determine if the wear resistant elements are to be a full spherical contact surface or include a planar top portion; (6) designate the number of wear resistant elements to number of concave pockets ratio per 360-degrees of race surface; (7) designate the curvature ratio between the concave pocket(s) and wear resistant element(s); (8) designate the depth of concave pocket to wear resistant element; (9) designate the number of races to be stacked axially; (10); designate the timing scheme between multiple races (if used) to achieve either a detent redundancy or to create an aggregate higher frequency detent timing pattern; and (11) designate Belville spring type and quantity, stack quantity, spring redundancy distributed over required surface to achieve the desired detent torque as per the drilling application and designer's discretion. Not all of these steps are necessarily required in order to design a dynamic torsional detent mechanism. Some steps may be omitted, and some steps not listed may be added. Also, these design steps, when performed, do not necessarily have to be performed in the above listed order.

Dynamic Torsional Detent Mechanism—Operation

Having now described the components of the dynamic torsional detent mechanism and well as design considerations, the operation of such dynamic torsional detent mechanisms will now be described.

During drilling, a steerable motor has two general modes of operation, including rotate and slide drilling. "Rotate drilling" is generally characterized as both the drill string and drill bit rotating at the same time. In other words, the drill string is rotated by the rotary table drive on the drill rig floor, while at the same time the drill bit is also rotated by a positive displacement motor of the bottom hole assembly. "Slide drilling" is generally characterized as the drill bit rotating while the drill string is not rotating, allowing the drill string to steer or build in a desired direction by means of a bent housing section contained in the bottom hole assembly. While not being bound by theory or drilling methodology, various configurations of the dynamic torsional detent mechanism will now be discussed.

During rotate mode drilling, both a drill bit and drill string will rotate at the same time. Included in a bottom hole assembly is a dynamic torsional detent mechanism in accordance with the present disclosure and configured for a lower frequency, higher torque limit threshold resistance. As the bit rotates, the bit will turn freely until detent engagement occurs between the wear resistant elements (e.g., 3102) and concave pockets (e.g., 3104). Upon engagement, bit rotation will be momentarily resisted causing torsional potential energy to be stored in the drill string while the drill string continues to rotate. Once the torsional detent resistance threshold is exceeded, the stored torsional potential energy in the drill string is released, allowing the bit to resume free rotation while also imparting a momentary reactive torque impulse to the bit. Without being bound by theory, prescribed torque impulse releases have the propensity to mitigate or breakup excessive torque buildups from occurring instead of an uncontrolled release of high torque and RPM, causing bit and cutting structure damage. The dynamic torsional detent mechanism will increase ROP by means of momentary, short duration energy torque impulses transmitted to the cutting structures to provide a chiseling effect.

During slide mode drilling, a drill bit rotates while the drill string and bearing housing generally does not rotate. Included in the bottom hole assembly, a dynamic torsional detent mechanism in accordance with the present disclosure is configured for a higher frequency and lower torque limit threshold resistance. As the bit rotates, it will turn freely until detent engagement occurs between the wear resistant elements and concave pockets. Upon engagement, bit rotation will be momentarily resisted. A higher frequency, lower torque resistance threshold will create a high frequency pulsing effect to reduce the propensity of or disrupt the buildup of macro torque events. A reduction of macro torque buildup events will result in better tool face control. That is, the dynamic torsional detent mechanism provides for reduced directional steer variation during slide mode drilling. The dynamic torsional detent mechanism will create an advantageous high frequency torsional vibration of the drill string to reduce sliding friction of the drill pipe in the borehole, particularly during drilling of the extended lateral section of a well.

During both side and rotate drilling, the drill bit of a bottom hole assembly is in constant rotation while powered by a positive displacement motor. Included in the bottom hole assembly, a dynamic torsional detent mechanism in accordance with the present disclosure is configured to first have a series of high frequency, low torsional resistance impulses, followed by one high torsional resistance impulse event to create a detent pattern that varies both as a function of impulse frequency and amplitude per 360-degree rotation. Such a patterned sequence may provide advantageous effects during drilling. The low frequency, large torsional impulse has the propensity to mitigate an excessive torque buildup and resultant deleterious uncontrolled torque release. The high frequency, low energy torsional impulse portion of the rotation will induce a torsional vibration or oscillation to advantageously reduce drill string friction, allowing the drill string to slide more easily while drilling particularly in the lateral section of a well.

During both slide and rotate drilling, various modes of resonant oscillations or harmonics that can occur along the drill string, which can be potentially harmful or even lead to eventual failure of the bottom hole assembly. These resonant oscillations can be an inherent natural frequency for a particular drill string design, or an oscillation that is induced by an excitation factor, such as drill string friction against the borehole wall, stabilizer blade contact or the design aggressiveness of a particular drill bit. A dynamic torsional detent mechanism incorporated into the drill string may be synchronized to cancel, breakup or significantly reduce the magnitude of these various deleterious resonant vibrations or oscillations. This can be accomplished by configuring the dynamic torsional detent mechanism to include asymmetric detent patterns, variations in detent resistance per 360 degrees of rotation, and by utilizing specific frequency cancelling detent patterns derived from empirical data taken from an MWD or similar measuring system. Such detent configurations can be effective at reducing the damaging effects of undesirable torsional vibrations or oscillations. The detent configurations may also reduce spiraling during both slide and rotate mode drilling.

The dynamic torsional detent mechanisms disclosed herein can be configured to create a lateral hammering or jarring effect, which can be used to augment a steering tendency; introduce additional cutting mechanisms, such as rock fracturing with shear cutting; and to reduce contact friction of the drill string with formation, particularly while slide drilling in the lateral section of a well. This may be accomplished by modifying the contour of the concave pockets (e.g., 3104) on the secondary mandrel surface (e.g., 3103), as well as the contour of the wear resistant elements (e.g., 3102). One non-limiting example would be to utilize a saw tooth pattern on the secondary mandrel race in lieu of concave pockets on the secondary mandrel surface. A wear resistant element would be aligned with a scribe line, or in the direction of steer for a steerable motor. As the secondary mandrel surface and mandrel shaft (e.g. 3101) rotate, a wear resistant element is gradually retracted into its respective element retention pocket (e.g., 3106) while riding up the sawtooth form. This causes the Belville spring (e.g., 3107) to become compacted. After passing the crest of a saw tooth, the wear resistant element abruptly extends back out of the retention pocket, causing a high energy lateral impulse or hammering event. This effect can be augmented by increasing the number of wear resistant elements that are axially stacked along the mandrel shaft in the same radial position being synchronized to create one high energy lateral impulse with increased aggregate mass. This effect is further augmented by using high-density materials, such as tungsten carbide, for the wear resistant elements. Furthermore, thicker Belville springs or a greater quantity of Belville springs will increase the elastic restoring force to correspondingly increase the hammering energy of the lateral impulse event. There may be a minimum of one impulse event per one 360-degree rotation, or as many impulse events as can configured on the secondary mandrel surface in one 360-degree rotation. The lateral jarring or hammering effect may be achieved by mounting the wear resistant elements on the mandrel shaft (as shown in FIG. 23) or conversely mounting them in the bearing housing (as shown in FIG. 26). The lateral jarring configuration could be used on a non-bent bottom hole assembly or a bent bottom hole assembly.

FIG. 29 depicts a simplified schematic of a portion of a drill string. Drill string 2900 includes prime mover 2902, such as a progressive cavity motor, which provides the motive force to rotate mandrel 2904 relative to bearing housing 2906. Rotation of mandrel 2904 rotates drill bit 2008. Drill string 2900 and the components thereof may be in accordance with any of the embodiments shown in FIGS. 1-28, such that drill bit 2908 may exhibit hypocycloidal motion, lateral impulses, and/or torsional impulses, depending upon the particular configuration of drill string 2900.

Methods of Drilling Using Hypocycloidal Motion

Certain embodiments of the present disclosure include methods of drilling utilizing hypocycloidal motion. In some such embodiments, the apparatus, systems, components, and mechanisms described herein with reference to FIGS. 1-28 may be used to implement the methods of drilling utilizing hypocycloidal motion.

Hypocycloidal motion of a drill string and/or drill bit may provide for increased modes of rock destruction. Hypocycloidal motion drilling creates multi-directional movement of cutting structures for rock excavation while drilling. More specifically, hypocycloidal motion provides for cutting structures to remove rock by shearing, lateral scoring, pivot grinding and crushing, as well as any combination of these modes.

In geometry, a hypocycloid is a special plane curve generated by the trace of a fixed point on a small circle that rolls within a larger circle. The pattern is created when referencing a single point on the small circle that rotates within the larger circle to create a trace with a series of cusps or points over 360 degrees.

Hypocycloidal movement can be created in a variety of ways, including helical positive displacement motors (PDM) and planetary gear systems. A positive displacement motor contains a rotor and stator. The rotor represents an elongated and helixed hypocycloid shaped body "rolling" inside a larger hypocycloid inner diameter representing the stator. Both the rotor and stator are elongated and helixed to create a motor drive mechanism. While rolling, the cusps of the rotor maintain continuous contact with the cusps of the larger hypocycloid or stator. This motion of the rotor is the same as that of the planet gears of a planetary gearing system. When a mandrel shaft and corresponding bit are directly connected to the rotor of a positive displacement motor, the bit will move in a hypocycloidal orbiting motion. Additionally, all cutting structures on the bit will trace or track with a discrete hypocycloidal pattern. This hypocycloidal pattern is changeable based on the number of cusps designed into the rotor and stator.

Method of Design

The hypocycloidal pattern related to drilling with a steerable motor is governed generally by three primary factors. These factors are orbit diameter, desired bit RPM/torque, and the PDM rotor/stator ratio required for a given drilling application. When designing a system, one of these factors is given priority as the determining factor upon which the others will become dependent factors.

When the PDM motor rotor/stator ratio is prioritized, the positive displacement motor and associated rotor/stator ratio are selected for a bottom hole assembly. The PDM motor will then dictate the bit orbit diameter. A low ratio leads to a larger orbit diameter (e.g., 1/2 ratio motor creates larger orbit diameter). A high ratio leads to a small orbit diameter (e.g., 5/6 ratio motor creates smaller orbit diameter). The PDM motor then dictates the bit revolutions per minute rotation. A low ratio PDM leads to higher rpm and lower torque (e.g., 1/2 ratio=higher rpm, low torque). A high ratio PDM leads to lower rpm, higher torque (e.g., 5/6 ratio=lower rpm, high torque).

When orbit diameter is prioritized, the desired orbit diameter of the bit is selected. The orbit diameter then dictates the ratio of motor that must be used. A larger orbit diameter leads to a low ratio motor (e.g., 1/2 ratio motor or similar may be required). A smaller orbit diameter leads to a high ratio motor (e.g., 5/6 ratio motor or similar may be required). The orbit diameter then dictates the bit RPM. A large orbit diameter leads to high RPM (e.g., a higher rpm output from a 1/2 ratio motor). A smaller orbit diameter leads to a low RPM (e.g., a lower rpm output from a 5/6 ratio motor).

When rotor RPM is prioritized, the desired rotor RPM is selected. The RPM dictates the motor ratio. A high RPM leads to a low motor ratio (e.g., a low ratio 1/2 motor to generate a high rpm). A low RPM leads to a high motor ratio (e.g., a high ratio 5/6 motor to generate a low rpm). The RPM dictates the orbit diameter. A high RPM leads to a large orbit diameter (e.g., higher rpm from a 1/2 ratio motor to create a large orbit). A low RPM leads to a small orbit diameter (e.g., lower rpm from a 5/6 ratio motor to create a small orbit).

Method—Drilling Mechanics

Bit design for concentric drilling includes the following types: rolling cones or tri-cone, polycrystalline diamond fixed cutter bits, natural diamond bits, and thermally stable diamond bits. Hybrid varieties also exist that combine attributes between these various bit types. Each of these bit types drill with a particular rock cutting methodology. For example, rolling cone bits predominantly crush rock via point loading stress. Fixed cutter bits predominantly shear rock. Natural diamond and thermally stable diamond (TSP) bits predominantly grind rock.

Hypocycloidal motion provides the ability to drill with a combination of rock cutting mechanisms. Both bits and associated cutting structures, such as polycrystalline diamond cutters (PDC), can take advantage of the multidirectional movement of hypocycloidal motion. With hypocycloid motion, a polycrystalline diamond cutter may shear when moving forward, crush and grind when pivoting, and/or score or fracture rock when moving laterally, as well as take advantage of any combinations of such movements.

As hypocycloidal motion introduces variable surface speed cutting and different cutting modes to remove rock formation, the cutting structure elements can more effectively dissipate deleterious heat. This is particularly important with polycrystalline diamond cutting elements and the localized edge point contact made with the rock. Slower surface speed intervals, the pivoting motion of cutting elements, and rock scoring to fracture rock all provide the ability to better dissipate thermal buildup at the cutting edge with improved thermal diffusion into the cutter body during slow surface speeds and pivot events while also reducing friction when the rock is laterally fractured instead of only sheared.

As hypocycloidal motion introduces multidirectional cutting action, there is a higher propensity for an increased amount of cutting element edge to be utilized during rock drilling. With traditional concentric drilling, the first signs of abrasive wear on polycrystalline diamond cutters generally initiate at the apex or static contact tip with the rock, as created by the bit shape profile. Hypocycloidal motion combines both forward, lateral and pivot motion, thus allowing a greater radial arc of polycrystalline diamond edge to engage the rock formation. This increased utilization of edge will further increase the life of the cutting elements.

As hypocycloidal motion introduces multiple directions of movement, there is a propensity for improved cutting efficiency in the cone or center most area of a bit, particularly for a fixed cutter PDC style bit. Due to the inherently low cutting surface speeds in the cone area of a fixed cutter bit, the cutting elements are more prone to higher forces and breakage. Hypocycloid motion provides both forward shearing and lateral fracturing to better remove the centermost formation of the borehole.

Traditional fixed cutter drill bits mount polycrystalline diamond cutters generally tangential to the bit profile. This traditional cutter mounting is best suited for concentric bit rotation, creating discrete radial cutting paths. More specifically, the cutting element cylindrical side (shank) and end portion made of tungsten carbide are metallurgically brazed at an angle to a mating bit pocket, allowing the cutting element to have a negative rake angle to cut the rock formation. The cutting element face subsequently shears the rock formation as the bit is rotated.

Hypocycloid motion of a bit can utilize traditional cutter mounting techniques, or take advantage of alternative cutter mounting techniques. One non-limiting example is to position cutting elements perpendicular to the bit profile, or in other words, mounting a cutting element to stand with the diamond table face making sliding contact with the rock formation and being generally tangent to the bit profile. Alternatively, the cutting element would be brazed on the bit to stand, but also be positioned with a degree of angle in any direction within 360 degrees as per the designer's discretion.

Hypocycloid motion of a bit can utilize traditional geometry cylindrical cutters or take advantage of alternative cutting element geometries. As hypocycloid motion allows a cutting structure to move in multiple directions, including forward, lateral, pivoting, backward and any combination of the movement thereof. Thus, a cutter may be mounted perpendicularly to the bit face, with the cutter and diamond table standing. In this position, the diamond table may be shaped to be non-round, including non-limiting shapes of square, rectangular, hexagonal, or ovoid. Alternatively, the diamond table top can have non-limiting surface contours including a concave top, convex top or other non-planar surfaces.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A dynamic lateral impulse drilling assembly of a drill string, the assembly comprising:

a mandrel shaft;

a bearing housing coupled with the mandrel shaft, wherein the bearing housing is coupled with the mandrel shaft via sliding engagement between at least one primary bearing pad and at least one primary bearing race, and via sliding engagement between at least one wear-resistant element and at least one secondary bearing race, wherein the at least one secondary bearing race is an undulating surface; and wherein the mandrel shaft includes the at least one primary bearing pad and the at least one wear-resistant element thereon; and the bearing housing includes the at least one primary bearing race and the at least one secondary bearing race thereon; or the bearing housing includes the at least one primary bearing pad and the at least one wear-resistant element thereon; and the mandrel shaft includes the at least one primary bearing race and the at least one secondary bearing race thereon.

2. The assembly of claim 1, wherein the at least one primary bearing pad is coupled within a recessed pocket on the mandrel shaft or the bearing housing.

3. The assembly of claim 2, further comprising an elastic restoring force member positioned between the at least one primary bearing pad and the recessed pocket.

4. The assembly of claim 3, wherein each elastic restoring force member includes a Belville spring, a coil spring, a leaf spring, or an elastomer pad.

5. The assembly of claim 1, wherein an arcuate length of the at least one primary bearing pad is equivalent to from a 45-degree arc section of the at least one primary bearing race to a 355-degree arc section of the at least one primary bearing race.

6. The assembly of claim 1, wherein the at least one primary bearing pad and the at least one wear-resistant element are each positioned on an outer surface of the mandrel shaft, and are separated from one another by from 135 degrees to 225 degrees, radially, along the outer surface of the mandrel shaft, as measured from a center of the at least one primary bearing pad to a center of the at least one wear-resistant element.

7. The assembly of claim 1, wherein the assembly includes multiple primary bearing pads positioned within a shared axial plane.

8. The assembly of claim 1, wherein the at least one wear-resistant element is cylindrical and includes a convex or spherical crown having a sliding contact surface radius that is equal to or less than the smallest radius of the at least one secondary bearing race.

9. The assembly of claim 1, wherein movement of the at least one wear-resistant element along the at least one undulating surface moves the mandrel shaft laterally.

10. The assembly of claim 1, wherein a pattern of undulations on the at least one secondary bearing race defines: a frequency of lateral movements imparted to the mandrel shaft as the at least one wear-resistant element moves along the at least one secondary bearing race; a number of lateral impulses imparted to the mandrel shaft in one 360-degree rotation of the at least one wear-resistant element along the at least one secondary bearing race; or combinations thereof.

11. The assembly of claim 1, wherein a pattern of undulations on the at least one secondary bearing race is a sinewave pattern, a half-wave pattern, or a sawtooth pattern.

12. The assembly of claim 1, wherein a pattern of undulations on the at least one secondary bearing race is symmetrical.

13. The assembly of claim 1, wherein a pattern of undulations on the at least one secondary bearing race is asymmetrical.

14. The assembly of claim 1, wherein an amplitude displacement distance of the mandrel shaft as a result of movement of the at least one wear-resistant element along the at least one undulating secondary bearing race is 0.025 inches or greater.

15. The assembly of claim 1, wherein an impulse frequency of lateral impulses imparted to the mandrel shaft per 360-degree rotation of the at least one wear-resistant element along the at least one undulating secondary bearing race is one impulse per 360-degree rotation or greater.

16. The assembly of claim 1, wherein the at least one secondary bearing race is contoured to have a prescribed pattern of undulations that is synchronized to coincide with a bottom hole assembly scribe line associated with a direction of steer on a steerable motor of the drill string.

17. The assembly of claim 1, further comprising at least one axial thrust bearing rotatably coupled between the mandrel shaft and the bearing housing.

18. The assembly of claim 17, wherein each axial thrust bearing includes a sliding, dual carrier ring that holds a plurality of bearing elements.

19. The assembly of claim 1, wherein the assembly includes one centrally located primary bearing race and two secondary bearing races located axially above and below the primary bearing race, wherein the secondary bearing races are synchronized with matching undulating patterns, such that the mandrel shaft rotates and translates laterally relative to the secondary bearing races while maintaining parallelism within the bearing housing.

20. The assembly of claim 1, wherein the bearing housing is rotatably connected to the mandrel shaft and axially supported thereon via a thrust and radial sliding bearing.

21. The assembly of claim 1, wherein the mandrel shaft includes the at least one primary bearing pad and the at least one wear-resistant element thereon, and the bearing housing includes the at least one primary bearing race and the at least one secondary bearing race thereon.

22. The assembly of claim 1, wherein the bearing housing includes the at least one primary bearing pad and the at least one wear-resistant element thereon, and the mandrel shaft includes the at least one primary bearing race and the at least one secondary bearing race thereon.

23. A method of drilling using a drill string that includes a mandrel shaft slidingly coupled with a bearing housing, the method comprising:

rotating the mandrel shaft relative to the bearing housing, wherein the mandrel shaft and bearing housing are slidingly coupled via a wear-resistant element engaged with an undulating bearing race;

while rotating the mandrel shaft, laterally moving the mandrel shaft relative to a longitudinal axis of the bearing housing;

wherein the lateral movement of the mandrel shaft is induced by sliding the wear-resistant element along the undulating bearing race.

24. The method of claim 23, wherein the lateral movement of the mandrel shaft imparts lateral movement to a drill bit coupled therewith.

25. The method of claim 24, wherein the lateral movement of the drill bit increases the degree of fracturing of rock formation relative to the degree of fracturing of rock formation in the absence of the lateral movement of the drill bit.

26. The method of claim 24, wherein the lateral movement of the mandrel shaft provides an additional force component to cutting action during drilling operations, increases cutting efficiency and speed, and reduces frictional engagement between the drill string and a wellbore.

27. The method of claim 23, wherein the undulating bearing race is a continuous, sinoidal undulating surface that induces the mandrel shaft to move laterally, from side-to-side, while rotating and maintaining parallelism with bearing housing.

28. The method of claim 23, wherein the undulating bearing race defines a sawtooth surface pattern that induces gradual lateral movements of the mandrel shaft followed by abrupt retractions of the mandrel shaft, thereby creating momentary, high-energy lateral movement impulses of the mandrel shaft and a drill bit coupled therewith.

29. The method of claim 23, wherein movement of a drill bit coupled with the mandrel shaft is aligned or synchronized with a direction of steer or scribe line of a bottom hole assembly of the drill string.

30. The method of claim 23, wherein lateral movements of the mandrel shaft reduce drill string friction while sliding the drill string through a wellbore.

31. The method of claim 23, wherein the lateral movements of the mandrel shaft are synchronized, via the undulating bearing race, to reduce or cancel resonant oscillations and vibrations of the drill string.

32. The method of claim 23, wherein the mandrel shaft includes at least one primary bearing pad and the wear-resistant element; wherein the bearing housing includes at least one primary bearing race and the undulating bearing race; and wherein the bearing housing is coupled with the mandrel shaft via sliding engagement between the at least one primary bearing pad and the at least one primary bearing race, and via sliding engagement between the wear wear-resistant element and the undulating bearing race.

33. The method of claim 23, wherein the bearing housing includes at least one primary bearing pad and the wear-resistant element; wherein the mandrel shaft includes at least one primary bearing race and the undulating bearing race; and wherein the mandrel shaft is coupled with the bearing housing via sliding engagement between the at least one primary bearing pad and the at least one primary bearing race and via sliding engagement between the wear-resistant element and the undulating bearing race.

34. A dynamic lateral impulse drilling assembly of a drill string, the assembly comprising:

a mandrel shaft;

a bearing housing coupled with the mandrel shaft via sliding engagement between a primary bearing pad and a primary bearing race and via sliding engagement between a wear-resistant element and a secondary bearing race, wherein the secondary bearing race is an undulating surface.

35. The assembly of claim 34, wherein the wear-resistant element comprises polycrystalline diamond, and wherein secondary bearing race comprises steel.

36. The assembly of claim 34, wherein the wear-resistant element is on the mandrel shaft and the secondary bearing race is on the bearing housing.

37. The assembly of claim 34, wherein the primary bearing pad is on the mandrel shaft and the primary bearing race is on the bearing housing.

* * * * *